US010632364B2

(12) United States Patent
Braun

(10) Patent No.: US 10,632,364 B2
(45) Date of Patent: Apr. 28, 2020

(54) SIMULATED AMERICAN FOOTBALL GAME

(71) Applicant: Steven Craig Braun, Arcadia, CA (US)

(72) Inventor: Steven Craig Braun, Arcadia, CA (US)

( * ) Notice: Subject to any disclaimer, the term of this patent is extended or adjusted under 35 U.S.C. 154(b) by 0 days.

(21) Appl. No.: 15/786,527

(22) Filed: Oct. 17, 2017

(65) Prior Publication Data

US 2018/0117453 A1 May 3, 2018

Related U.S. Application Data

(60) Provisional application No. 62/414,367, filed on Oct. 28, 2016.

(51) Int. Cl.

| | |
|---|---|
| ***A63F 3/00*** | (2006.01) |
| *A63F 7/40* | (2006.01) |
| *A63F 7/06* | (2006.01) |

(52) U.S. Cl.

CPC ..... *A63F 3/00041* (2013.01); *A63F 7/06* (2013.01); *A63F 7/0616* (2013.01); *A63F 2007/4068* (2013.01)

(58) Field of Classification Search

CPC ..... A63F 3/00041; A63F 7/06; A63F 7/0616
USPC ..... 473/465, 470, 471; 273/108.4, 108.41
See application file for complete search history.

(56) References Cited

U.S. PATENT DOCUMENTS 1,577,932 A * 3/1926 Palese ..... A63F 3/00041 273/247
1,603,717 A * 10/1926 Rubino ..... A63F 7/0668 273/108.4
2,239,431 A * 4/1941 Shepherd ..... A63F 7/06 273/108.4
3,375,007 A * 3/1968 Meyer ..... A63F 3/00041 273/247
3,758,113 A * 9/1973 Trbovich ..... A63F 7/06 273/108.4
3,782,726 A * 1/1974 Huffman ..... A63F 7/3603 273/108.41
3,814,426 A * 6/1974 Moe ..... A63F 7/06 273/237
5,087,051 A * 2/1992 LoBue ..... A63F 3/00041 273/247
5,423,550 A * 6/1995 Guthrie ..... A63F 3/00041 273/247
5,501,456 A 3/1996 Collins
D393,492 S 4/1998 Van Wormer
(Continued)

*Primary Examiner* — Mark S Graham
(74) *Attorney, Agent, or Firm* — Eric Kelly

(57) ABSTRACT

A simulated American football game, with a particular gaming surface, and methods of play are described. The gaming surface may include an elongate "I" shaped field that may include a simulated field region bounded by two opposing simulated play regions in a same plane. The simulated field region may simulate a 100 yard American football field and may include LED lighting to track a line of scrimmage and to track a first down yard marker target. The two opposing simulated play regions may provide for a diversity and plurality of various play outcomes that may dictate certain gameplay results when a slider comes to rest mostly over a given target or region. The slider may be slid from one opposing simulated play region, across the simulated field region to the other opposing simulated play region. In some embodiments, defensive blocking obstacles may be used to intentionally increase gameplay difficulty.

11 Claims, 44 Drawing Sheets

(56) References Cited

U.S. PATENT DOCUMENTS

| | | | | |
|---|---|---|---|---|
| 5,967,513 | A | 10/1999 | Wells | |
| D419,797 | S | 2/2000 | Pelletier | |
| 6,322,073 | B1 * | 11/2001 | Davis | A63F 3/00041 273/236 |
| 6,402,154 | B1 * | 6/2002 | Hess | F41J 3/0076 273/317.5 |
| 6,428,006 | B1 * | 8/2002 | Stewart | A63F 3/00041 273/247 |
| D475,092 | S | 5/2003 | Maggi | |
| 7,806,409 | B1 * | 10/2010 | Cardenas | F41J 5/04 273/371 |
| 8,944,435 | B2 | 2/2015 | Kolb | |
| D761,914 | S | 7/2016 | Stirnkorb | |
| D798,388 | S | 9/2017 | Santoro | |
| 2003/0203774 | A1 * | 10/2003 | Pettey | A63B 67/002 473/470 |
| 2013/0032997 | A1 * | 2/2013 | Kolb | A63F 3/0052 273/108.4 |

* cited by examiner

SIMULATED AMERICAN FOOTBALL GAME

PRIORITY NOTICE

The present application claims priority under 35 U.S.C. § 119(e) to U.S. Provisional Patent Application Ser. No. 62/414,367 filed on Oct. 28, 2016, the disclosure of which is incorporated herein by reference in its entirety.

TECHNICAL FIELD OF THE INVENTION

The present invention relates in general to American football and parlor games and more specifically to parlor games that simulate American football.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

American football is enjoyed by millions, at diverse ages, diverse levels of play, as players, and as fans and spectators. Yet presently (circa 2016) there are no simulated versions of American football available to play that are comparable in size to existing parlor games found in bars, arcades, and the like. For example, there are air hockey tables which simulate hockey. For example, there are foosball tables which simulate soccer. For example, there are table tennis (ping-pong) tables which simulate tennis. For example, there are shuffleboard tables which simulate shuffleboard. And among existing parlor games there are of course pool and billiards tables. But there are no comparably sized games available to simulate American football.

There is U.S. Utility Pat. No. 8,944,435 which attempts to teach a table version of an American rules football game; however, that patent suffers from a number of problems. For example, the drawing figures included in that patent are entirely devoid of reference numerals and it is not clear whether the patent is definite and enabling as required by law. Additionally, that patent utilizes a simulated 100 yard field that is raised off of the game playing field and thus separated from gameplay mechanics; which is a significant deviation from how American football is played where the 100 yard field in inseparable from gameplay. It would be desirable to have a parlor game style of game to simulate American football wherein the simulated 100 yard field is integral to gameplay mechanics; wherein the simulated 100 yard field and the game playing field all reside in the same plane.

Additionally, by raising the simulated 100 yard field off of the game playing field, this requires additional structural members, which increases the overall complexity of manufacturing such a table game as compared against a game wherein the simulated 100 yard field is integral to the overall game playing field.

Further, by raising the simulated 100 yard field off of the game playing field, this means that the resulting game playing field is sunken in relation to the simulated 100 yard field, which not only deviates from a look of an American football field, but also may create undesirable viewing limitations for players and/or spectators viewing this sunken game playing field as compared against a game playing field that is not sunken.

There is a need in the art for a parlor game style of game to simulate American football wherein the simulated 100 yard field is integral to gameplay mechanics.

It is to these ends that the present invention has been developed.

BRIEF SUMMARY OF THE INVENTION

To minimize the limitations in the prior art, and to minimize other limitations that will be apparent upon reading and understanding the present specification, the present invention may describe simulated American football games, with a particular gaming surface, and methods of gameplay on such gaming surface. In some embodiments, the gaming surface may comprise an elongate "I" shaped field that may comprise a simulated field region bounded by two opposing simulated play regions, in a same plane. In some embodiments, the simulated field region may simulate a 100 yard American football field and may comprise LED (light emitting diode(s)) lighting to track a line of scrimmage and to track a first down yard marker target. In some embodiments, the two opposing simulated play regions may provide for a diversity and plurality of various play outcomes that may dictate certain gameplay results when a slider comes to rest mostly over a given target or region within an opposing simulated play region. In some embodiments, the gaming surface or game may comprise at least one removable slider. In some embodiments, the slider may be slid from one opposing simulated play region, across the simulated field region to the other opposing simulated play region. In some embodiments, defensive blocking obstacles may be used to intentionally increase gameplay difficulty.

It is an objective of the present invention to provide a game and/or gaming surface for playing simulated versions of American football.

It is another objective of the present invention to provide a game and/or gaming surface for playing simulated versions of American football wherein the gaming surface is sized comparable to existing parlor (arcade) games.

It is another objective of the present invention to provide a game and/or gaming surface for playing simulated versions of American football wherein the gaming surface includes a simulated 100 yard field, such that gameplay includes use of the simulated 100 yard field.

It is another objective of the present invention to provide a game and/or gaming surface for playing simulated versions of American football wherein different versions of the gaming surface may be for full sized use (e.g., comparably sized to existing parlor games) and a smaller version for home use.

It is another objective of the present invention to provide a game and/or gaming surface for playing simulated versions of American football that may utilize various LED lighting effects, for example, to track where the line of scrimmage may be located and/or to track where a first down yard marker may be located.

It is another objective of the present invention to provide a game and/or gaming surface for playing simulated versions of American football that may include various sound effects, including, but not limited to, a speaker for emitting noise of simulated fans/spectators, and/or announcer and/or of players making plays.

It is another objective of the present invention to provide a game and/or gaming surface for playing simulated versions of American football that may provide for different levels of difficulty, which may be incorporated by the players selecting various styles of play; such as, but not limited to, high school style, college style, professional style and/or non-professional style.

It is another objective of the present invention to provide a game and/or gaming surface for playing simulated versions of American football that may provide for different levels of difficulty, by utilizing various physical obstacles (e.g., blockers) to make it more difficult for an offensive player to reach a particular desired offensive target (objective).

It is another objective of the present invention to provide a game and/or gaming surface for playing simulated versions of American football that may include motion detectors and accompanying algorithms to automatically determine locations of sliders moving across the gaming surface.

It is another objective of the present invention to provide a game and/or gaming surface for playing simulated versions of American football that may utilize a computer and internet connectivity hardware to connect with remote servers such that gameplay statistics from a given game play or gaming surface play may be communicated to such remote servers.

It is another objective of the present invention to provide a game and/or gaming surface for playing simulated versions of American football that may be integrated into a supportive structure, such as, but not limited, to a cabinet or table, and the like.

It is another objective of the present invention to provide a game and/or gaming surface for playing simulated versions of American football that may be removable from a supportive structure (such as, but not limited to, a table or table top).

It is yet another objective of the present invention to provide a game and/or gaming surface for playing simulated versions of American football that may be mobile and easily transported from site to site.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1I may also show Region-1J.

FIG. 2A may also show the following regions: Region-2B, Region-2C, and Region 2-D.

FIG. 5A may also show Region-5B.

REFERENCE NUMERALS

Figure 1A:
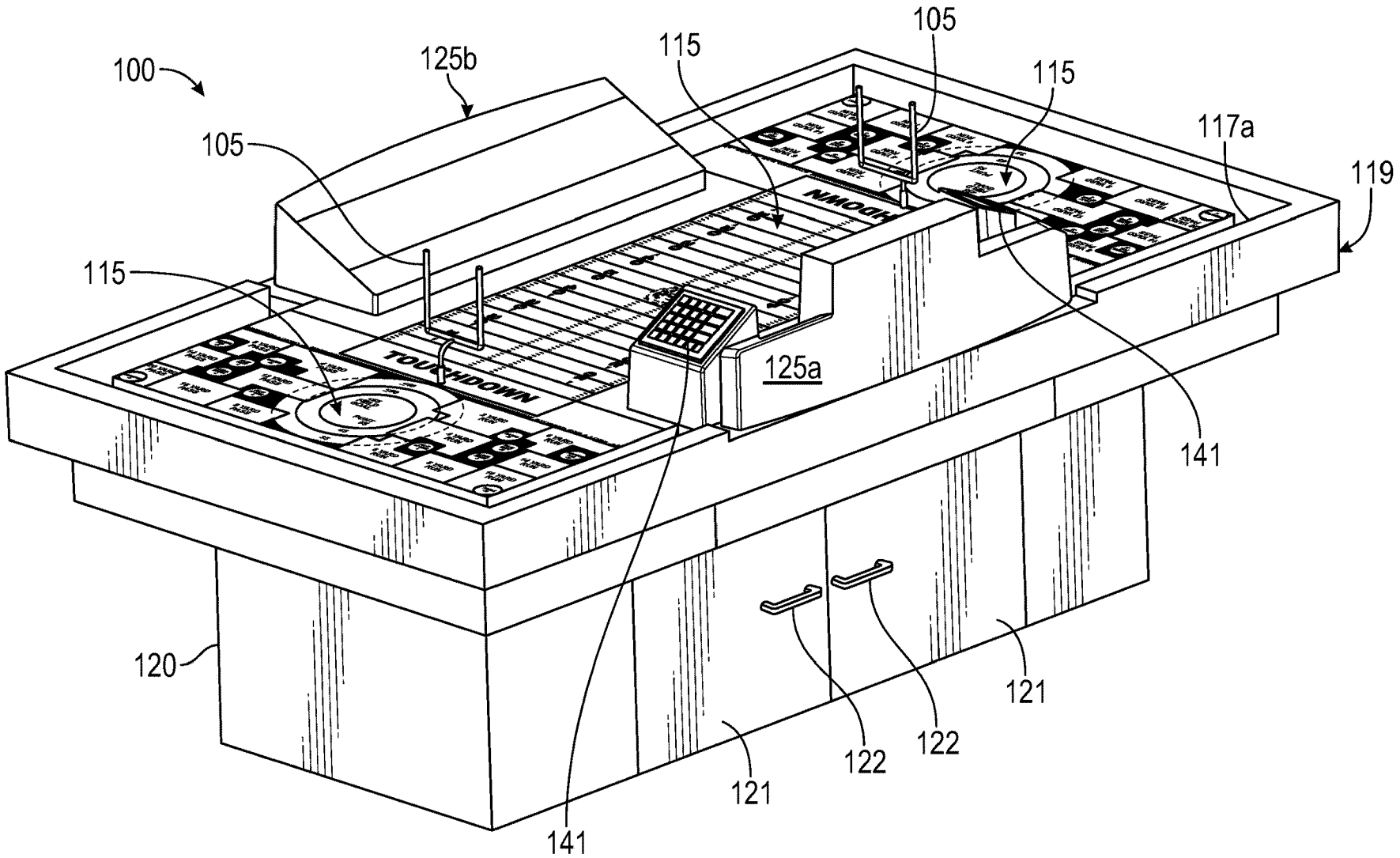
FIG. 1A may depict an embodiment of an overall game, from a perspective view; wherein the game may be simulating American football gameplay.

100 game 100
105 decorative field goal post 105
115 top surface 115
117*a* catch basin 117*a*
117*b* catch basin 117*b*
119 supportive structure 119
120 base 120
121 door 121
122 handle 122
125*a* simulated spectator stand 125*a*
125*b* simulated spectator stand 125*b*
126 ricochet wall 126
128 display 128
129 display cover 129
130 display board 130
131 display housing 131
141 controls 141
142 buttons cover 142
143 buttons 143
144 buttons housing 144
200 gaming surface 200
204 simulated field graphics 204
206*a* simulated play region graphics 206*a*
206*b* simulated play region graphics 206*b*
211*a* simulated end-zone 211*a*
211*b* simulated end-zone 211*b*
213 logo or trademark 213
215 yardage marker 215
217 major yardage marker 217
220 goal line 220
221 run targets 221
231 pass targets 231
241 kick targets 241
251 no gain regions 251
261 penalty regions 261
271 turnover regions 271
529 score display 529
530 present down 530
531 yards to go for a first down 531
532 current possession 532
533 time outs remaining 533
544 line of scrimmage indicator 544
600 slider 600
601 slider top 601
603 slider bottom 603
605 slider side 605
700 simulated defensive players 700
701 individual defensive player 701
703 linkage 703
705 slider gap 705
707 base 707
709 anchor 709
800 method of playing a simulated American rules football game 800
805 offensive possession start conditions 805
810 sliding step 810
811 run targets slide outcome 811
812 pass target slide outcome 812
813 kick targets slide outcome 813
814 "To the House" slide outcome 814
815 no gain targets slide outcome 815
816 too hard slide outcome 816
817 too soft slide outcome 817
818 penalty targets slide outcome 818
819 undesired slide outcomes 819
820 desired slide outcomes 820
821 yardage gain outcome 821
823 advancing line of scrimmage and advance Down 823
825 advance line of scrimmage and new $1^{st}$ Down and New $1^{st}$ Down Target 825
827 touchdown outcome 827
829 down determination 829
831 outcome if present down is less than $4^{th}$ Down 831
833 outcome if present down is $4^{th}$ Down 833
835 punt attempt 835
837 field goal attempt 837
839 "Go for It" 839
841 field goal success determination 841
843 successful field goal 843
845 unsuccessful field goal 845
847 change of possession 847
849 change of possession 849

851 style of play determination 851
853 no yardage gain 853 (or "high school" style of play 853)
855 yardage loss 855 (or not "high school" style of play 855)
857 no gain outcome and no change to line of scrimmage and advance Down 857
859 loss of yard(s) and retract line of scrimmage and advance Down 859
861 loss of yard(s) and retract line of scrimmage and repeat Down 861
871 turnover outcome 871
901 style determination 901
1000 computer 1000
1001 controller/processor 1001
1003 memory 1003
1005 inputs 1005
1007 outputs 1007
1009 networking hardware 1009
1011 power supply 1011
1100 game 1100
1119 bumper border 1119
1201 overall length 1201
1203 simulated field length 1203
1204 simulated field region 1204
1205*a* play region length 1205*a*
1205*b* play region length 1205*b*
1206*a* simulated play region 1206*a*
1206*b* simulated play region 1206*b*
1211 overall transverse width 1211
1213 field region transverse width 1213
1221 shorter supportive structure 1221
1223 supportive structure 1223
1227 motion detector 1227
1231 goal post receiver 1231
1245 backlighting region 1245
1300 method of play 1300
1301 kicks 1301
1302 Professional Style 1302
1303 Does Offense Intend to Kick 1303
1304 Receive Players' Run/Pass Selection 1304
1305 Players selected different Run/Pass Intentions 1305
1306 Blockers Off 1306
1307 Players selected same Run/Pass intentions 1307
1308 Blockers On 1308
1309 Slide Outcomes 1309
1310 Non-Professional Style 1310
1311 Does Offense Intend to Kick 1311
1312 Gain 1312
1313 Advance LOS 1313
1314 Touchdown? 1314
1315 $1^{st}$ Down Achieved? 1315
1316 Reset $1^{st}$ Down Marker 1316
1317 No Gain 1317
1318 No Change to LOS 1318
1319 Was it $4^{th}$ Down? 1319
1320 Advance Down 1320
1321 Loss 1321
1322 Retract LOS 1322
1323 Is It A Safety? 1323
1324 Penalty 1324
1325 Retract LOS 1325
1326 Repeat Down 1326
1327 Turnover 1327
1328 Advance LOS 1328
1329 7 Points Added to Score 1329
1330 2 Points Added to Score 1330
1331 3 Points Added to Score 1331
1347 change of possession 1347
1348 change of possession 1348

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Note, as used herein, "football" may refer to American football and not soccer.

Figure 1B:
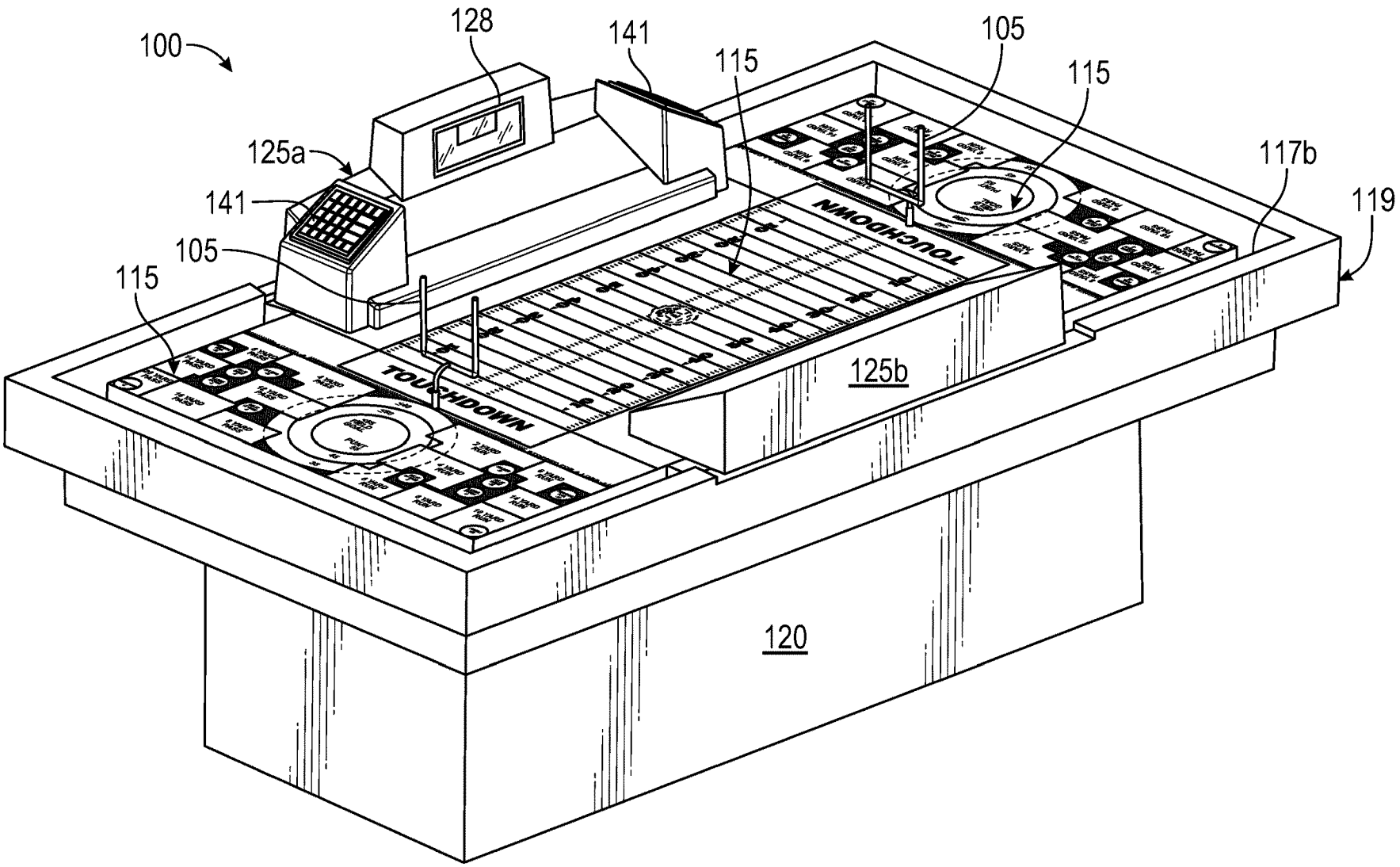
FIG. 1B may depict an opposing perspective view as compared against FIG. 1A.
Figure 1C:
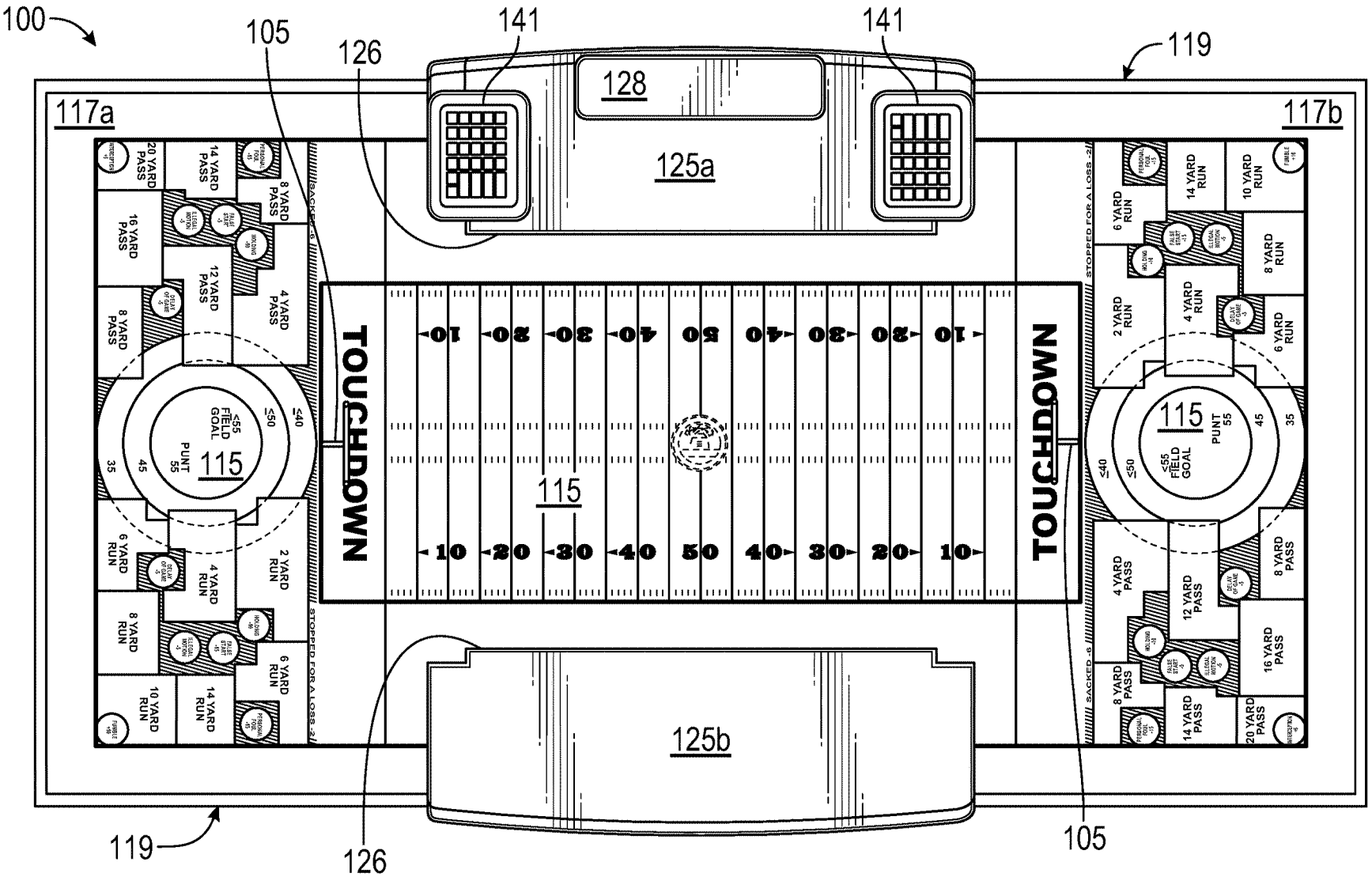
FIG. 1C may depict a top view of the embodiment from FIG. 1B.
Figure 1D:
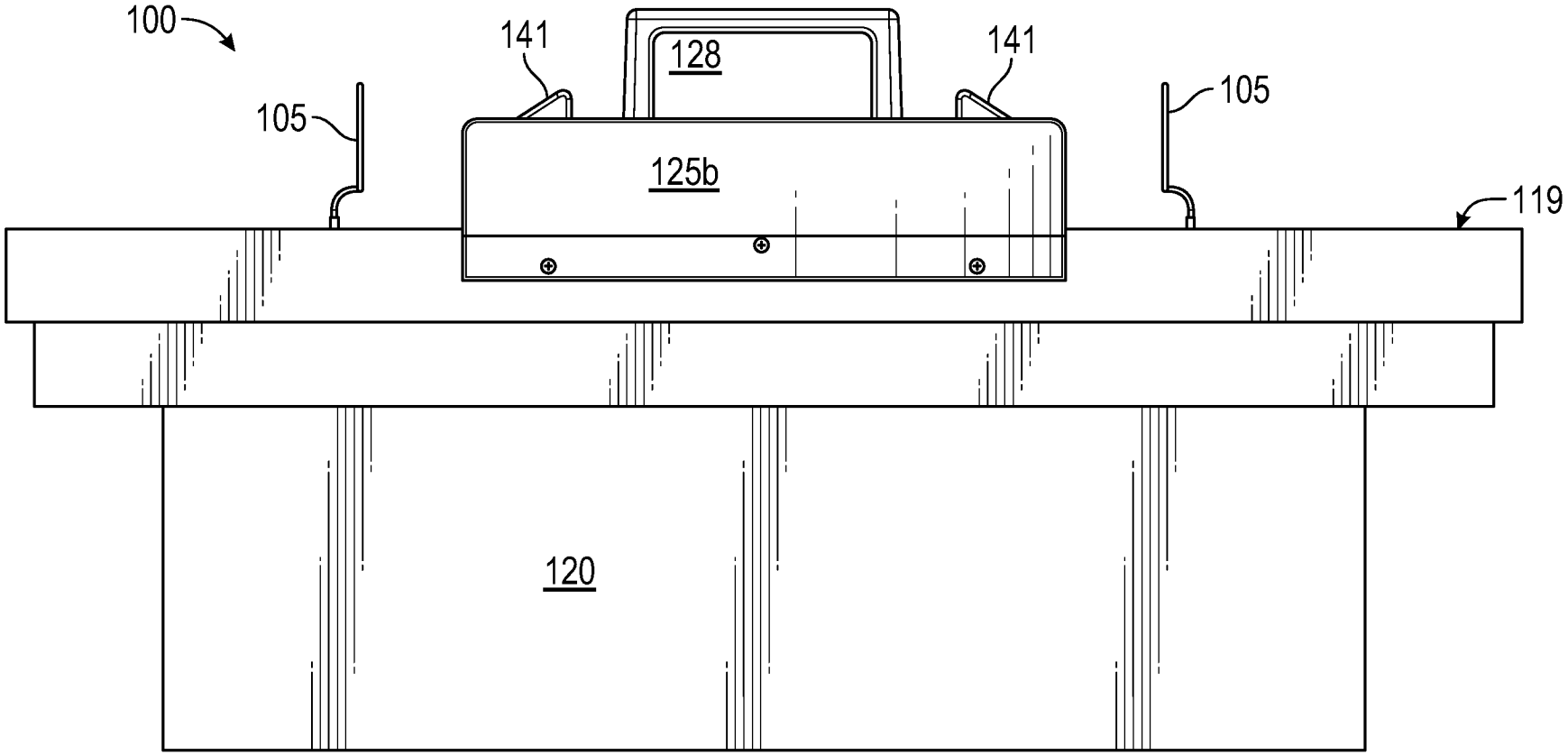
FIG. 1D may depict a longitudinal side view of the embodiment from FIG. 1B.
Figure 1E:
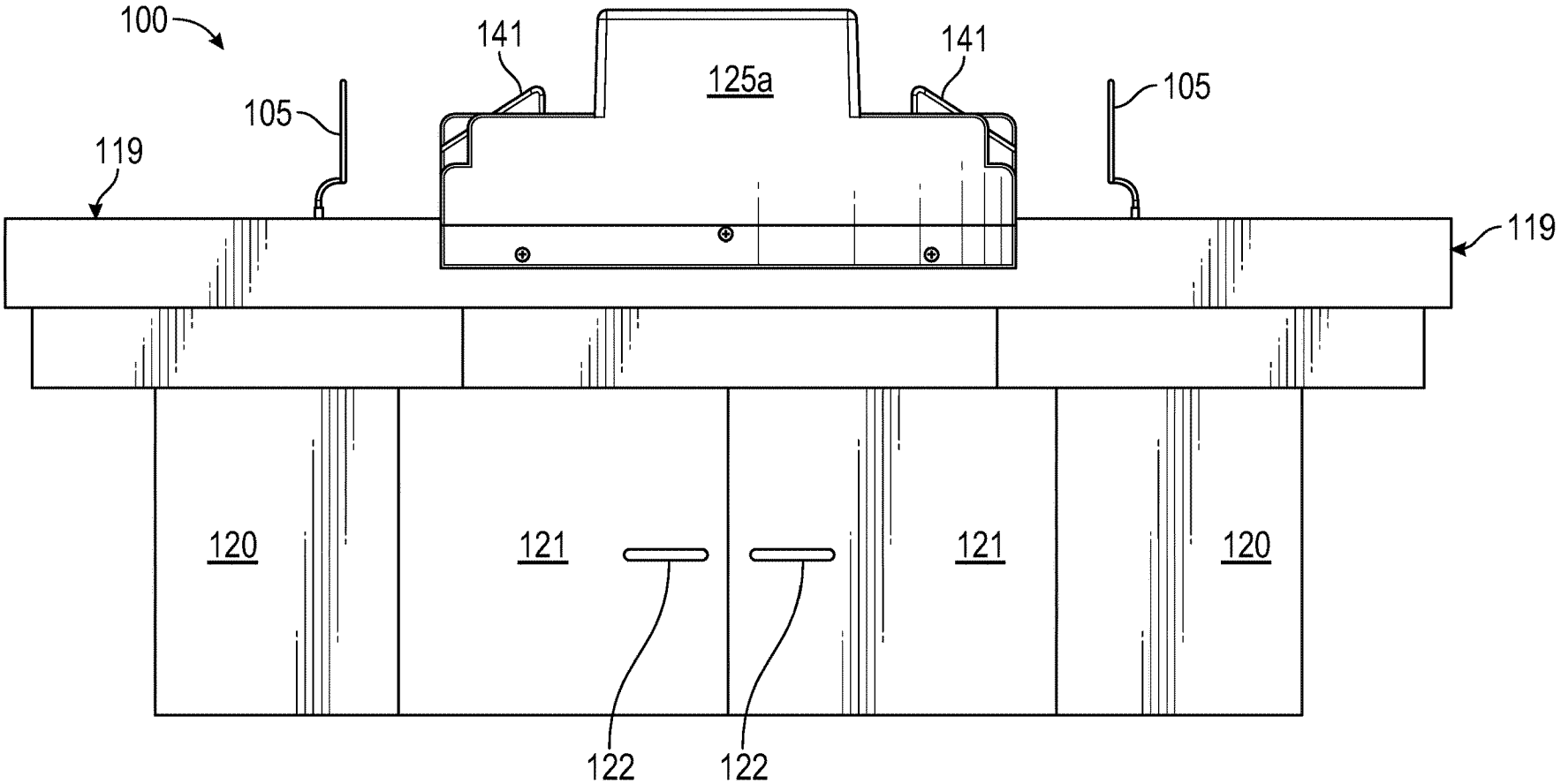
FIG. 1E may depict an opposing longitudinal side view as compared against the view of FIG. 1D.
Figure 1F:
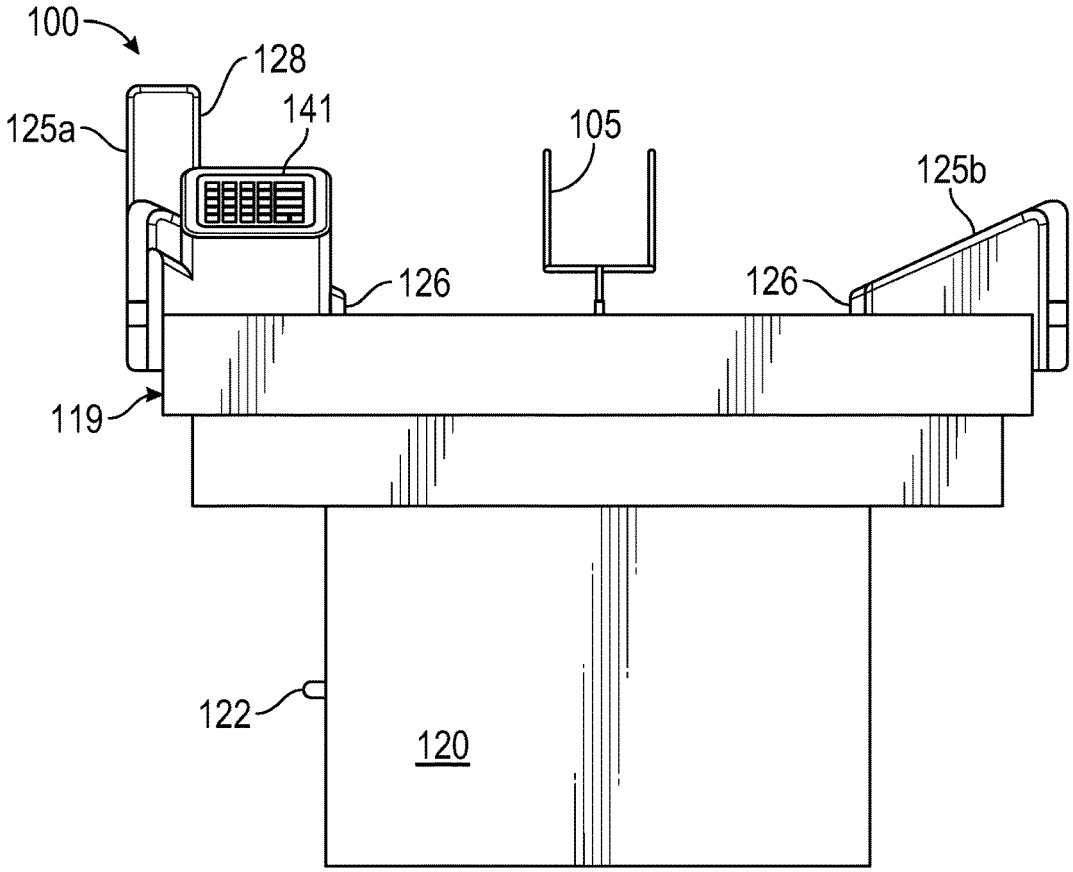
FIG. 1F may depict an end side view of the embodiment from FIG. 1A.
Figure 1G:
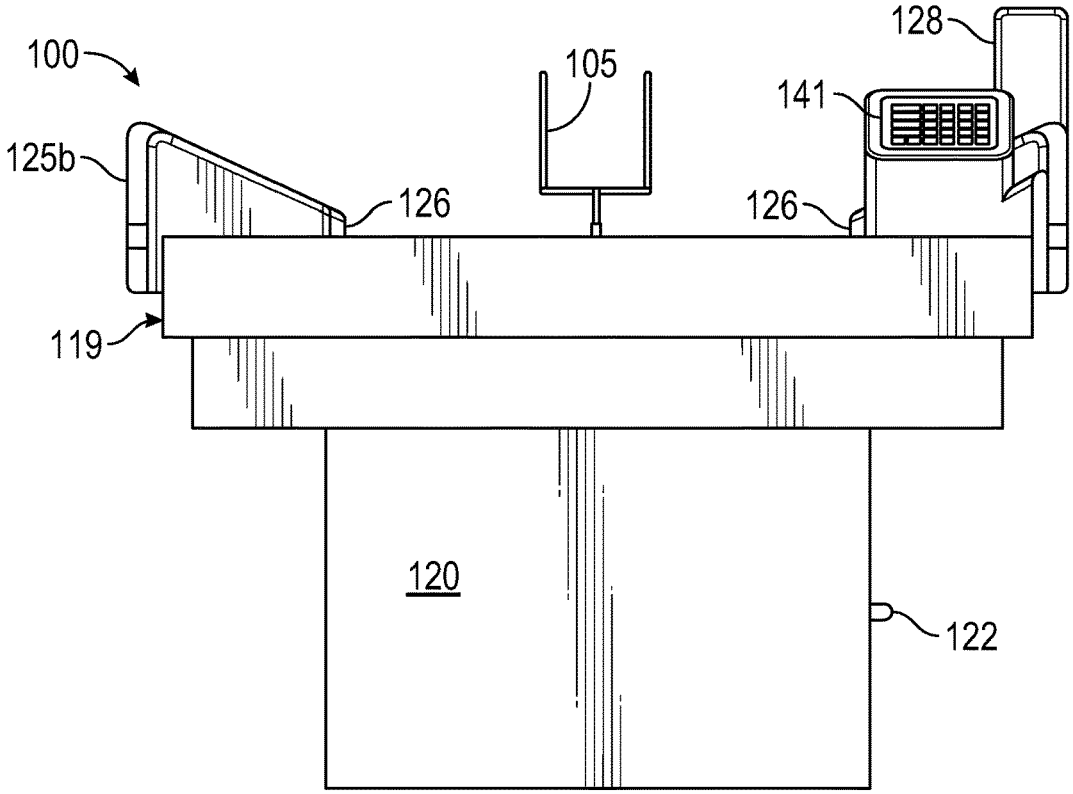
FIG. 1G may depict an opposing end side view as compared against the view of FIG. 1F.
Figure 1H:
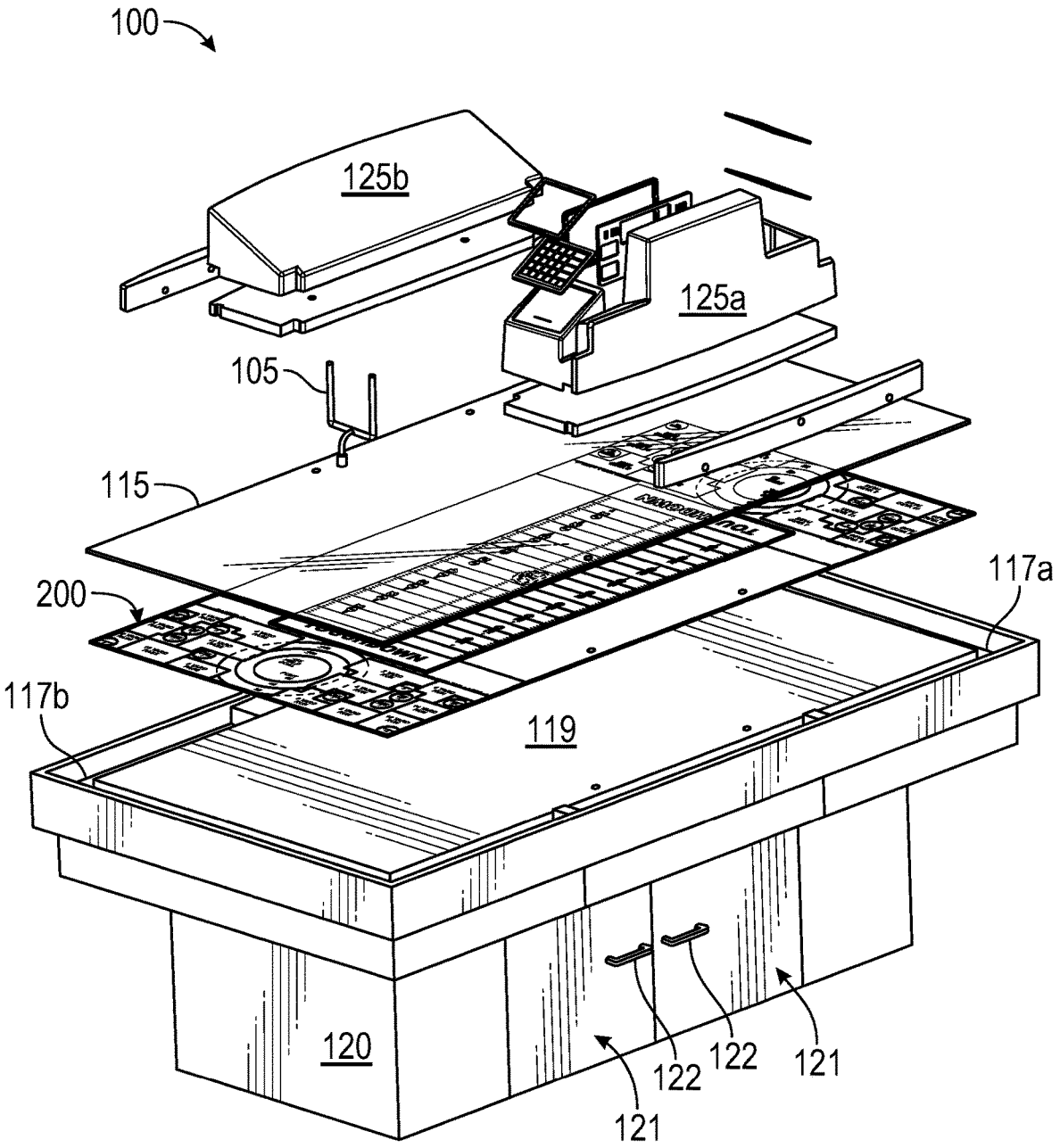
FIG. 1H may depict a partially exploded perspective view of the embodiment of FIG. 1A.
Figure 1I:
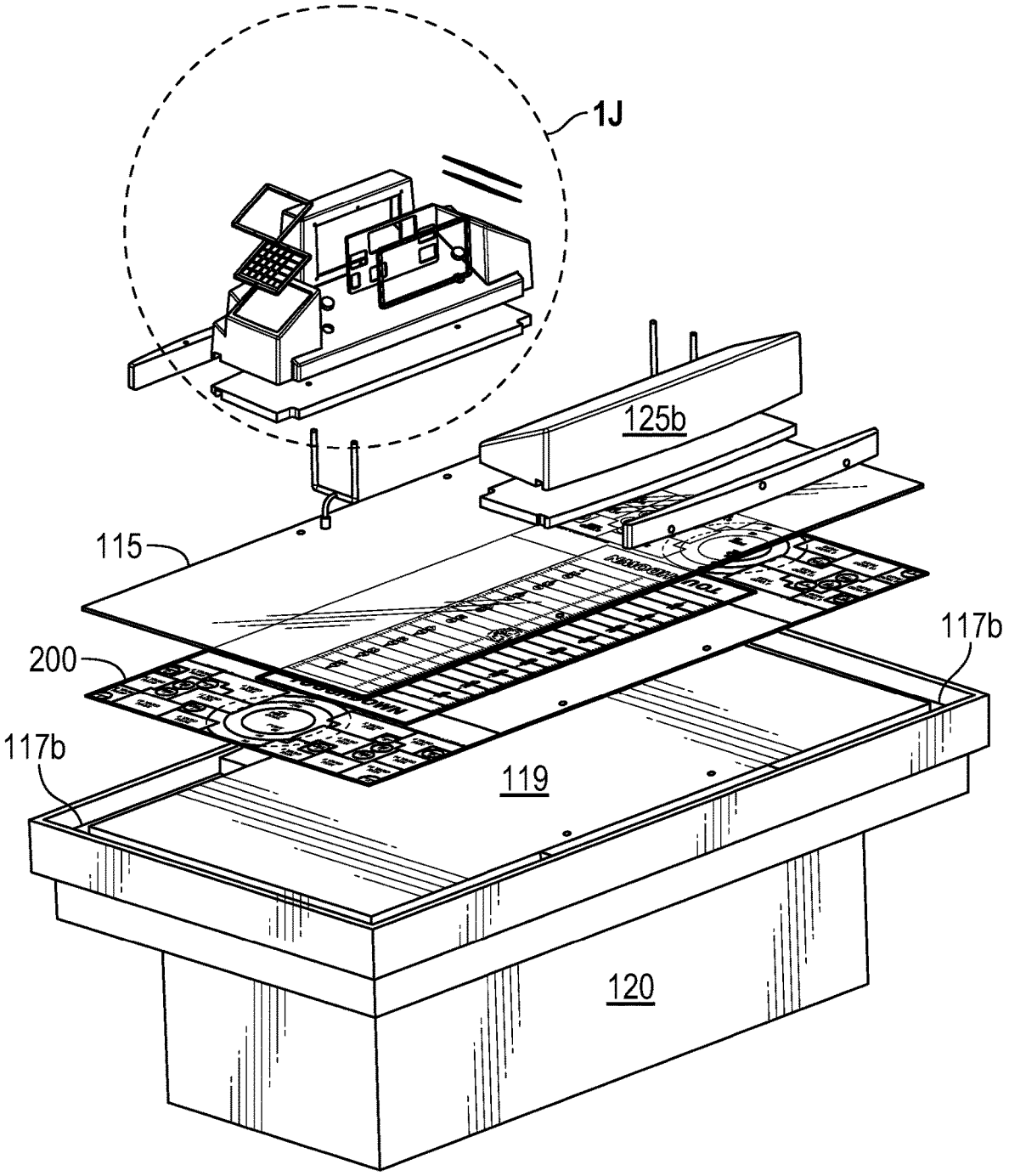
FIG. 1I may depict a partially exploded perspective view that is opposing of the view of FIG. 1H.
Figure 1J:
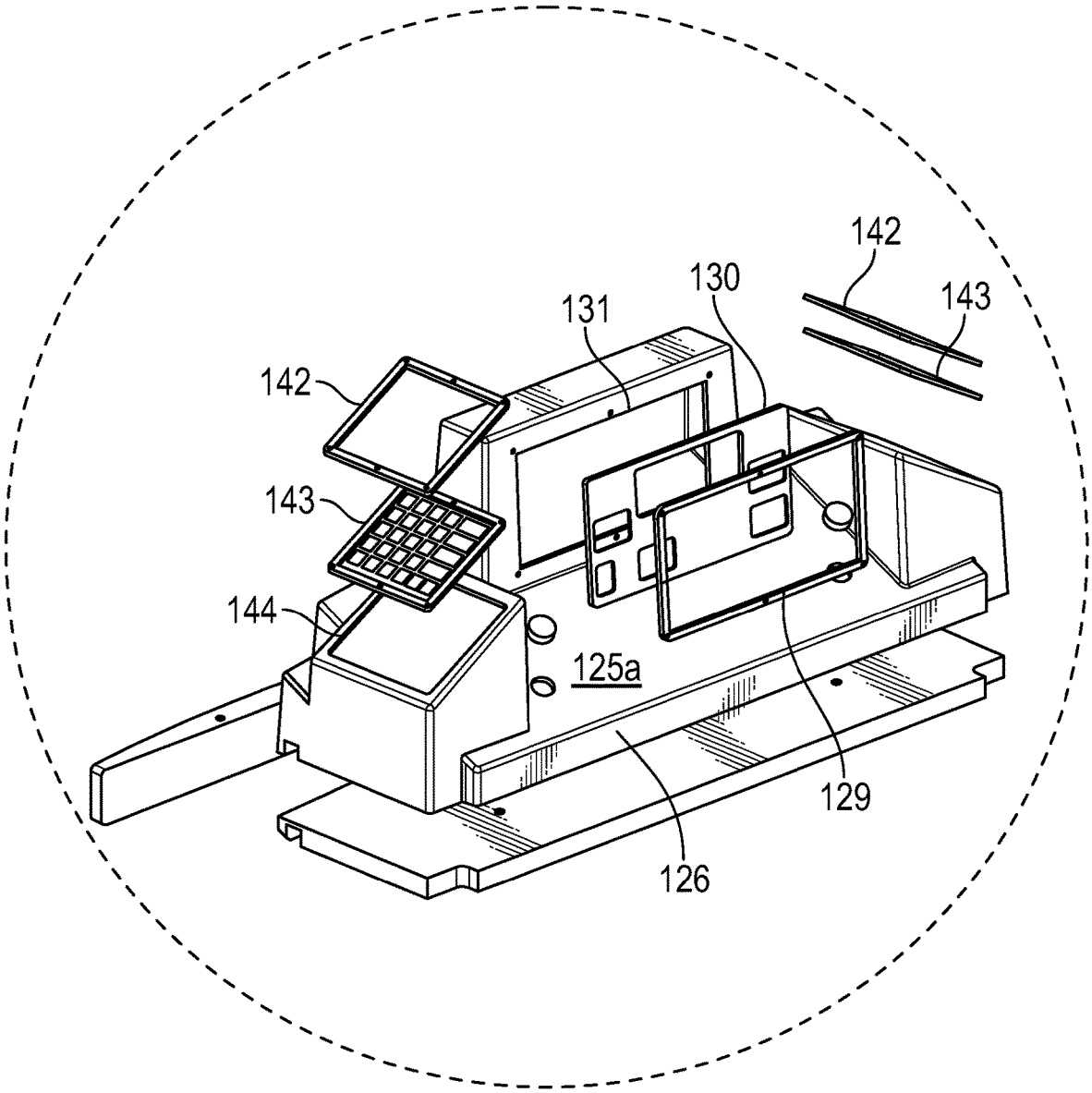
FIG. 1J may be a close up view of Region-1J.

FIG. 1A may depict an embodiment of an overall game 100, from a perspective view; wherein the game 100 may be simulating American football gameplay. FIG. 1B may depict an opposing perspective view as compared against FIG. 1A. FIG. 1C may depict a top view of game 100. FIG. 1D may depict a longitudinal side view of game 100. FIG. 1E may depict an opposing longitudinal side view as compared against the view of FIG. 1D. FIG. 1F may depict an end side view of game 100. FIG. 1G may depict an opposing end side view as compared against the view of FIG. 1F. FIG. 1H may depict a partially exploded perspective view of game 100. FIG. 1I may depict a partially exploded perspective view that is opposing of the view of FIG. 1H. FIG. 1I may also show Region-1J. FIG. 1J may be a close up view of Region-1J.

In some embodiments, game 100 may be for simulating American rules football style of gameplay. In some embodiments, game 100 may comprise gaming surface 200 (shown by top surfaces 115 in FIG. 1A). In some embodiments, top surface 115 may be an upper most surface of gaming surface 200. In some embodiments, one or more sliders 600 (see e.g., FIG. 6A) may be slid on top of top surface 115 during gameplay of game 100. In some embodiments, top surface 115 may be substantially: hard, smooth, and/or flat. Graphical aspects of gaming surface 200 may be shown in FIG. 2A, FIG. 2B, FIG. 2C, and in FIG. 2D; and discussed in the corresponding figure discussions. Other qualities and/or properties of gaming surface 200 may be shown in FIG. 12A, FIG. 12B, FIG. 12C, FIG. 12D, FIG. 12E, FIG. 12F, FIG. 12G, FIG. 12H; and discussed in the corresponding figure discussions.

In some embodiments, game 100 or gaming surface 200 may comprise two opposing decorative field goal posts 105. See e.g., FIG. 1A, FIG. 1B, FIG. 1C, FIG. 1D, FIG. 1E, FIG. 1F, FIG. 1G, FIG. 1H, and FIG. 1I. In some embodiments, decorative field goal posts 105 may be removably attached to opposing particular locations of top surface 115 of gaming surface 200. In some embodiments, such removable attachment may be accomplished via a suction cup located at a bottom of each decorative field goal post 105. In some embodiments, such removable attachment may be accomplished via a pin/post at a bottom of each decorative field goal post 105 that may be received into a goal post receiver 1231 (see e.g., FIG. 12H). Note, in some embodiments of game 100 there may no decorative field goal posts 105. Whereas in other embodiments of game 100 (and/or of game 1100 see FIG. 11) there may be at least two opposing decorative field goal posts 105.

In some embodiments, game 100 may comprise opposing catch basins 117. See e.g., FIG. 1A, FIG. 1B, FIG. 1C, FIG.

1H, and FIG. 1I. In the relevant figures catch basin 117 may be shown with an additional reference numeral suffix of "a" or "b"; which merely denote catch basins 117 located opposing from each other. In some embodiments, catch basins 117 may be located at opposing ends of gaming surface 200. In some embodiments, these catch basins 117 may be for catching sliding slider(s) 600 and prevent such slider(s) 600 from falling onto a floor or ground. In some embodiments, such catch basins 117 may also be used to removably store slider(s) 600. In some embodiments, structurally these catch basins 117 may be like troughs.

In some embodiments, game 100 may also comprise a supportive structure 119 for supporting gaming surface 200. In some embodiments, supportive structure 119 may support two opposing simulated spectator stands 125 (denoted in the relevant figures as by "125*a*" and "125*b*"). See e.g., FIG. 1A, FIG. 1B, FIG. 1C, FIG. 1D, FIG. 1E, FIG. 1F, FIG. 1G, FIG. 1H, and FIG. 1I. In some embodiments, a top perimeter of supportive structure 119 may form outer portions of catch basins 117. In some embodiments, supportive structure 119 may be selected from: a table, a bench, a desk, a workbench, a pedestal, a stand, a cabinet, a chest, a chest of drawers, or the like. In FIG. 1A, FIG. 1B, FIG. 1C, FIG. 1D, FIG. 1E, FIG. 1F, FIG. 1G, FIG. 1H, and FIG. 1I supportive structure 119 may be a cabinet structure.

In some embodiments, supportive structure 119 may comprise a base 120; wherein base 120 may rest upon a substrate (e.g., the floor or ground). See e.g., FIG. 1A, FIG. 1B, FIG. 1D, FIG. 1E, FIG. 1F, FIG. 1G, FIG. 1H, and FIG. 1I. In some embodiments, base 120 may comprise one or more doors 121; wherein such door(s) 121 may permit access to an interior of base 120. In some embodiments, such door(s) 121 may comprise one or more handles 122. See e.g., FIG. 1A. In some embodiments, an interior of base 120 may allow for storage areas, access to electronics for programming and/or access for maintenance.

In some embodiments, game 100 may comprise two opposing simulated spectator stands 125 (denoted in the relevant figures as by "125*a*" and "125*b*"). See e.g., FIG. 1A, FIG. 1B, FIG. 1C, FIG. 1D, FIG. 1E, FIG. 1F, FIG. 1G, FIG. 1H, and FIG. 1I. In some embodiments, a portion of gaming surface 200 (e.g., a simulated field region 1204 [see e.g., FIG. 12G]) may run between the set of opposing simulated spectator stands 125. In some embodiments, the set of opposing simulated spectator stands 125 may also be disposed between other portions of gaming surface 200 (e.g., two opposing simulated play regions 1206 [see e.g., FIG. 12H]). In some embodiments, at least one of the set of opposing simulated spectator stands 125 (e.g., 125*a*) may comprise one or more of: opposing user interface controls 141 (controls 141) or a scoreboard 128 (display 128). See e.g., FIG. 1B.

In some embodiments, a portion of each simulated spectator stand 125 that may be closest to and facing gaming surface 200 may be ricochet wall(s) 126. See e.g., FIG. 1C. In some embodiments, during gameplay, one or more sliders 600 may ricochet off of such ricochet wall(s) 126 after the given slider 600 is slid by a user (player).

Now discussing FIG. 1J, in some embodiments, a given controls 141 may comprise buttons cover 142, buttons 143, and buttons housing 144. In some embodiments, buttons 143 may be covered and/or secured to buttons housing 144 via buttons cover 142 (which may be molding and/or frame). In some embodiments, buttons 143 may be a touchscreen. See also FIG. 4 for an embodiment of buttons 143 and corresponding discussion of button functions.

Continuing discussing FIG. 1J, in some embodiments, display 128 may comprise display cover 129, display board 130, and display housing 131. In some embodiments, display board 130 may be covered and/or secured to display housing 131 via display cover 129 (which may be molding and/or frame). In some embodiments, display board 130 may comprise LCD (liquid crystal display) and/or LED (light emitting diode(s)) display regions to display details such as score, possession, line of scrimmage yard indication, down number, yards to go for a touchdown, time remaining, timeouts, and/or the like. See also FIG. 5B for an embodiment of display 128 (e.g., display board 130) and corresponding discussion of button functions.

Figure 2A:
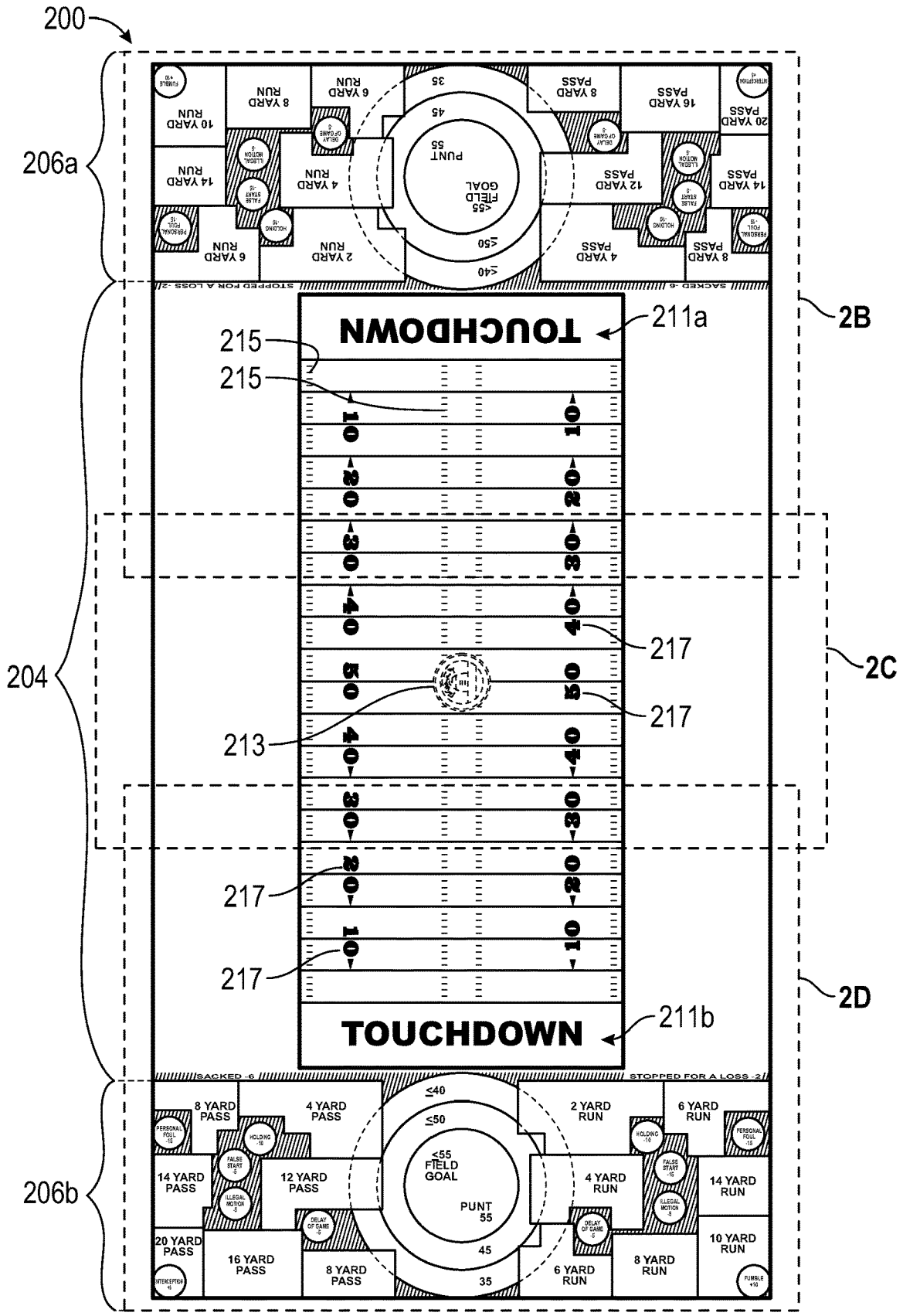
FIG. 2A may depict a top view of an entire gaming surface according to one embodiment.
Figure 2B:
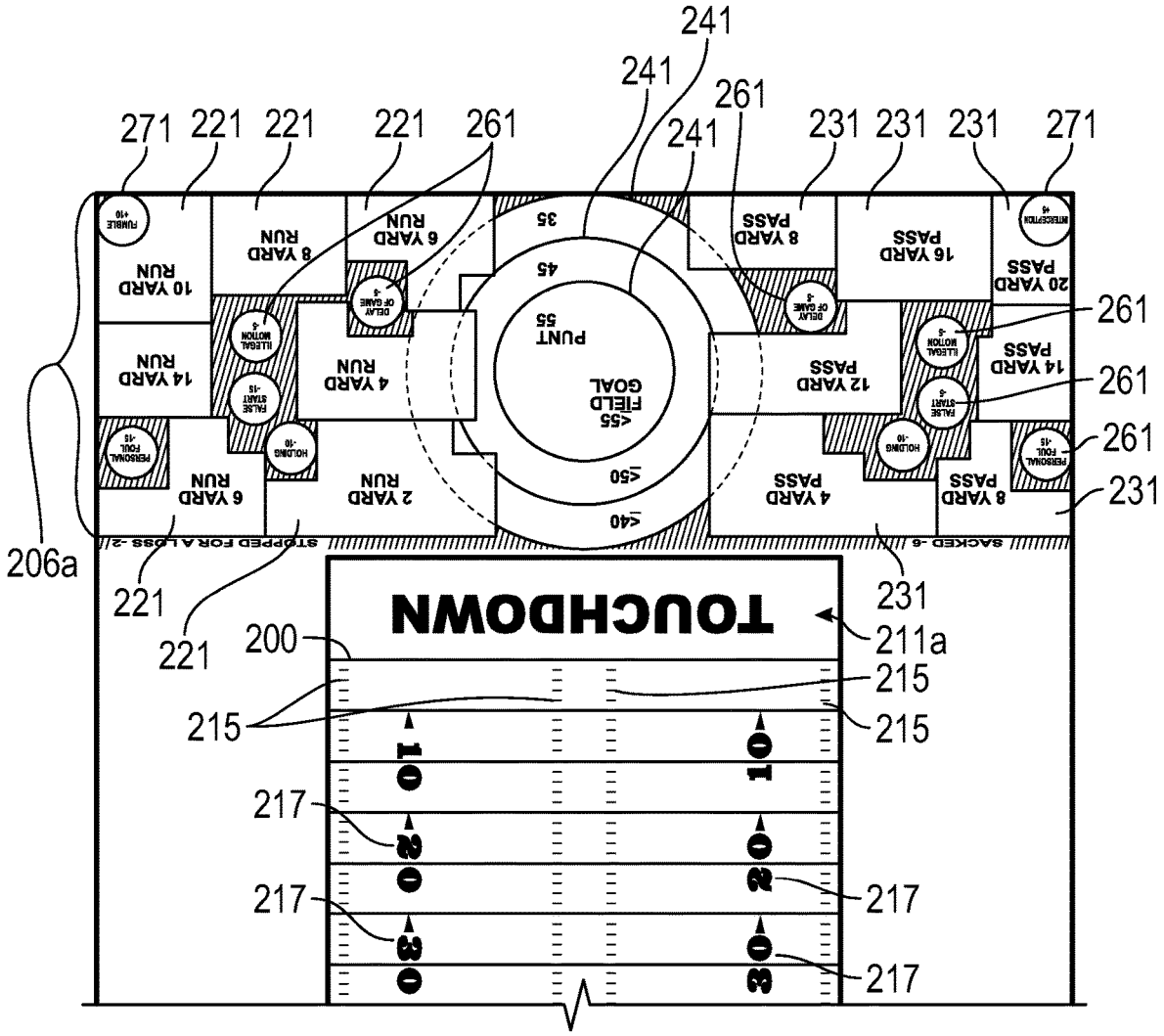
FIG. 2B may show a close up view of Region-2B; wherein Region-2B may of an upper (or top) portion of the gaming surface shown in FIG. 2A.
Figure 2C:
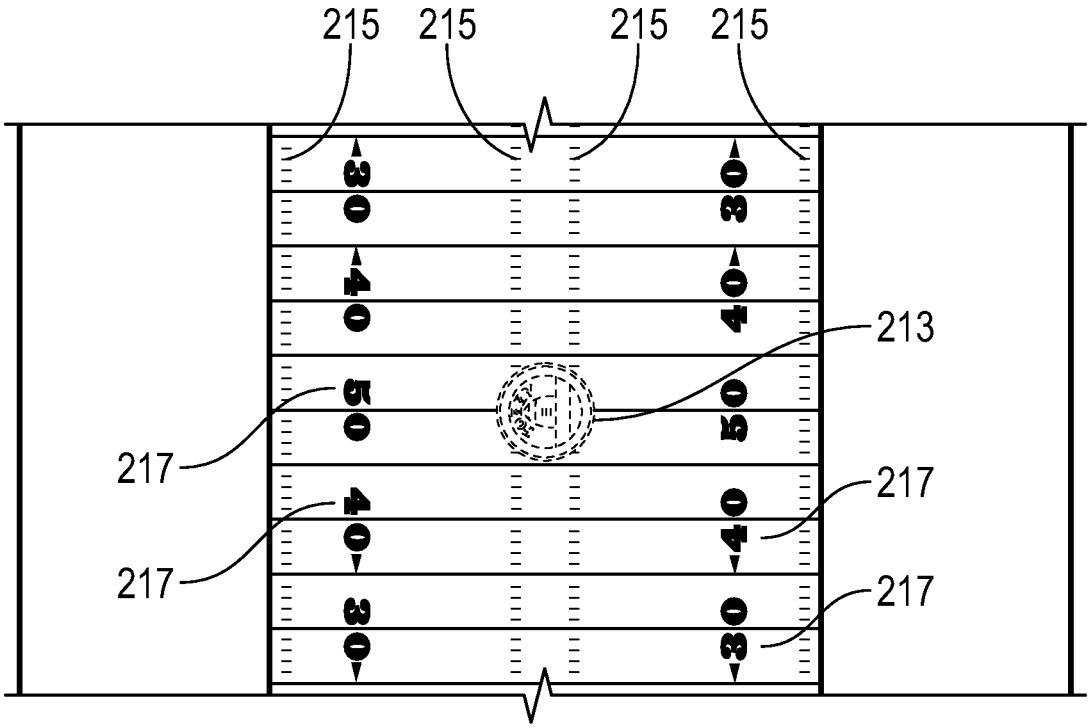
FIG. 2C may show a close up view of Region-2C; wherein Region-2C may of a middle portion of the gaming surface shown in FIG. 2A.
Figure 2D:
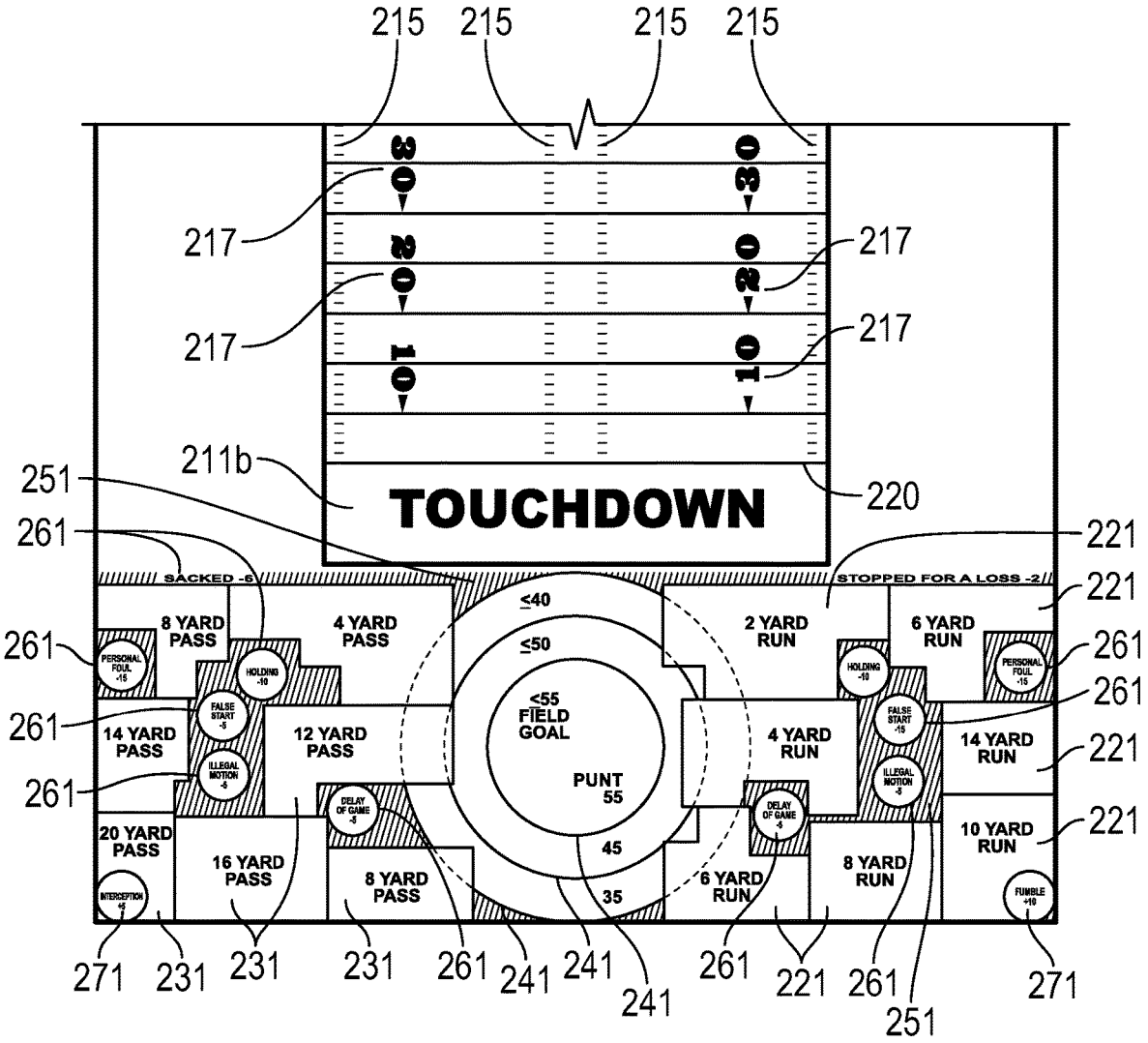
FIG. 2D may show a close up view of Region-2D; wherein Region-2D may of a lower (or bottom) portion of the gaming surface shown in FIG. 2A. (Note Region-2B and Region-2D may be substantially mirror images of each other in some embodiments.)

FIG. 2A may depict a top view of an entire gaming surface 200 according to one embodiment. FIG. 2A may also show the following regions: Region-2B, Region-2C, and Region 2-D. FIG. 2B may show a close up view of Region-2B; wherein Region-2B may of an upper (or top) portion of gaming surface 200 shown in FIG. 2A. FIG. 2C may show a close up view of Region-2C; wherein Region-2C may of a middle portion of gaming surface 200 shown in FIG. 2A. FIG. 2D may show a close up view of Region-2D; wherein Region-2D may of a lower (or bottom) portion of gaming surface 200 shown in FIG. 2A. (Note Region-2B and Region-2D may be substantially mirror images of each other in some embodiments.)

FIG. 2A may depict prominent game play related graphics of gaming surface 200, shown from a top view. FIG. 2A may depict an entirety of gaming surface 200. FIG. 2A may depict the prominent game play related graphics for simulated play regions 1206 and for simulated field region 1204, shown from a top view (see e.g., FIG. 12A). In some embodiments, these prominent game play related graphics may be printed onto a bottom surface of simulated play regions 1206 and of simulated field region 1204.

Continuing discussing FIG. 2A, in some embodiments, these prominent game play related graphics may comprise simulated field graphics 204 and simulated play region graphics 206. In FIG. 2A, suffix "a" and "b" to reference numeral "206" are merely to designate one such opposing simulated play region graphics 206*a* from the other opposing simulated play region graphics 206*b*. Note, discussion of "simulated play region graphics 206" without explicit reference to the suffix "a" and/or without explicit reference to the suffix "b," may mean the discussion may apply to either or both of simulated play region graphics 206*a* and/or simulated play region graphics 206*b*.

Continuing discussing FIG. 2A, in some embodiments, simulated field region 1204 may comprise simulated field graphics 204. In some embodiments, simulated field graphics 204 may be printed on a bottom surface of simulated field region 1204. In some embodiments, a material of construction for simulated field region 1204 may be substantially transparent. In some embodiments, simulated field graphics 204 may be graphics that simulate (e.g., mimic) a standard full sized American football field, including, but not limited to yardage markings (e.g., 215 and 217) and opposing end-zones (e.g., 211). In some embodiments, simulated field graphics 204 may comprise: simulated end-zone 211*a*, simulated end-zone 211*b*, logo or trademark 213, yardage marker 215, and major yardage marker 217. In some embodiments, simulated end-zone 211*a* and simulated end-zone 211*b* may be opposing, at opposite ends of simulated field region 1204. In some embodiments, logo or trademark 213 may be displayed prominently in a central or middle of simulated field region 1204. In some embodiments, logo or trademark 213 may be a logo and/or a trademark of a football team, football league, football association, football conference, and the like. In some embodiments, logo or trademark 213 may be a logo and/or a trademark of an entity that provides games 100 and/or gaming surfaces 200. In some embodiments, yardage markers 215 may indicate yards on a per yard basis. In some embodiments, major yardage marker 217 may be depicted to indicate every 10 yards.

In FIG. 2A, suffix "a" and "b" to reference numeral "211" are merely to designate one such opposing simulated end-zone 211*a* from the other opposing simulated end-zone 211*b*. Note, discussion of "simulated end-zone 211" without explicit reference to the suffix "a" and/or without explicit reference to the suffix "b," may mean the discussion may apply to either or both of simulated end-zone 211*a* and/or simulated end-zone 211*b*.

In some embodiments, FIG. 2B and/or FIG. 2D may depict a close up of simulated play region 1206 showing simulated play region graphics 206, from a top view. In some embodiments, simulated play region 1206 may be sub-divided into various targets and regions, wherein boundaries and meanings of such targets and regions may be indicated by simulated play region graphics 206; which may be readable and visible from the top view. In some embodiments, a given simulated play region 1206 may be subdivided into: one or more of: run targets 221, pass targets 231, kick targets 241, no gain regions 251, penalty regions 261, and/or turnover regions 271. In some embodiments, a given simulated play region graphics 206 may comprise the following graphics regions: one or more of: run targets 221, pass targets 231, kick targets 241, no gain regions 251, penalty regions 261, and/or turnover regions 271.

Continuing discussing FIG. 2B and/or FIG. 2D, in some embodiments, kick targets 241 may separate run targets 221 from pass targets 231. In some embodiments, no gain regions 251 and/or penalty regions 261 may be dispersed within run targets 221. In some embodiments, different no gain regions 251 and/or different penalty regions 261 may be dispersed within pass targets 231. In some embodiments, turnover regions 271 may comprise either a fumble or an interception; wherein a fumble region (turnover region 271) may be located in the run targets 221 region(s); wherein an interception region (turnover region 271) may be located in the pass targets 231 region(s). Results (outcomes) of any of these run targets 221, pass targets 231, kick targets 241, no gain regions 251, penalty regions 261, and/or turnover regions 271 may be self-evident according to what the given target/region states via the wording of the region. For example, a slider 600 coming to rest (stop) mostly over "8 Yard Pass" in pass targets 231 may mean line of scrimmage indicator 544 should be advanced by eight yards. In some embodiments, kick targets 241 may comprise a series of concentric circles with different yardage indications corresponding to different such circles. In some embodiments, kick targets 241 may be relevant and used when the given offensive player is punting 835 or attempting a field goal 837.

In some embodiments, FIG. 2B and/or FIG. 2D may also depict end portions of simulated field region 1204 showing simulated field graphics 204, from a close up top view. FIG. 2B and/or FIG. 2D may show some simulated field graphics 204 of: simulated end-zone 211*a* (FIG. 2B), simulated end-zone 211*b* (FIG. 2D), yardage marker 215, and major yardage marker 217. Boundaries of simulated end-zones 211 may be indicated by goal line 220.

In some embodiments, FIG. 2C may depict a close up of central portions of simulated field region 1204 showing some of simulated field graphics 204, from a top view. FIG. 2C may show some simulated field graphics 204 of: logo or trademark 213, yardage marker 215, and major yardage marker 217. Boundaries of simulated end-zones 211 may be indicated by goal line 220.

Figure 3A:
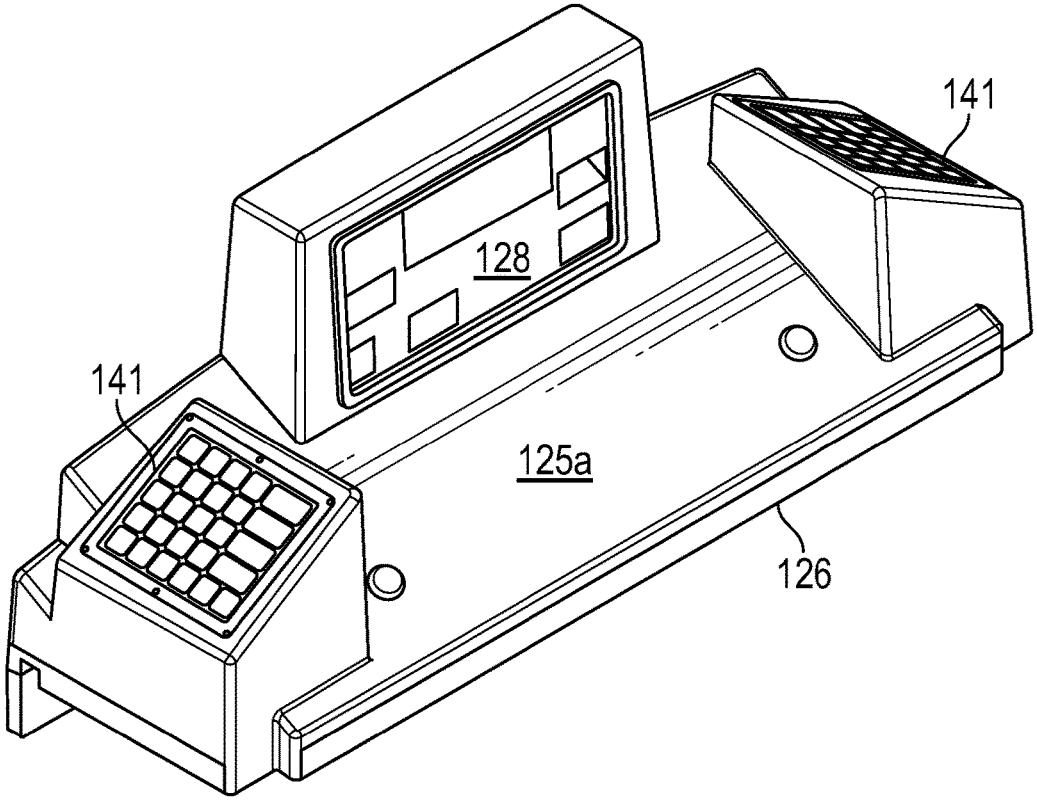
FIG. 3A may depict a perspective view of a simulated spectator stand (e.g., bleachers or stadium seating).
Figure 3B:
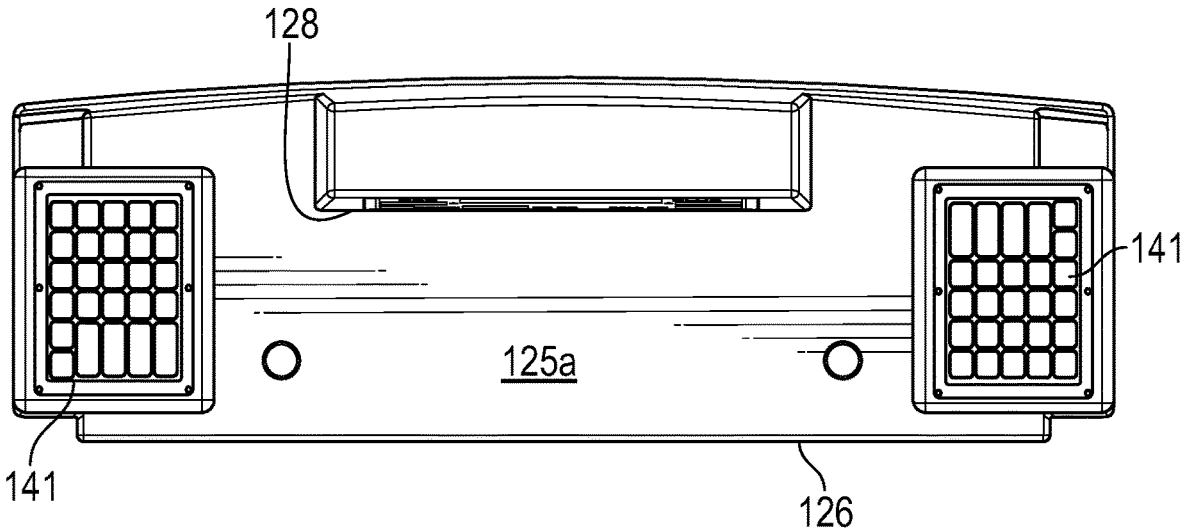
FIG. 3B may depict a top view of the simulated spectator stand of FIG. 3A.
Figure 3C:
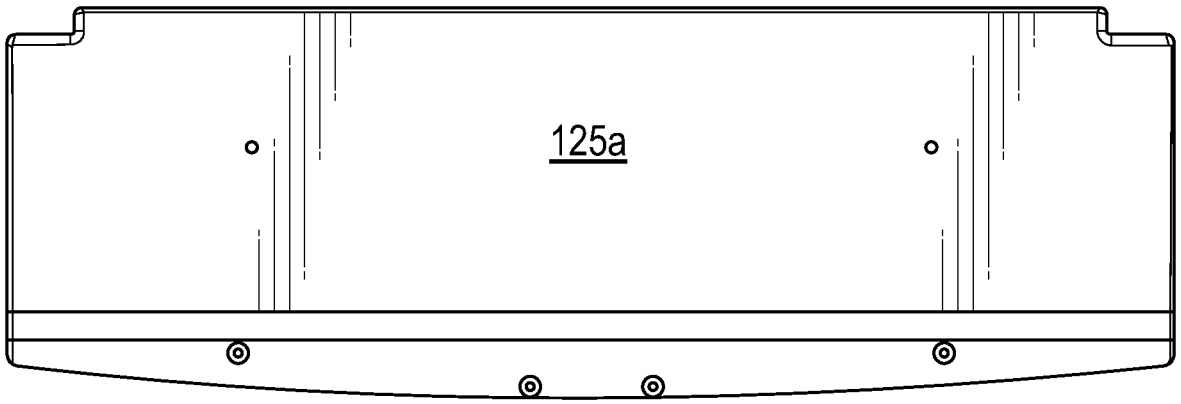
FIG. 3C may depict a bottom view of the simulated spectator stand of FIG. 3A.
Figure 3D:
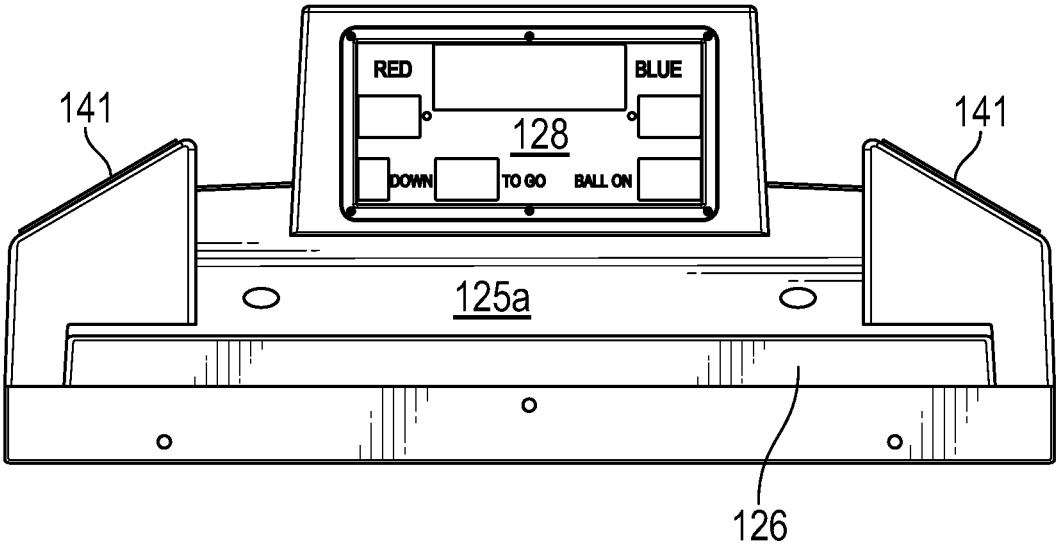
FIG. 3D may depict a front view of the simulated spectator stand of FIG. 3A.
Figure 3E:
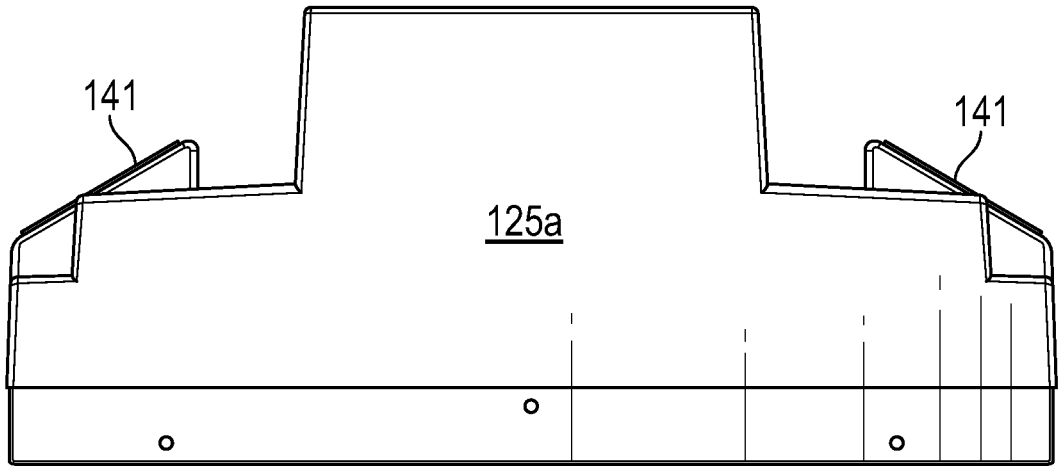
FIG. 3E may depict a back view of the simulated spectator stand of FIG. 3A.
Figure 3F:
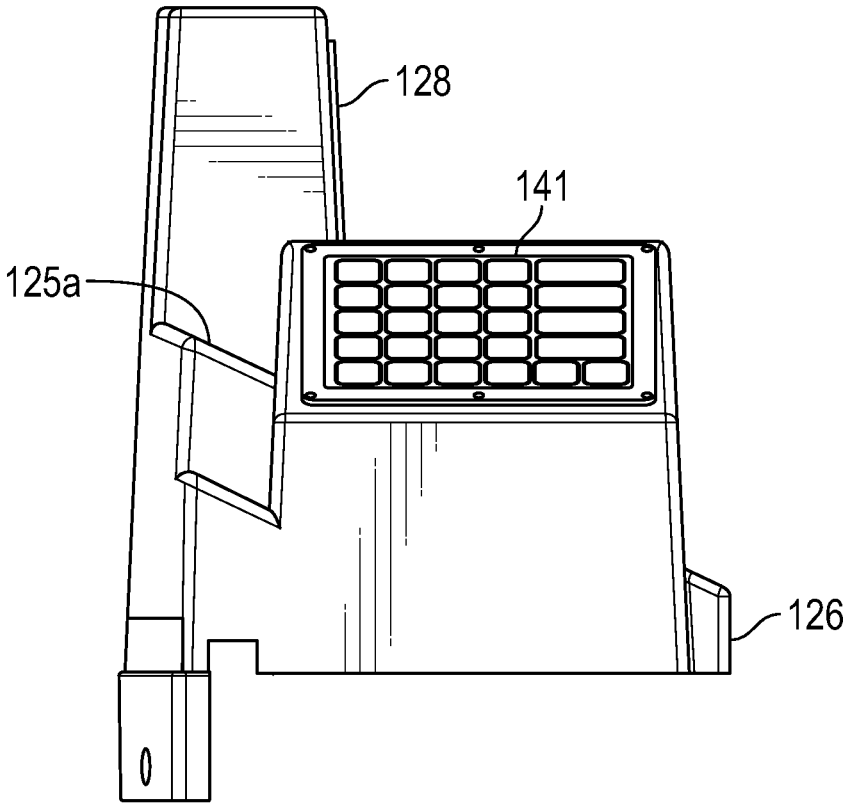
FIG. 3F may depict an end view (e.g., left end or right end) of the simulated spectator stand of FIG. 3A.

FIG. 3A may depict a perspective view of a simulated spectator stand 125*a* (e.g., bleachers or stadium seating). FIG. 3B may depict a top view of simulated spectator stand 125*a*. FIG. 3C may depict a bottom view of simulated spectator stand 125*a*. FIG. 3D may depict a front view of simulated spectator stand 125*a*. FIG. 3E may depict a back view of simulated spectator stand 125*a*. FIG. 3F may depict an end view (e.g., left end or right end) of simulated spectator stand 125*a*.

Figure 3G:
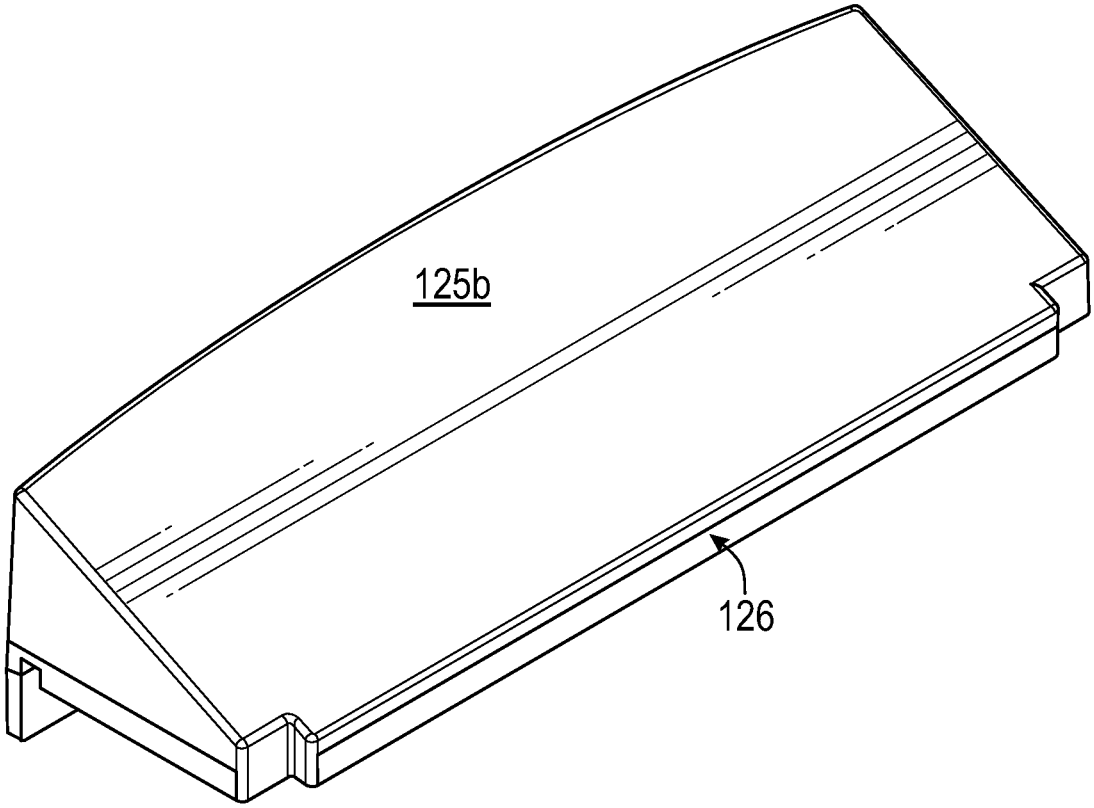
FIG. 3G may depict a perspective view of a simulated spectator stand (e.g., bleachers or stadium seating).
Figure 3H:
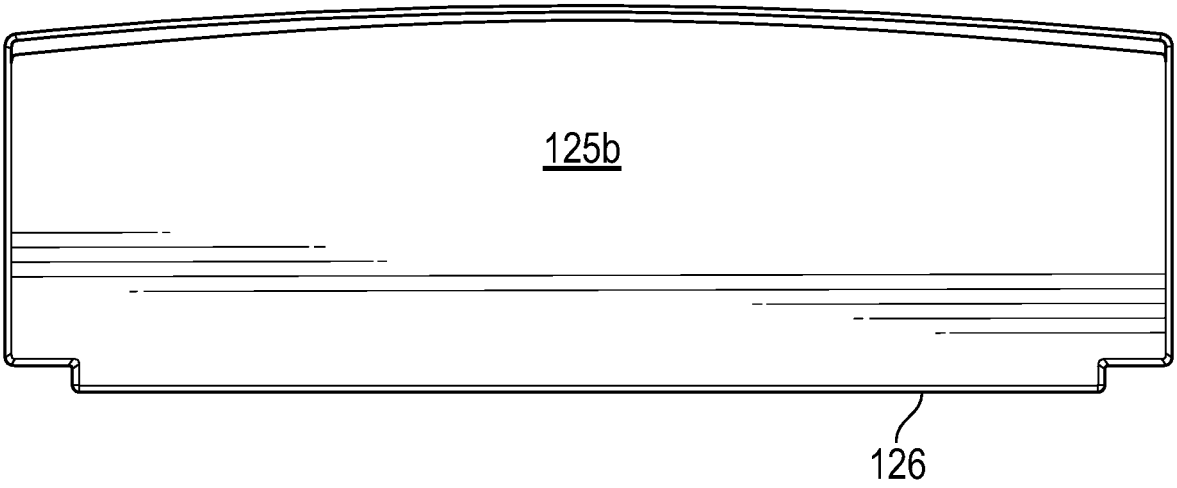
FIG. 3H may depict a top view of the simulated spectator stand of FIG. 3G.
Figure 3I:
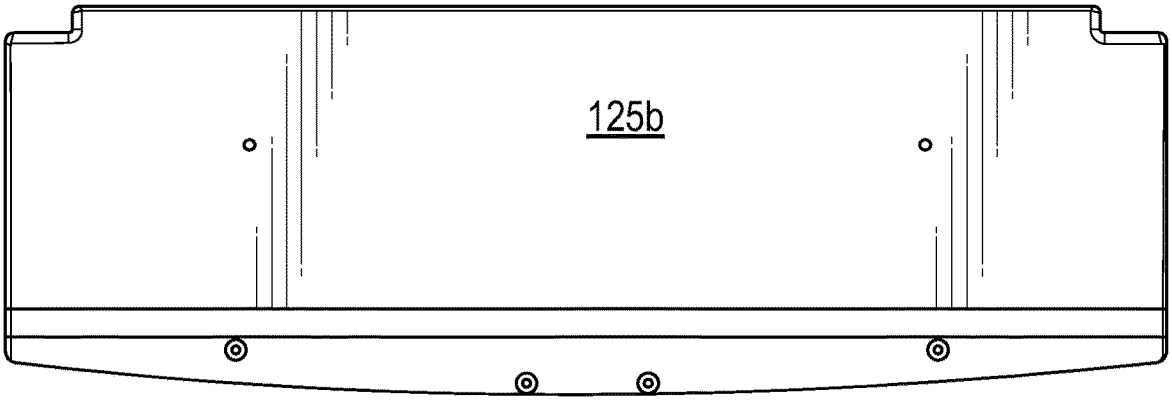
FIG. 3I may depict a bottom view of the simulated spectator stand of FIG. 3G.
Figure 3J:
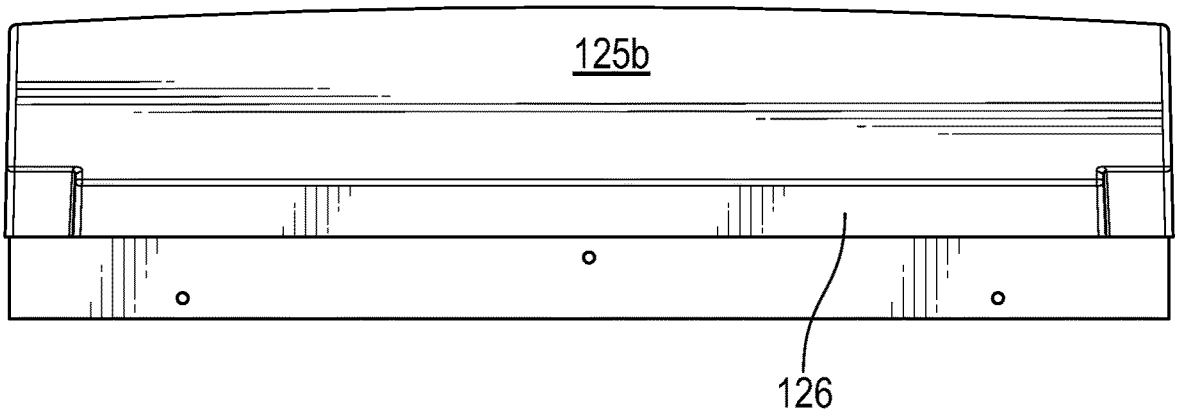
FIG. 3J may depict a front view of the simulated spectator stand of FIG. 3G.
Figure 3K:
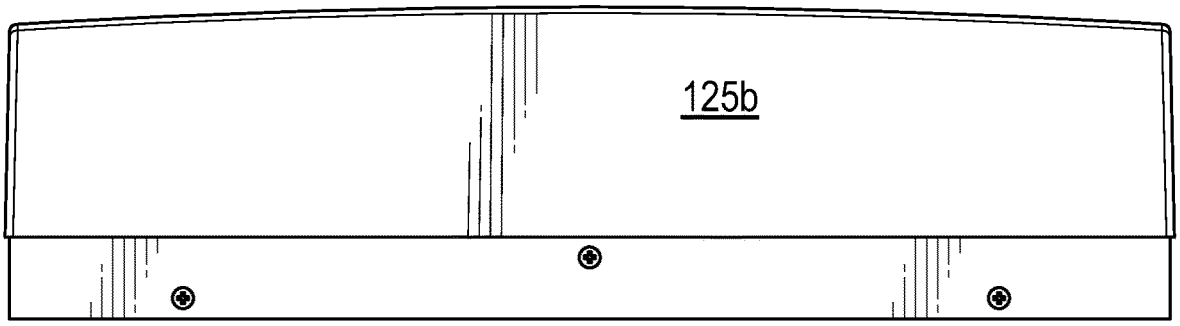
FIG. 3K may depict a back view of the simulated spectator stand of FIG. 3G.
Figure 3L:
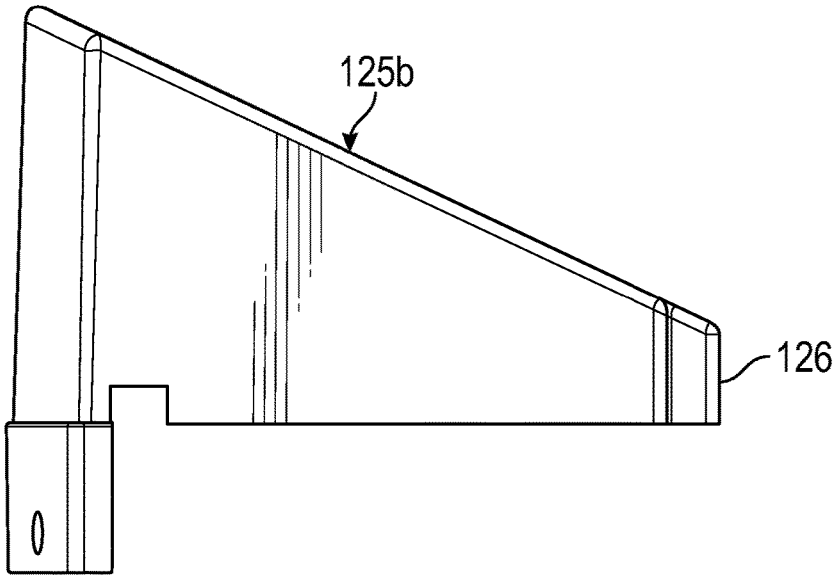
FIG. 3L may depict an end view (e.g., left end or right end) of the simulated spectator stand of FIG. 3G.

FIG. 3G may depict a perspective view of a simulated spectator stand 125*b* (e.g., bleachers or stadium seating). FIG. 3H may depict a top view of simulated spectator stand 125*b*. FIG. 3I may depict a bottom view of simulated spectator stand 125*b*. FIG. 3J may depict a front view of simulated spectator stand 125*b*. FIG. 3K may depict a back view of simulated spectator stand 125*b*. FIG. 3L may depict an end view (e.g., left end or right end) of simulated spectator stand 125*b*.

In some embodiments, game 100 may comprise at least one simulated spectator stand 125. In some embodiments, game 100 may comprise at least two opposing simulated spectator stands 125 (denoted 125*a* and 125*b* in the relevant figures). In some embodiments, one such simulated spectator stand 125 may be for simulating home team spectator seating and the other one such simulated spectator stand 125 may be for simulated visitor team spectator seating. FIG. 3A through FIG. 3F may show simulated spectator stand 125*a*. And FIG. 3G through FIG. 3L may show simulated spectator stand 125*b*. In some embodiments, simulated spectator stand 125*a* may also comprise controls 141 and display 128. In some embodiments, there may be two opposing sets of controls 141, one for each user (player), of simulated spectator stand 125*a*. See e.g., FIG. 3A and FIG. 3B.

In some embodiments, simulated spectator stand(s) 125 may simulate fan (patron) bleachers (seating) of an American football stadium. In some embodiments, simulated spectator stand 125 may extend substantially vertically at a predetermined height above supportive structure 119 (see e.g., FIG. 1A) (or above supportive structure 1223 top). In some embodiments, simulated spectator stand 125 may extend substantially vertically at a predetermined height above top surface 115 (see e.g., FIG. 1A). In some embodiments, simulated spectator stand 125 may be attachable to supportive structure 119 (see e.g., FIG. 1A) (or to supportive structure 1223). In some embodiments, simulated spectator stand 125 may be removable from supportive structure 119 (see e.g., FIG. 1H and FIG. 1I) (or from supportive structure 1223). In some embodiments, a majority of exterior surfaces of simulated spectator stand 125 may be substantially rigid to semi-rigid. In some embodiments, a majority of exterior surfaces of simulated spectator stand 125 may be colored, painted, decaled, and/or decorated in a manner to reflect fans (spectators), colors, names, logos, and/or mascots of a football team.

In some embodiments, game 100 may comprise two opposing simulated spectator stands 125. In some embodiments, each such simulated spectator stand 125 may be disposed one to a side (e.g., left and right) of simulated field region 1204 (see e.g., FIG. 12G and FIG. 12H). See also FIG. 1B.

In some embodiments, simulated spectator stand 125 may comprise ricochet wall 126. See e.g., FIG. 3A, FIG. 3B, FIG. 3G, and FIG. 3H. In some embodiments, ricochet wall 126 may a side of simulated spectator stand 125 that may be closest to gaming surface 200. In some embodiments, ricochet wall 126 may a side of simulated spectator stand 125 that may be closest to simulated field region 1204. In some embodiments, ricochet wall 126 may a side of simulated spectator stand 125 that may face gaming surface 200. In some embodiments, ricochet wall 126 may a side of simulated spectator stand 125 that may face simulated field region 1204. In some embodiments, ricochet wall 126 may be linearly straight and substantially parallel with simulated field length 1203. In some embodiments, ricochet wall 126 may be curved and substantially parallel with simulated field length 1203. In some embodiments, ricochet wall 126 may be substantially rigid. In some embodiments, it may be intended for sliders 600 to hit, strike, and/or bounce against/off of ricochet wall 126. In some embodiments, ricochet wall 126 may be substantially semi-rigid.

In some embodiments, simulated spectator stand 125 may comprise (house) electronic components, such as, but not limited to lighting, LEDs, wiring, speakers, motion detectors, displays (e.g., for displaying time remaining, scores, down, possession, and the like), circuits, and the like. In some embodiments, such electronic components may be attached to structural members of simulated spectator stand 125. In some embodiments, simulated spectator stand(s) 125 may emit sounds simulating gameplay and/or simulating outcomes of a given play, from speakers on and/or in simulated spectator stand(s) 125. In some embodiments, simulated spectator stand(s) 125 may emit lights (colored and/or flashing) simulating gameplay and/or simulating outcomes of a given play, from lights (e.g., LEDs) on simulated spectator stand(s) 125.

In some embodiments, such electronics may also be or alternatively housed on and/or in supportive structure 119 (or other supportive structures disclosed herein). In some embodiments, supportive structure 119 may emit sounds simulating gameplay and/or simulating outcomes of a given play, from speakers on and/or in supportive structure 119. In some embodiments, supportive structure 119 may emit lights (colored and/or flashing) simulating gameplay and/or simulating outcomes of a given play, from lights (e.g., LEDs) on supportive structure 119.

FIG. 3D may depict various electronic components attached to a given simulated spectator stand 125*a*. In some embodiments, simulated spectator stand 125*a* may comprise electronic components, such as, but not limited to lighting, LEDs, wiring, speakers, motion detectors, displays (e.g., for displaying time remaining, scores, down, possession, and the like), circuits, and the like. In some embodiments, such electronic components may be attached to structural members of simulated spectator stand 125*a*. In some embodiments, simulated spectator stand 125*a* may comprise display 128. In some embodiments, display 128 may display one or more of: score display 529, present down, yards to go for a first down, line of scrimmage indicator 544 (ball on certain yard), current possession, time outs remaining, game clock, and/or the like. In some embodiments, the game clock may be a countdown clock with count down display for displaying time remaining in a given game or time remaining in a given half or a given quarter.

In some embodiments, one or more of: score display 529, present down, yards to go for a first down, line of scrimmage indicator 544 (ball on certain yard), current possession, time outs remaining, game clock, and/or the like may be integrated together into a single display 128.

In some embodiments, simulated spectator stand(s) 125 may be substantially constructed of one or more of: plastics, wood, and/or metals.

Figure 4:
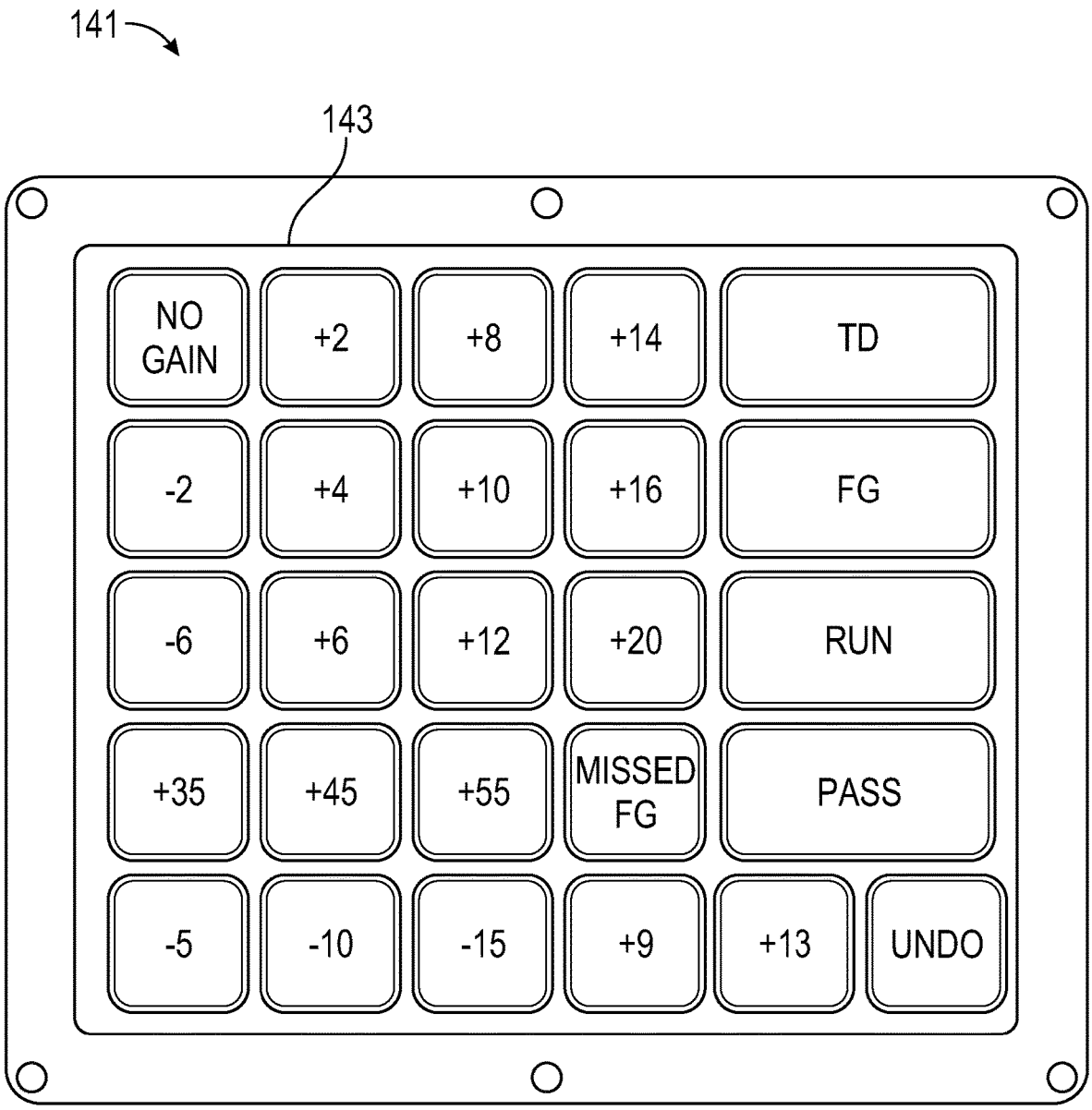
FIG. 4 may depict a front view of a user interface controls (controller) showing various buttons which may be engaged by a user.

FIG. 4 may depict a front view of a user interface controls 141 (controls 141 or controller 141) showing various buttons 143 which may be engaged by a user (player). A result of engaging a given button 143 may be indicated by what is printed/disclosed/shown on the given button 143. Buttons 143 may be engaged to match the given outcome of a given slider 600 coming to rest mostly over a given region in simulated play region graphics 206 (or simulated play region 1206). For example, and without limiting the scope of the present invention, buttons 143 with a "+" followed by a number, indicate a yardage gain of that number. Conversely, buttons 143 with a "−" followed by a number, indicate a yardage loss of that number. For example, and without limiting the scope of the present invention, buttons 143: "No Gain" may indicate a play resulting in no yardage change but a down advancement; "TD" may indicate a touchdown; "FG" may indicate a field goal"; "Missed FG" may indicate a missed field goal attempt; "Run" may indicate a run play attempt; "Pass" may indicate a pass play attempt; and "Undo" may indicate undo the last button 143 selected. In some embodiments, controls 141 and/or buttons 143 may be touchscreen, buttons, switches, membrane switches, levers, dials, sliders, and/or the like. Each of two players may have their own given controls 141. In some embodiments, there may be two opposing controls 141, one for each player, at opposing ends of a simulated spectator stand 125. Buttons 143 of each given controls 141 may be angled away from each other, so that the opposing player may not be able to see the other player's selection (e.g., selection of "Run" or of "Pass") (see e.g., FIG. 3D).

Figure 5A:
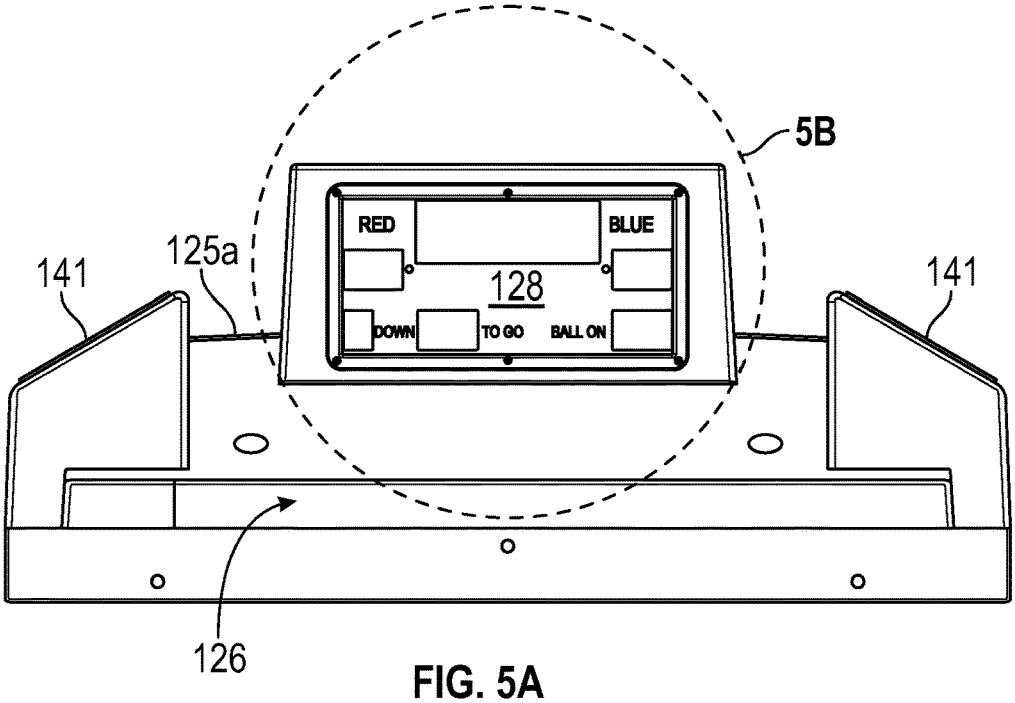
FIG. 5A may depict a front view of a simulated spectator stand with a display, such as a display acting as a scoreboard.
Figure 5B:
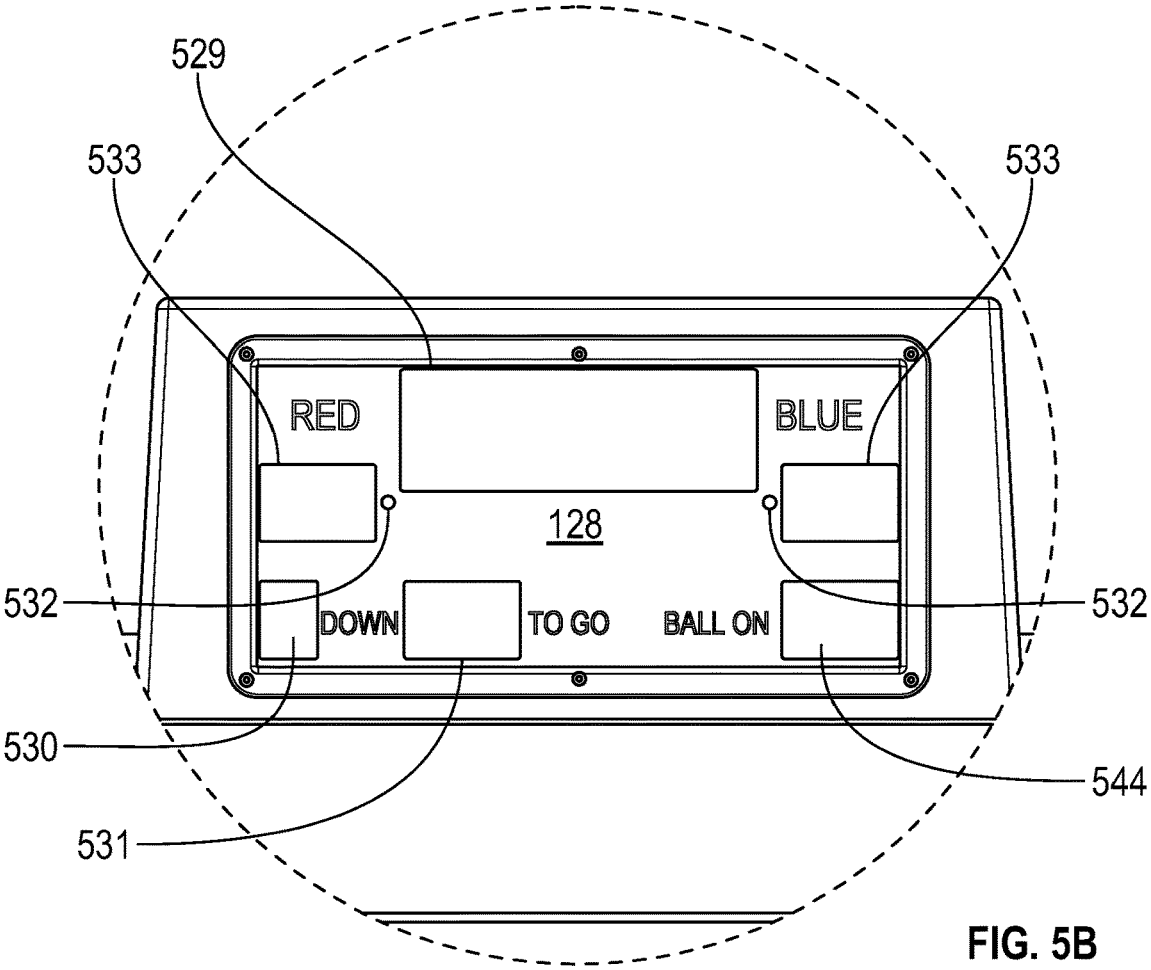
FIG. 5B may be a close up view of Region-5B, showing details that may be displayed.

FIG. 5A may depict a front view of a simulated spectator stand 125*a* with a display 128, such as a display 128 acting as a scoreboard. FIG. 5A may also show Region-5B. FIG. 5B may be a close up view of Region-5B, showing details that may be displayed on display 128. In some embodiments, display 128 may display one or more details of: score display 529; present down 530; yards to go for a first down 531; line of scrimmage indicator 544 (e.g., ball on certain yard line); current possession 532; time outs remaining 533; game clock; and/or the like. In some embodiments, anyone of these display regions of 529, 530, 531, 532, 533, and/or 544 may be programmed to display other information. In some embodiments, the game clock may be displayed in score display 529. In some embodiments, display 128 may be a LCD, LED, plasma, CRT, and/or the like display.

In some embodiments, yards to go for a first down 531 and/or line of scrimmage indicator 544 may appear one or more of: display 128 and/or on (or under) gaming surface 200. In some embodiments, where yards to go for a first down 531 and/or line of scrimmage indicator 544 may appear on (or under) gaming surface 200. These may appear by different colored backlighting below yardage marker 215, which may advance/decline along the length of yardage marker 215 during gameplay. See e.g., FIG. 12G. Locations (advances/declines) of yards to go for a first down 531 and/or line of scrimmage indicator 544 shown on gaming surface 200 in some embodiments by backlighting may be controlled by buttons 143 of controls 141. Yardage numbers of yards to go for a first down 531 and/or line of scrimmage indicator 544 shown on display 128 in some embodiments may be controlled by buttons 143 of controls 141.

In some embodiments, game 100 (and/or game 1100—see FIG. 11) may comprise one or more speakers for emitting sounds. In some embodiments, such one or more speakers may be attached to and/or housed on or in: at least one simulated spectator stand 125, display 128, controls 141, supportive structure 119, supportive structure 1221 (see FIG. 12E), supportive structure 1223 (see FIG. 12G), and/or the like. In some embodiments, such speakers may be electrically coupled to computer 1000 (see FIG. 10A) and/or to controls 141. In some embodiments, such speakers may emit sounds from one or more sound files stored (saved) non-transitorily in Memory 1003 (see FIG. 10A). In some embodiments, these sound files may be of the following content: simulated announcer commentary on plays, outcomes, and/or penalties (i.e., slider 600 slide outcomes); simulated fan (spectator) reaction to plays, outcomes, and/or penalties (i.e., slider 600 slide outcomes); simulated player noises (e.g., grunts) to plays, outcomes, and/or penalties (i.e., slider 600 slide outcomes); whistle blows; environmental sounds associated with American rules football gameplay; sounds of fireworks; musical soundtracks (or portions thereof); and/or the like. Selection of such audio file to play over such speakers may be determined by down, yards to go to first down, line of scrimmage indicator 544, time remaining, and/or to plays, outcomes, and/or penalties (i.e., slider 600 slide outcomes) as indicated by buttons 143 engaged on controls 141 and/or as determined by motion detectors (e.g., 1227 in FIG. 12G) of sliders 600.

Figure 6A:
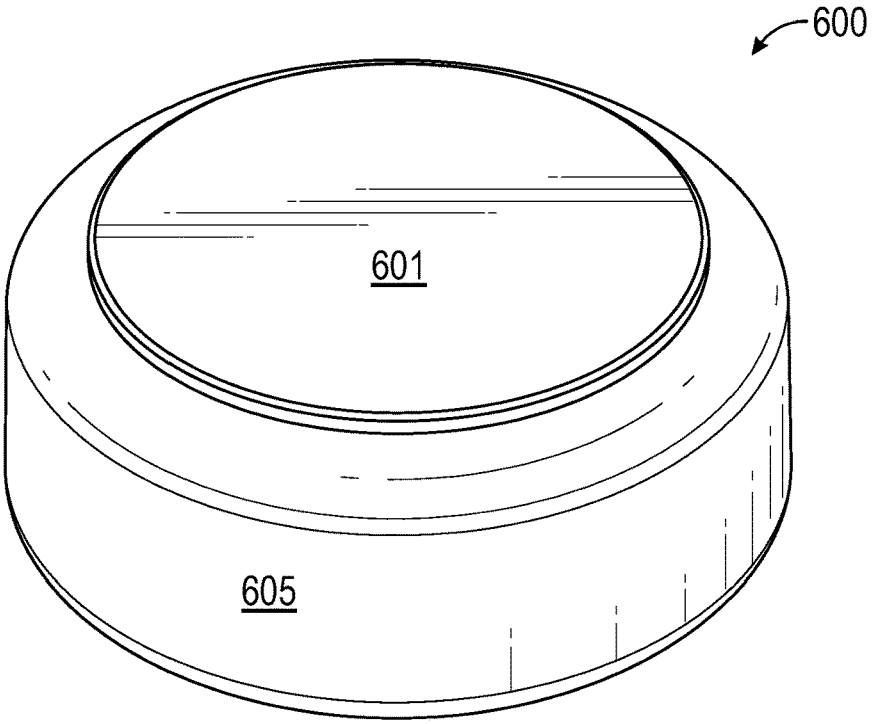
FIG. 6A may depict a perspective view of a slider.
Figure 6B:
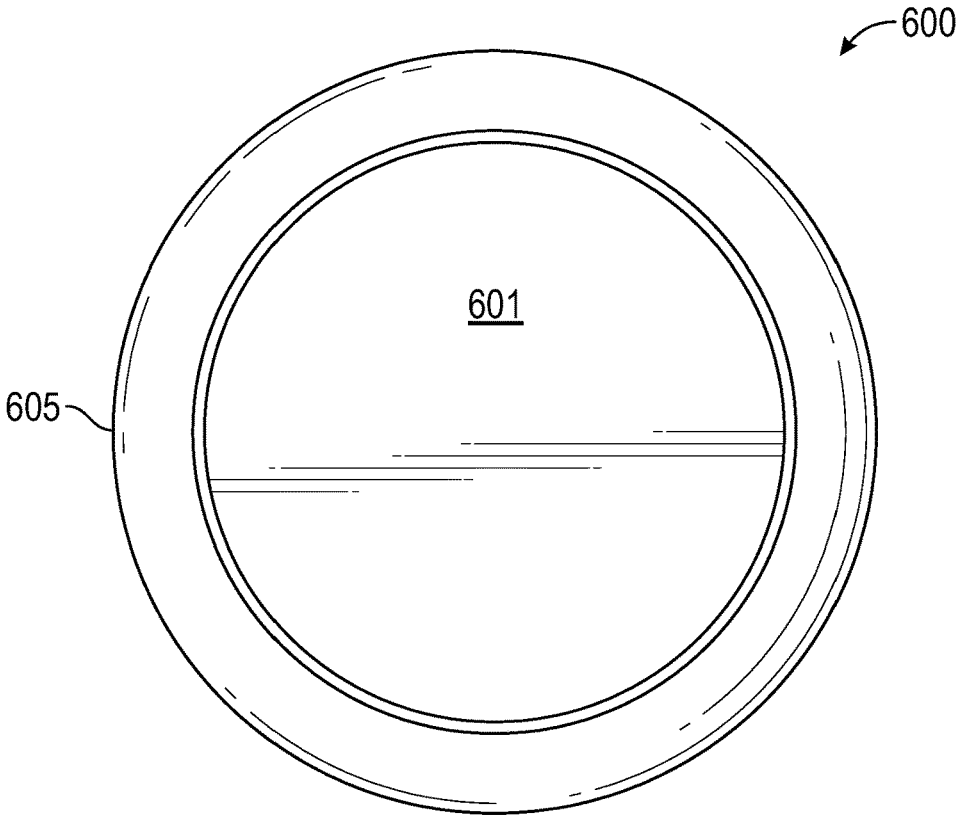
FIG. 6B may depict a top view of the slider of FIG. 6A.
Figure 6C:
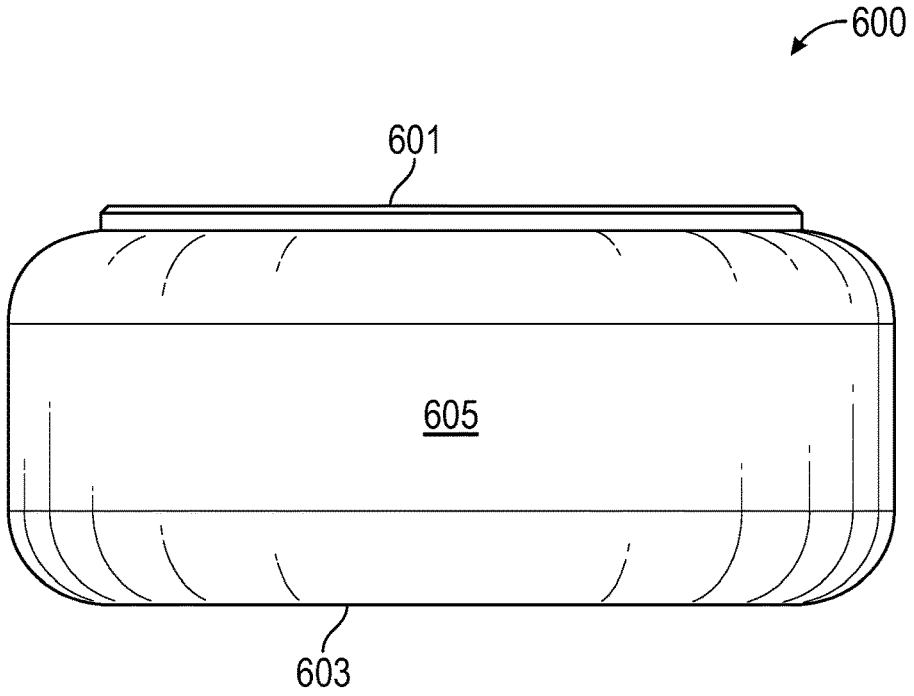
FIG. 6C may depict a side view of the slider of FIG. 6A.
Figure 6D:
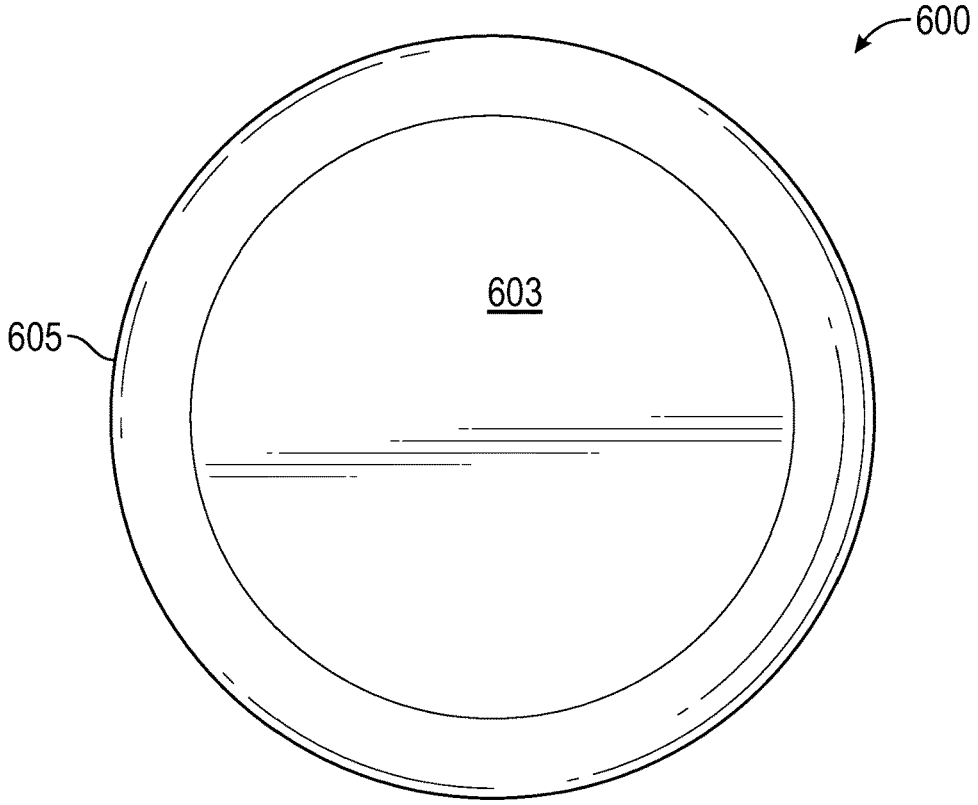
FIG. 6D may depict a bottom view of the slider of FIG. 6A.

FIG. 6A may depict a perspective view of a slider 600. FIG. 6B may depict a top view of slider 600. FIG. 6C may depict a side view of slider 600. FIG. 6D may depict a bottom view of slider 600.

In some embodiments, slider 600 may be a simulated American football. For example, and without limiting the scope of the present invention, in some embodiments, slider 600 when viewed from above, may have an oval or eye shape that approximates a look of an American football. In some embodiments, slider 600 may represent an American football. For example, and without limiting the scope of the present invention, in some embodiments, slider 600 when viewed from above, may have circular shape. In some embodiments, slider 600 may slide over top surface 115 during gameplay of game 100 or of gameplay of gaming surface 200. In some embodiments, slider 600 may be sized to fit within an average adult male hand of a human. In some embodiments, slider 600 may be handheld.

In some embodiments, game 100 may comprise at least one slider 600. In some embodiments, game 100 may comprise at least two sliders 600. In some embodiments, gaming surface 200 may comprise at least one slider 600. In some embodiments, gaming surface 200 may comprise at least two sliders 600. In some embodiments, during gameplay, each player may have their own slider 600. During gameplay, a given player may slide their given slider 600 from their end of gaming surface 200 towards the opposing simulated play region graphics 206, trying to achieve a certain desired play outcome.

FIG. 6A may depict slider 600 from a perspective view. FIG. 6A may show slider top 601 and portions of slider side 605. FIG. 6B may depict a slider 600 from a top view showing slider top 601. Shown in FIG. 6B, may be a top of slider 600, indicated as slider top 601. In some embodiments, slider 600 may comprise slider top 601 as the top of slider 600. In some embodiments, slider top 601 may be shaped and/or configured to simulate or represent a specific American football team, which may involve slider top 601 depicting one or more of: team colors, team mascot, team name, and/or the like. FIG. 6C may depict slider 600 from a side view. FIG. 6C may show some portions of slider side 605. FIG. 6D may depict slider 600 from a bottom view showing slider bottom 603. In some embodiments, slider 600 may comprise: slider top 601, slider bottom 303 which may be opposing slider top 601, and slider side 605. See e.g., FIG. 6A, FIG. 6B, FIG. 6C, and FIG. 6D.

In some embodiments, slider bottom 603 and top surface 115 may comprise a static coefficient of friction of 0.5 or less. In some embodiments, slider bottom 603 and top surface 115 may comprise a static coefficient of friction of 0.7 or less. In some embodiments, an exterior of slider bottom 603 may be substantially constructed from a metal. In some embodiments, an exterior of slider bottom 603 may be substantially coated with Teflon or a Teflon like material, such as polytetrafluoroethylene (PTFE), and/or the like; which may minimize friction with top surface 115. In some embodiments, top surface 115 may be substantially: hard, smooth, and/or flat.

In some embodiments, slider sides 605 may have IR (infrared) reflective surfaces to aid in automated positional finding of moving slides 600. In some embodiments, sliders 600 may be fitted with RFIDs (radio frequency identification or NFC [near field communication]) to aid in automated positional finding of moving slides 600.

Figure 7A:
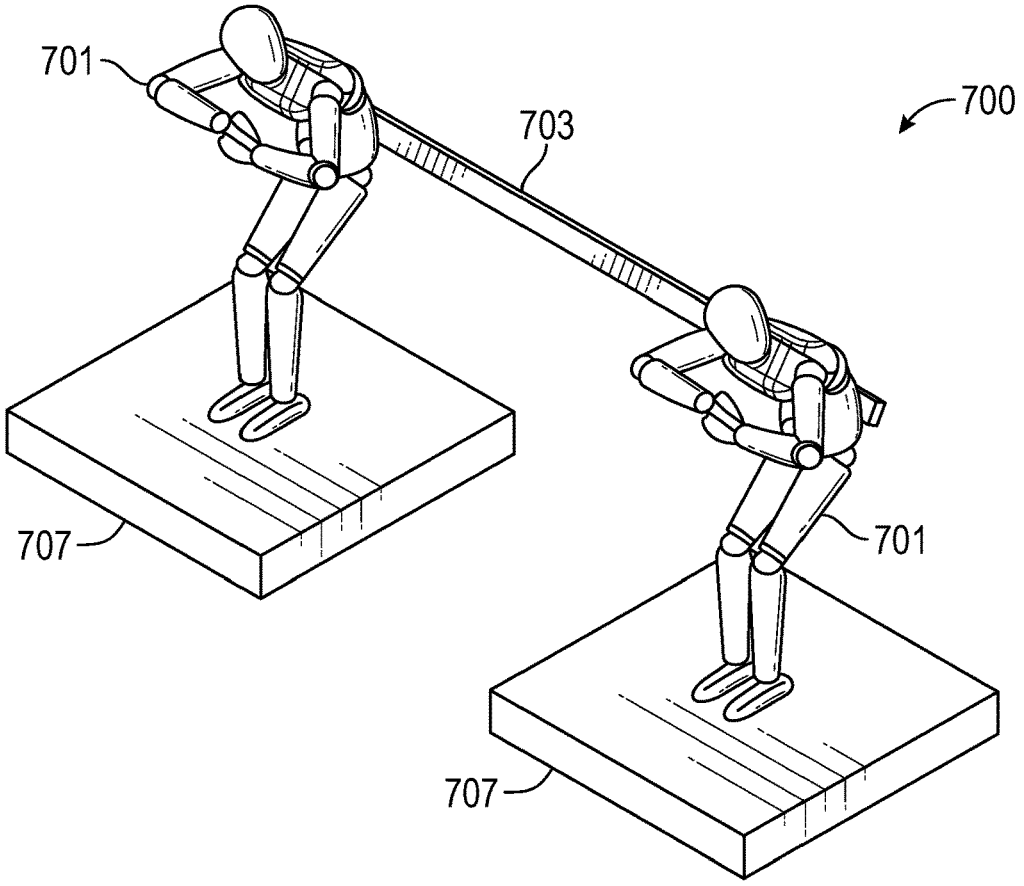
FIG. 7A may depict a perspective view of simulated defensive players.
Figure 7B:
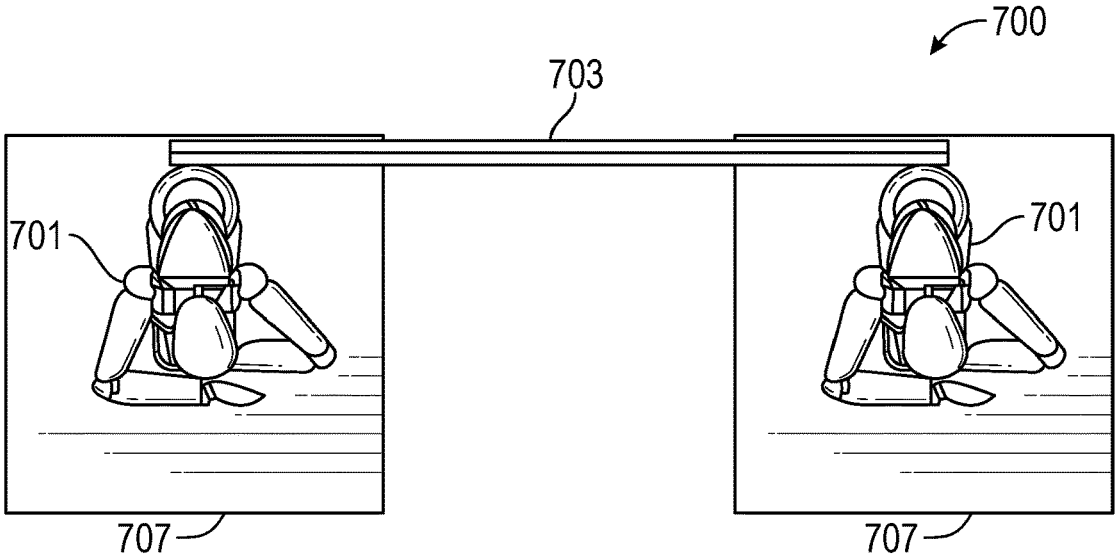
FIG. 7B may depict a top view of the simulated defensive players of FIG. 7A.
Figure 7C:
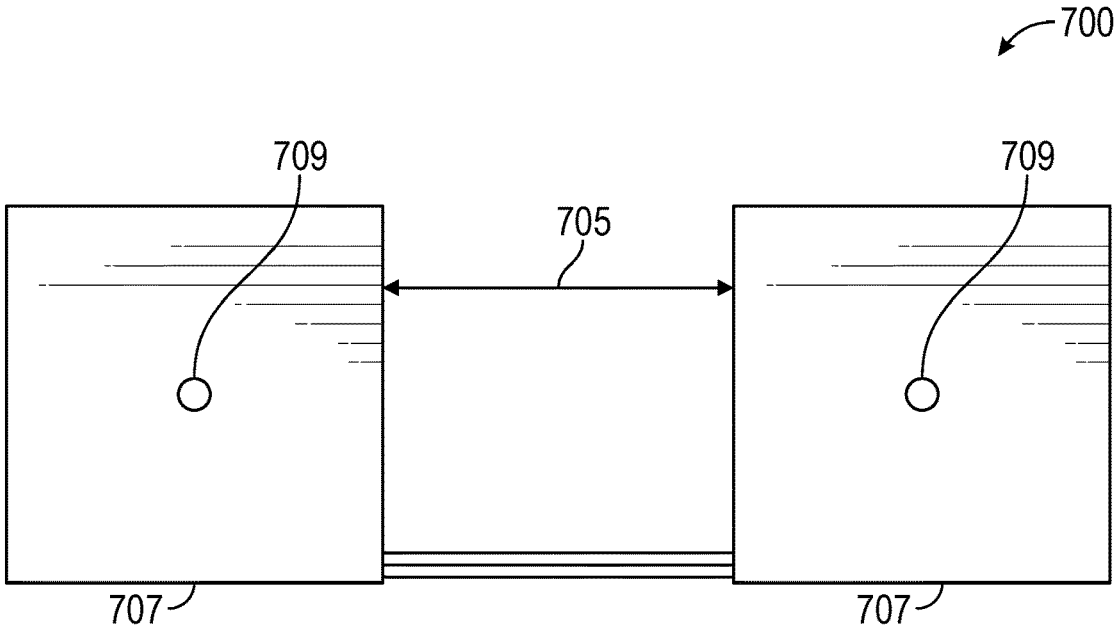
FIG. 7C may depict a bottom view of the simulated defensive players of FIG. 7A.
Figure 7D:
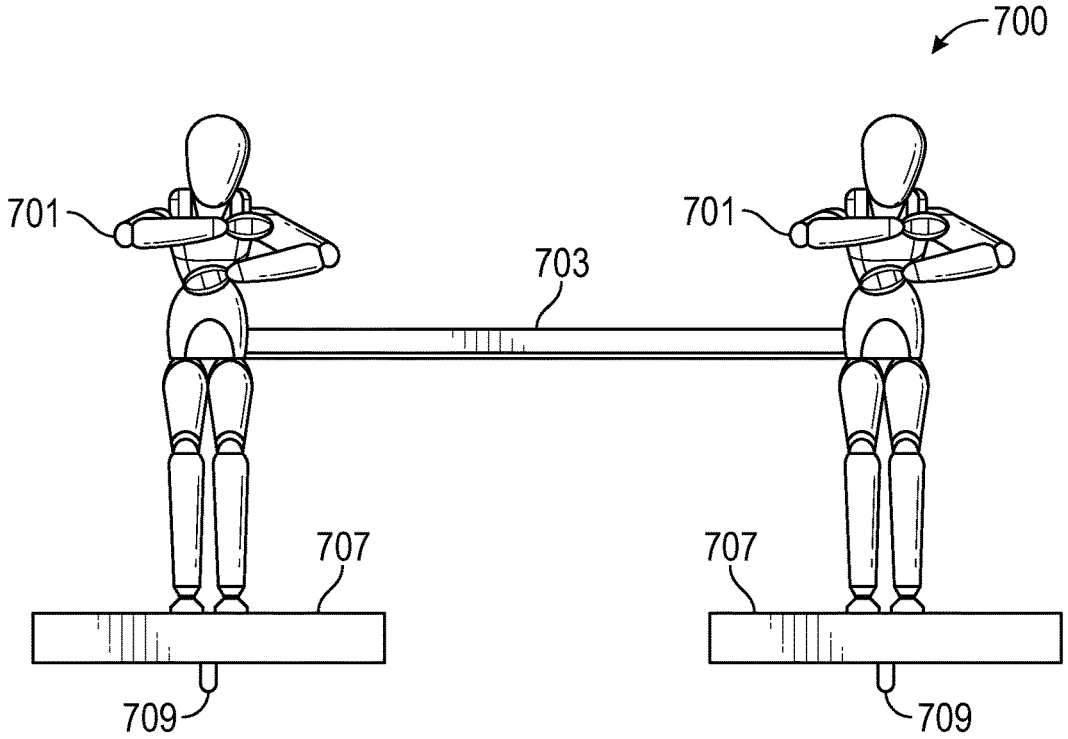
FIG. 7D may depict a front view of the simulated defensive players of FIG. 7A.
Figure 7E:
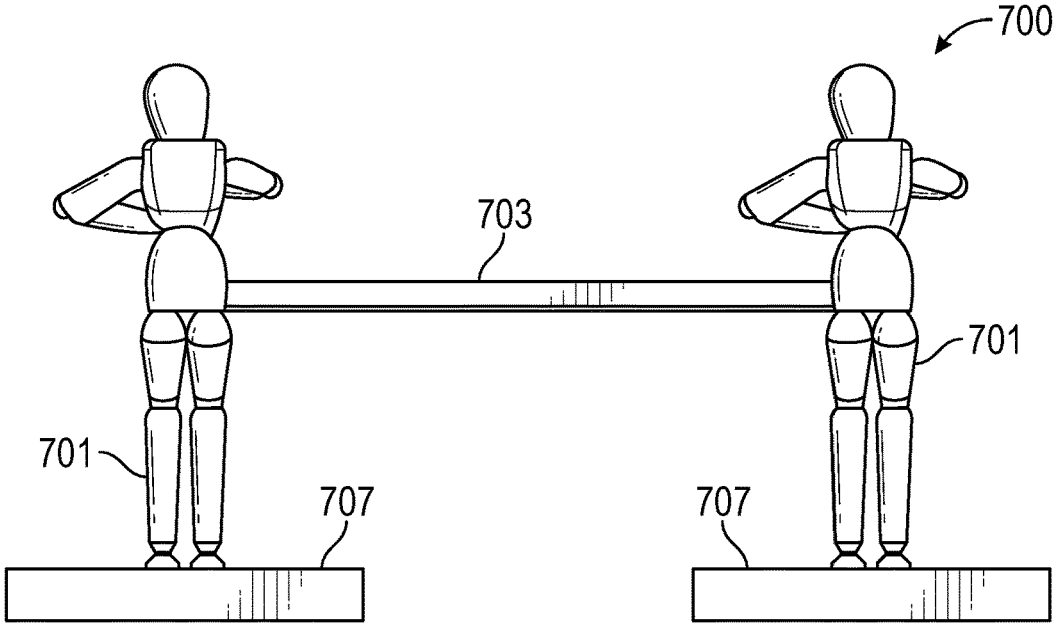
FIG. 7E may depict a back view of the simulated defensive players of FIG. 7A.
Figure 7F:
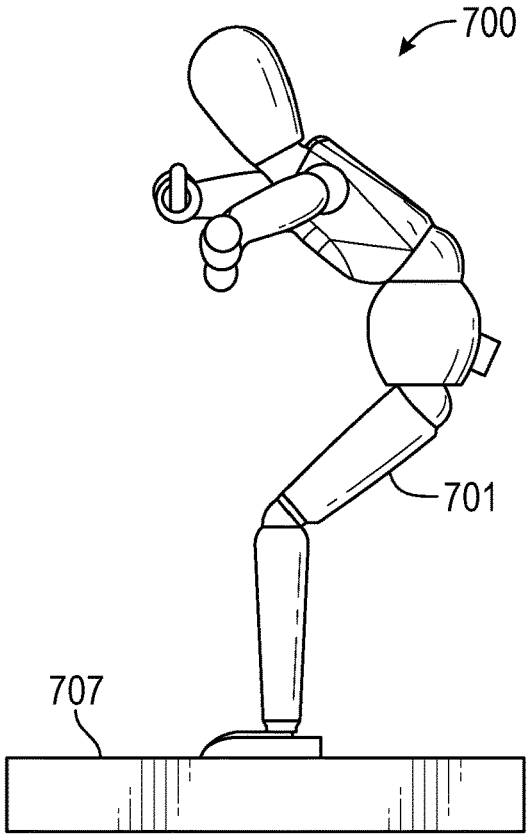
FIG. 7F may depict an end side view (left or right) of the simulated defensive players of FIG. 7A.
Figure 7G:
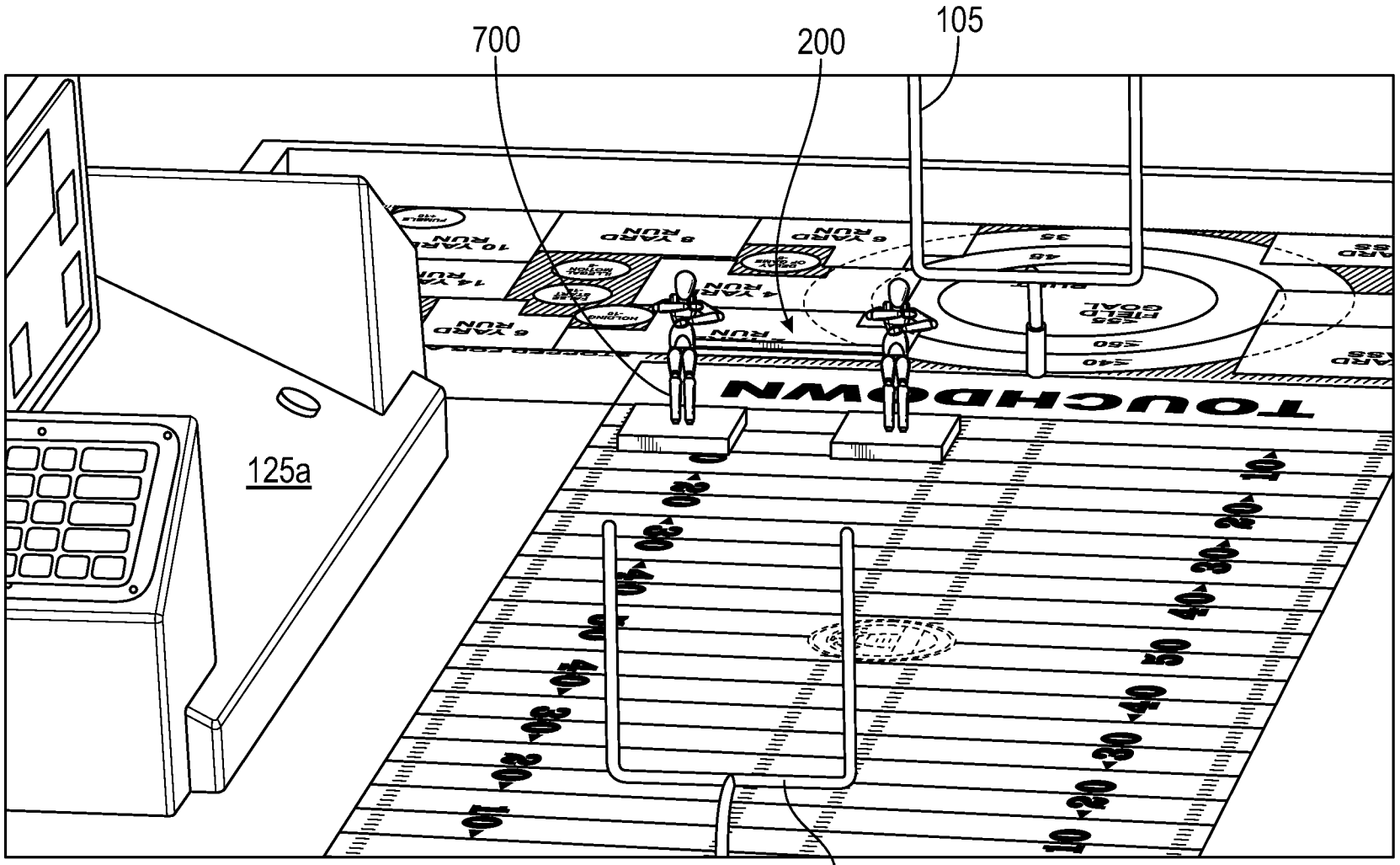
FIG. 7G may depict a perspective view of the simulated defensive players of FIG. 7A in use on a gaming surface.

FIG. 7A may depict a perspective view of simulated defensive players 700. FIG. 7B may depict a top view of simulated defensive players 700. FIG. 7C may depict a bottom view of simulated defensive players 700. FIG. 7D may depict a front view of simulated defensive players 700. FIG. 7E may depict a back view of simulated defensive players 700. FIG. 7F may depict an end side view (left or right) of simulated defensive players 700. FIG. 7G may depict a perspective view of simulated defensive players 700 in use on a gaming surface 200.

FIG. 7A may depict simulated defensive players 700. In some embodiments, game 100 may comprise or more simulated defensive players 700. In some embodiments, gaming surface 200 may comprise or more simulated defensive players 700; which may be removable from gaming surface 200. In some embodiments, simulated defensive players 700 may be removable from game 100. In some embodiments, simulated defensive players 700 may simulate defensive American football players. In some embodiments, during gameplay of game 100, or of gaming surface 200, a player on defense, may use simulated defensive players 700 to act as an obstacle to the other player's use of a slider 600. That is, simulated defensive players 700 may act as an obstacle to sliding motion of a slider 600. In some embodiments, simulated defensive players 700 may be placed removably upon a portion of top surface 115 during certain gameplay.

Continuing discussing FIG. 7A, in some embodiments, simulated defensive players 700 may comprise at least one individual defensive player 701. In some embodiments, individual defensive player 701 may be intended to be hit by and/or be struck by sliding sliders 600. In some embodiments, individual defensive player 701 may be shaped as an action figure resembling an American football player (defensive player). In some embodiments, individual defensive player 701 may be weighted, so as to minimize falling over upon being struck by a sliding slider 600. In some embodiments, individual defensive player 701 may be constructed from substantially rigid to semi-rigid materials of construction. In some embodiments, individual defensive player 701 may be constructed from substantially plastics, woods, and/or metals.

Continuing discussing FIG. 7A, in some embodiments, simulated defensive players 700 may comprise two or more individual defensive players 701; wherein adjacent individual defensive player 701 may be separated from each other by a slider gap 705 (shown in FIG. 7C); and wherein adjacent individual defensive player 701 may be physically linked to each other by linkage 703. In some embodiments, slider gap 705 may be sized to accommodate sliding of sliders 600 through slider gap 705. Thus a player on offense may aim a slider 600 for one such slider gap 705; with an intent to get the given slider 600 past simulated defensive players 700. In some embodiments, linkage 703 may be an elongate structural member linking individual defensive player 701 to each other in a given simulated defensive players 700. In some embodiments, linkage 703 may be positioned offset from top surface 115 by a height that does restrict slider 600 movement on top surface 115. That is, linkage 703 may be positioned by the height from top surface 115 that is greater than a height of slider 600.

For example, and without limiting the scope of the present invention, simulated defensive players 700 may comprise two or three individual defensive players 701 all linked by linkage(s) 703, and with adjacent individual defensive players 701 separated by slider gaps 705. See e.g., FIG. 7A, FIG. 7B, FIG. 7D, FIG. 7E, and FIG. 7G.

FIG. 7C showing a bottom of simulated defensive players 700 may also show anchors 709 on a bottom of each individual defensive player 701. FIG. 7D may also show these anchors 709 the bottom of each individual defensive player 701. In some embodiments, anchors 709 may be rigid to semi-rigid downwards facing/extending protrusions, pins and/or posts that may removably fit into complimentary receiving holes of top surface 115, and which may then facilitate removable attachment of simulated defensive players 700 to top surface 115. Some embodiments of simulated defensive players 700 may comprise these anchors 709 (see e.g., FIG. 7C and FIG. 7D).

However, other embodiments of simulated defensive players 700 may not comprise such anchors 709, which is why these anchors 709 are not shown in FIG. 7E nor in FIG. 7F. In some embodiments of simulated defensive players 700, without anchors 709, simulated defensive players 700 removably may rest upon top surface 115, by weight of simulated defensive players 700 and gravity. In some embodiments of simulated defensive players 700, without anchors 709, simulated defensive players 700 removably may rest upon top surface 115, by magnetic attraction, i.e., magnets in a bottom of each individual defensive player 701 and ferrous metals in gaming surface 200. In some embodiments of simulated defensive players 700, without anchors 709, simulated defensive players 700 removably may rest upon top surface 115, by suction cups at a bottom of each individual defensive player 701.

FIG. 7G may depict simulated defensive players 700 removably resting upon a portion of top surface 115 of gaming surface 200. FIG. 7G may be viewed from the offensive player's end of gaming surface 200. In FIG. 7G, a slider 600 may have been blocked from reaching simulated play region graphics 206 (or from reaching simulated play region 1206) by one of simulated defensive players 700's individual defensive players 701.

Figure 8A:
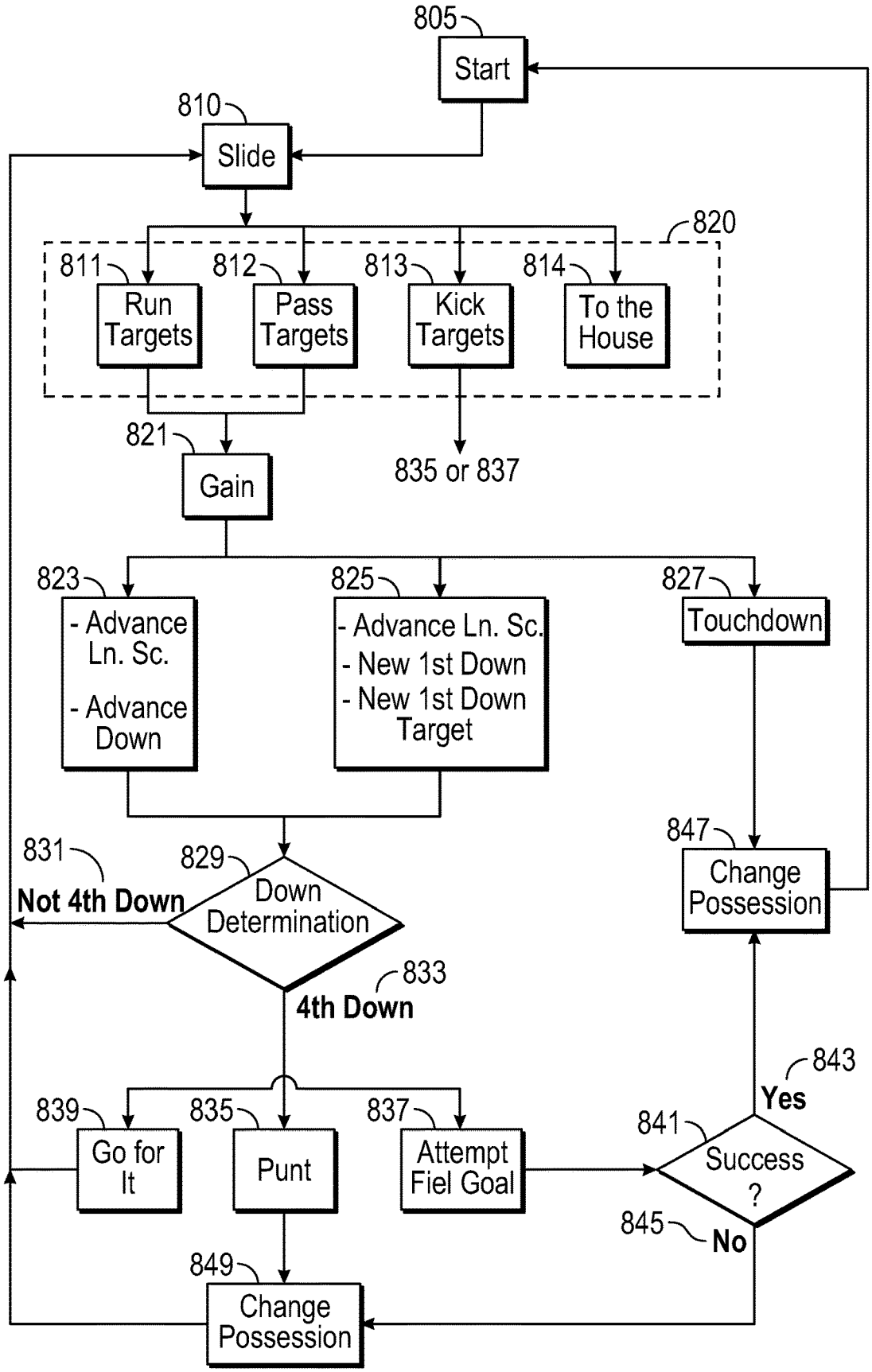
FIG. 8A may depict some possible desired outcomes from an offensive player (team) sliding a given slider, as depicted in a flow diagram.
Figure 8B:
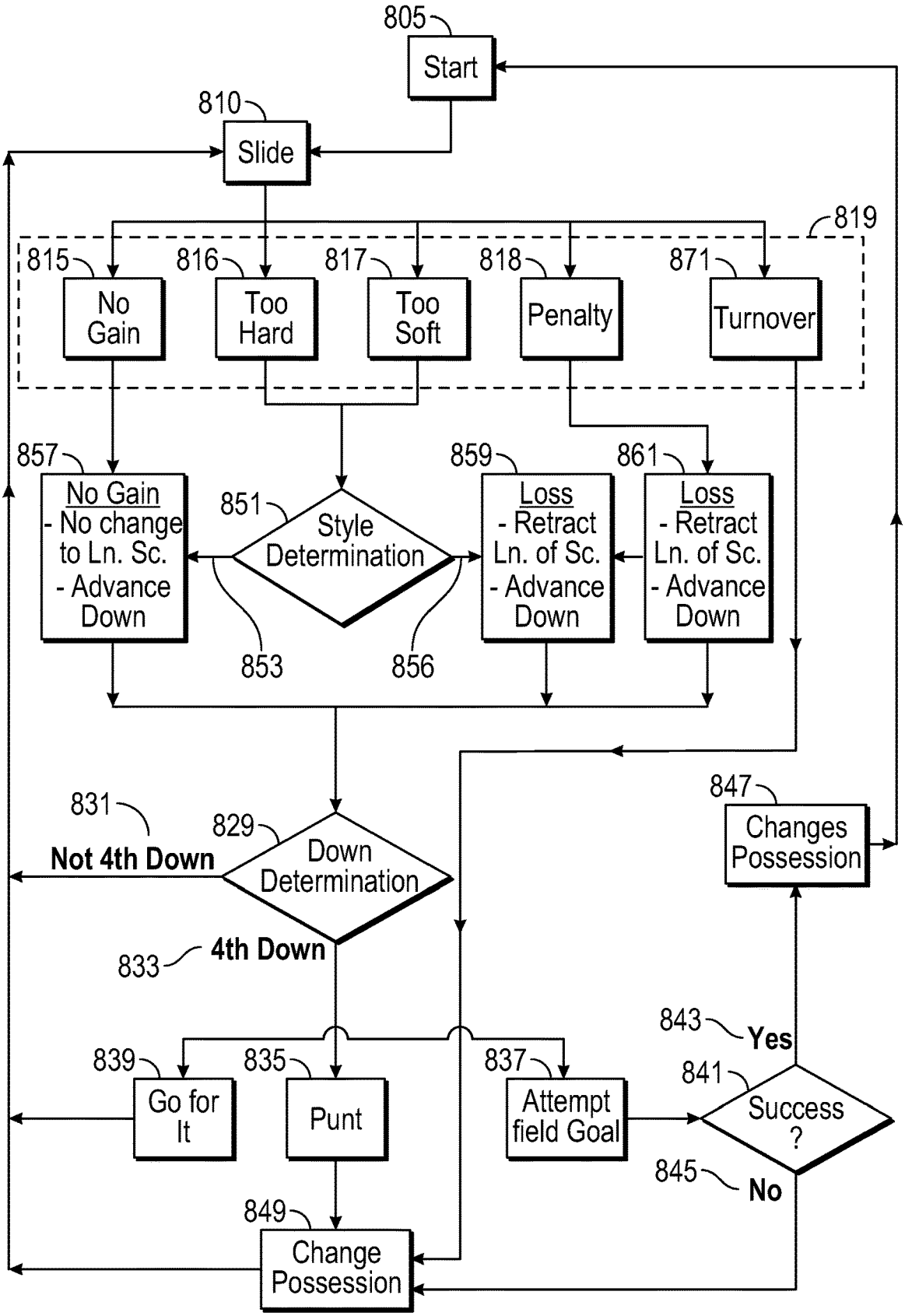
FIG. 8B may depict some possible undesired outcomes from an offensive player (team) sliding a given slider, as depicted in another flow diagram.

FIG. 8A may depict some possible desired outcomes from an offensive player (team) sliding a given slider, as depicted in a flow diagram. FIG. 8B may depict some possible undesired outcomes from an offensive player (team) sliding a given slider, as depicted in another flow diagram.

FIG. 8A may depict some possible desired outcomes 820 from an offensive player (team) sliding a given slider 600, as depicted in a flow diagram. And FIG. 8B may depict some possible undesired outcomes 819 from an offensive player (team) sliding a given slider 600, as depicted in another flow diagram. Together, FIG. 8A and FIG. 8B, may show steps in a method 800, wherein method 800 may be a method of playing a simulated American rules football game on a given game 100 using at least one slider 600 (or of playing a simulated American rules football game in a given gaming surface 200 with at least one slider 600).

Continuing discussing FIG. 8A, in some embodiments, a game played on gaming surface 200 with at least one slider 600 may have gameplay begin with step 805. In some embodiments, step 805 may comprise uniform offensive possession start conditions. In some embodiments, these offensive possession start conditions may comprise with the offensive player (team) starting on their 25 yard line, First Down, and at least 10 yards to go to achieve a new First Down. In some embodiments, this offensive player (team) may use their control 741 (e.g., line of scrimmage advance/decline buttons 143) to locate line of scrimmage indicator 544 at their 25 yard line. In some embodiments, this offensive player (team) may use their control 741 to locate first down yard marker target 531 at their 35 yard line. In some embodiments, step 805 of method 800 may comprise receiving these initial offensive possession start conditions.

Continuing discussing FIG. 8A, in some embodiments, method 800 may then progress to a sliding step of step 810. In some embodiments, step 810 may comprise the offensive player (team) sliding a given slider 600 from their simulated end-zone 211 towards the opposing simulated play region graphics 206 (simulated play region 1206).

Continuing discussing FIG. 8A, in some embodiments, method 800 may then progress to a sliding outcome step of either desired slide outcomes 820 or undesired slide outcomes 819. Note undesired slide outcomes 819 may be depicted in FIG. 8B. Continuing discussing FIG. 8A, desired slide outcomes 820 may comprise: run targets slide outcome 811; pass target slide outcome 812; kick targets slide outcome 813; or "To the House" slide outcome 814. In some embodiments, run targets slide outcome 811 may result if the given slider 600 comes to a stop mostly over a run target 221. In some embodiments, pass target slide outcome 812 may result if the given slider 600 comes to a stop mostly over a pass target 231. In some embodiments, kick targets slide outcome 813 may result if the given slider 600 comes to a stop mostly over a kick target 241 (or outside of the outermost concentric circle) and the offensive player was intending a punt 835 or attempting a field goal 837. In some embodiments, "To the House" slide outcome 814 may result if the given slider 600 comes to a stop with a portion of the given slider 600 straddling an edge of the opposing simulated play region 1206; i.e., if the given slider 600 may come to rest straddling a boundary between the opposing simulated play region 1206 and catch basin 117, but without the given slider 600 falling into catch basin 117. In some embodiments, if "To the House" slide outcome 814 is an outcome result from sliding step 810, then this outcome result may be a touchdown 827; which may provide that offensive player (team) with seven points. In some embodiments of method 800, having "To the House" slide outcome 814 may be optional. In some embodiments of method 800, "To the House" slide outcome 814 may not be included in method 800.

Continuing discussing FIG. 8A, in some embodiments, run targets slide outcome 811 or pass target slide outcome 812 may result in yardage gain outcome 821. In some embodiments, method 800 may comprise yardage gain outcome 821. In some embodiments, yardage gain outcome 821 may result in "advancing line of scrimmage and advance Down 823" or "advance line of scrimmage and new First Down and New First Down Target 825" depending upon how many yards were gained in relation to first down yard marker target 531, as indicated by the run targets 221 or pass targets 231 that the given slider 600 came mostly to a stop over. If the yards gained are less than indicated by first down yard marker target 531, then the step of "advancing line of scrimmage and advance Down 823" may be appropriate. Advancing the line of scrimmage, as indicated by line of scrimmage indicator 544, may be via control 741 to locate line of scrimmage indicator 544 to a new yard location on simulated field region 1204 (and/or on display 128) by adding the yards gained onto the prior line of scrimmage. Advancing the Down in step 823 may result in Second Down, Third Down, or Fourth Down for the next play. If the yards gained are equal to or more than indicated by first down yard marker target 531, then the step of "advance line of scrimmage and new First Down and New First Down Target 825" may be appropriate. In some embodiments, advancing first down yard marker target 531 to a new first down yard marker target 531 may entail using controls 741 to toggle first down yard marker target 531 to 10 yards plus the new line of scrimmage on simulated field region 1204.

Continuing discussing FIG. 8A, in some embodiments, step 823 or step 825 may each progress into a step of down determination 829. In some embodiments, in down determination 829, if the Down from step 823 (e.g., Second Down, Third Down, or Fourth Down) or step 825 (e.g., First Down) is less than Fourth Down, then outcome 831 may result. In some embodiments, outcome 831 may be outcome if present down is less than Fourth Down 831. In some embodiments, outcome 831 may then result into sliding step 810.

Continuing discussing FIG. 8A, in some embodiments, in down determination 829, if the Down from step 823 (e.g., Second Down, Third Down, or Fourth Down) is the Fourth Down, then outcome 833 may result. In some embodiments, outcome 833 may be the outcome if present down is Fourth Down 833.

Continuing discussing FIG. 8A, in some embodiments, the offensive player (team) at outcome 833 (e.g., Fourth Down) may have two or three options depending on line of scrimage location as indicated by line of scrimmage indicator 544. In some embodiments of method 800, these two or three options may comprise: punting 835, attempting a field goal 837, or "Going for It 839."

Continuing discussing FIG. 8A, in some embodiments, punting 835 may comprise the current offensive player (team) sliding their slider 600 from their simulated end-zone 211 towards the opposing simulated play region graphics 206 (opposing simulated play region 1206), specifically towards kick targets 241. If the slider 600 may come to rest (stop) mostly over a given kick target 241, then kick targets slide outcome 813 may result; or if the slide in step 810 was too light failing to even reach outer most concentric circle of kick targets 241, then a 35 yard punt may be the result for outcome 813. Regardless of sliding outcome of punting 835, punting 835 may result in a step of change of possession 849; wherein the former defensive player (team) now becomes the current offensive player (team) and the former offensive player (team) becomes the current defensive player (team). In some embodiments, the new offensive player (team) resulting from change of possession 849 may then begin method 800 at sliding step 810. In some embodiments, the new offensive player (team) resulting from change of possession 849 may then begin method 800 at sliding step 810 at line yardage dictated by the punt results.

Continuing discussing FIG. 8A, in some embodiments, attempting a field goal 837 may comprise the current offensive player (team) sliding their slider 600 from their simulated end-zone 211 towards the opposing simulated play region graphics 206 (opposing simulated play region 1206), specifically towards kick targets 241. If the slider 600 may come to rest (stop) mostly over a given kick target 241, then kick targets slide outcome 813 may result; or if the slide in step 810 was too light failing to even reach outer most concentric circle of kick targets 241, then attempting a field goal 837 would be a simulated 40 yard kick, which may or may not be successful depending upon where line of scrimmage indicator 544 was. In some embodiments, outcomes of attempting a field goal 837 may be a successful field goal earning that player (team) three points or a failed attempt because not enough yardage was obtain to reach goal post 105. In some embodiments, attempting a field goal 837 step may progress into a step of determining of the field goal attempt was successful or not, i.e., field goal success determination 841. A successful field goal may be step 843 which may then progress into a step of change of possession 847; wherein the former defensive player (team) now becomes the new offensive player (team) and the former offensive player (team) becomes the new defensive player (team). The new offensive player (team) resulting from change of possession 847 may then begin method 800 at starting step 805. Whereas, an unsuccessful field goal attempt may be step 845, which may then progress into change of possession step 849; wherein the former defensive player becomes the new offensive player and the former offensive player becomes the new defensive player; wherein this new offensive player resumes play at slide step 810 and with line of scrimmage indicator 544 at the last line of scrimmage indicator 544 location.

Note, in some embodiments, attempting a field goal 837 may only be an option for outcome 833 (i.e., Fourth Down) (or any Down) if the line of scrimmage as indicated by line of scrimmage indicator 544 was at the defensive player's 45 yard marker or closer to the defensive player's end-zone 211.

Continuing discussing FIG. 8A, in some embodiments, kick targets slide outcome 813 may be a slide outcome from slide step 810 if the offensive player was intentionally punting 835 or intentionally attempting a field goal 837. In some embodiments, prior to the offensive player intentionally punting 835 or intentionally attempting a field goal 837, the offensive player must communicate these intentions to the defensive player. Punting 835 or attempting a field goal 837 may be attempted on any Down; however, in some embodiments, attempting a field goal 837 may only be an option for outcome 833 (i.e., Fourth Down) (or any Down) if the line of scrimmage as indicated by line of scrimmage indicator 544 was at the defensive player's 45 yard marker or closer to the defensive player's end-zone 211.

Continuing discussing FIG. 8A, in some embodiments, at Fourth Down, the current offensive player may decide to "go for it 839." In some embodiments, the step of going for it 839 may be a step of the current offensive player making a final slide 810 towards run targets 221 or pass targets 231; with an intent to gain sufficient yardage to achieve a new First Down or a touchdown 827.

Continuing discussing FIG. 8A, in some embodiments, if yardage gains 821 from slider 600 coming to rest mostly on run targets 221 or mostly on pass targets 231, as indicated by run targets slide outcome 811 or pass target slide outcome 812, respectively, are sufficient to advance line of scrimmage indicator 544 to goal line 220 or further, then touchdown 827 may be the result. Touchdown 827 may then result in change of possession 847. Change of possession 847 may then result in start step 805 for the new offensive player (team).

FIG. 8B may depict some possible undesired outcomes 819 from an offensive player (team) sliding a given slider 600, as depicted in another flow diagram. In some embodiments, undesired outcomes 819 may comprise: no gain targets slide outcome 815, too hard slide outcome 816, too soft slide outcome 817, penalty targets slide outcome 818, or turnover outcome 871. In some embodiments, no gain targets slide outcome 815 may be a result if the given slider 600 comes to a stop with a majority of that given slider 600 over a no gain region 251. In some embodiments, no gain targets slide outcome 815 may mean "no gain outcome and no change to line of scrimmage and advance Down 857" is the result of that given slider 600 sliding outcome.

Continuing discussing FIG. 8B, in some embodiments, too hard slide outcome 816 may mean the offensive player (team) slid the given slider 600 hard enough to cause that given slider 600 to slide entirely through simulated play region graphics 206 (simulated play region 1206) such that the given slider 600 comes to a stop (rest) not on any target or region within simulated play region graphics 206 (simulated play region 1206). In some embodiments, too hard slide outcome 816 may mean the offensive player (team) slid the given slider 600 hard enough to cause that given slider 600 to slide entirely through simulated play region graphics 206 (simulated play region 1206) such that the given slider 600 comes to a stop (rest) in a catch basin 117.

Continuing discussing FIG. 8B, in some embodiments, too soft slide outcome 817 may mean the offensive player (team) slid the given slider 600 soft enough such that the given slider 600 failed to reach any portion of simulated play region graphics 206 (simulated play region 1206).

Continuing discussing FIG. 8B, in some embodiments for a given game being played upon gaming surface 200, too hard slide outcome 816 or too soft slide outcome 817 may have a same result, either a result of no yardage gain 853 or a result of yardage loss 855. This determination, denoted as style of play determination 851, in FIG. 8B, may be a mutually agreed upon determination of whether too hard slide outcome 816 and too soft slide outcome 817 will result in no yardage gain 853 or will result in a yardage loss 855. In some embodiments, timing of making this decision of style of play determination 851 may be decided by the players (teams) prior to commencement of start step 805. In some embodiments, once style of play determination 851 has been decided, that decision may apply to an entirety of that game.

Continuing discussing FIG. 8B, in some embodiments, if no yardage gain 853 is selected for style of play determination 851, then method 800 may progress to "no gain outcome and no change to line of scrimmage and advance Down 857."

Continuing discussing FIG. 8B, in some embodiments, if yardage loss 855 is selected for style of play determination 851, then method 800 may progress to "loss of yard(s) and retract line of scrimmage and advance Down 859."

In some embodiments, style of play determination 851, may be a selection from "high school style," "college style," or "professional style." Selection of "high school style" may be a selection of "no gain outcome and no change to line of scrimmage and advance Down 857" as the result for too hard slide outcome 816 or too soft slide outcome 817.

Selection of "college style" or "professional style" may be a selection of "loss of yard(s) and retract line of scrimmage and advance Down 859" as the result for too hard slide outcome 816 or too soft slide outcome 817. In some embodiments, "college style" may provide for a loss of two yards when too hard slide outcome 816 or too soft slide outcome 817 is the outcome. In some embodiments, "professional style" may provide for a loss of six yards when too hard slide outcome 816 or too soft slide outcome 817 is the outcome.

Continuing discussing FIG. 8B, in some embodiments, penalty targets slide outcome 818 may be a result if the given slider 600 comes to a stop with a majority of that given slider 600 over a penalty region 261. In some embodiments, penalty targets slide outcome 818 may mean "loss of yard(s) and retract line of scrimmage and repeat Down 861" is the result of that given slider 600 sliding outcome. Note, step 861 may differ from step 859, in that in step 861 the result may be repeating the Down; whereas, in step 859 the Down is advanced.

Continuing discussing FIG. 8B, in some embodiments, step 857, step 859, or step 861 may each then lead to down determination 829; wherein down determination 829 may be as discussed above. See e.g., FIG. 8A and its discussion.

Continuing discussing FIG. 8B, in some embodiments, turnover outcome 871 may mean the offensive player (team) slid the given slider 600 hard enough to have slider 600 come to rest mostly over a given turnover region 271, which may simulate a fumble or an interception. See FIG. 2B and/or FIG. 2D for turnover regions 271. In some embodiments, an offensive player achieving turnover outcome 871 may then result in change of possession 849, with the former defensive player now becoming the offensive player and starting with step 810. Where line of scrimmage indicator 544 should be, may be indicated by the given turnover region 271 that the slider 600 came to rest mostly over. For example, and without limiting the scope of the present invention, an interception outcome may result in a simulated 15 yard change in line of scrimmage indicator 544, with the yardage benefit going to the new offensive player (former defensive player). For example, and without limiting the scope of the present invention, a fumble outcome may result in a simulated 10 yard change in line of scrimmage indicator 544, with the yardage benefit going to the new offensive player (former defensive player).

In some embodiments of gameplay on game 100 and/or on gaming surface 200 the following rules of play may apply:

In some embodiments, under "college style" and/or under "professional style" of play, if a first player is on offense, then a second player is on defense (e.g., as possession may be indicated by lit offense-or-defense indicators on display 128). In some embodiments, the first player may then engage either RUN selection or PASS selection (see e.g., applicable buttons 143 of FIG. 4) on the player's given controls 141; which may then also light up after engagement. In some embodiments, the second player may not be able to see the first player's selection because view may be obstructed by simulated stands 125 and/or because the two opposing controls 141 may not face each other. In some embodiments, the second player may also select either RUN selection or PASS selection on that player's respective controls 141. It may not matter which order RUN selections or PASS selections are engaged by the first player or by the second player. In other words, the first player may select RUN selection or PASS selection first; or the second player may select RUN selection or pass selection first. What matters is that both players make their own selections of RUN selections or PASS selections, such as prior to sliding a slider 600. After both players have indicated their intention by either engaging their own RUN selection or PASS selection, the following outcomes may occur:

(a) Player on offense selects RUN selection and the player on defense also selects RUN selection; then run LEDs may light up and may blink for a predetermined amount of time (e.g., five seconds). The color these LEDs may show may be red. These LEDs may be backlit beneath gaming surface 205 and/or may appear on controls 141 and/or may appear on display 128. This outcome may mean this defensive player may use simulated defensive players 700 to attempt to block slider 600.

(b) Player on offense selects RUN selection and the player on defense selects PASS selection; then run LEDs light up and may blink for a predetermined amount of time (e.g., five seconds). The color run LEDs may show may be green. These LEDs may be backlit beneath gaming surface 205 and/or may appear on controls 141 and/or may appear on display 128. This outcome may mean this defensive player may not use simulated defensive players 700 to attempt to block slider 600.

(c) Player on offense selects PASS selection and the player on defense also selection PASS selection; then pass LEDs light up and may blink for a predetermined amount of time (e.g., five seconds). The color pass LEDs may show may be red. These LEDs may be backlit beneath gaming surface 205 and/or may appear on controls 141 and/or may appear on display 128. This outcome may mean this defensive player may use simulated defensive players 700 to attempt to block slider 600.

(d) Player on offense selects PASS selection and the player on defense selects RUN selection; then pass LEDs light up and may blink for a predetermined amount of time (e.g., five seconds). The color pass LEDs may show may be green. These LEDs may be backlit beneath gaming surface 205 and/or may appear on controls 141 and/or may appear on display 128. This outcome may mean this defensive player may not use simulated defensive players 700 to attempt to block slider 600.

In some embodiments, it may be the player on offense (e.g., as possession may be indicated by lit offense-or-defense indicators on display 128), which may dictate whether pass LEDs or run LEDs 781 may be activated. That is, if the player on offense selects RUN selection then run LEDs may activate (e.g., light up and/or blink); however, whether they engage green or red may depend upon the player on defense selection. That is, if the player on offense selects PASS selection then pass LEDs may activate (e.g., light up and/or blink); however, whether they engage green or red may depend upon the player on defense selection.

In some embodiments, wherein game 100, game 1100, and/or supportive table structures (e.g., 119, 1221, and/or 1223) may comprise controls 141 with RUN selection means and PASS means (see e.g., FIG. 4); then use of player fingers as noted below may not be necessary.

In some embodiments of gameplay on game 100 and/or on gaming surface 200 using at least one slider 600, wherein the following rules of play may apply:

Objectives of Gameplay

Objectives of gameplay may roughly follow, approximate, and/or simulate that of American Rules Football. A primary objective may be for a given player (team) to advance their line of scrimmage indicator 544 towards their opponent's end-zone and with an objective of scoring points either by a field goal (three points) or a touchdown (seven points). A safety of two points may also be possible, earned by the defense.

Fundamental Rules of Gameplay

In some embodiments, rules of gameplay on game 100 (or of using gaming surface 200) and using at least one slider 600 may roughly follow rules and gameplay of American Rules Football. Fundamental rules of gameplay on game 100 (or of using gaming surface 200) using at least one slider 600 may comprise:

a. A given offensive player (team) is permitted four Downs to advance at least ten (simulated) yards to a first down yard marker target 531 (which is set at 10 yards beyond line of scrimmage indicator 544 of a First Down).

b. Line of scrimmage indicator 544 may advance (yardage gain), retract (yardage loss), or stay unchanged at the end of any given Down; however, first down yard marker target 531 may only advance if a new First Down is achieved.

c. A new set of four Downs is allotted after a First Down is achieved. A new First Down is achieved for the current offensive player (team) via plays (runs or passes) in the proceeding First Down, Second Down, Third Down, or Fourth Down results in cumulative yardage gain at or beyond first down yard marker target 531 (which is set at 10 yards beyond line of scrimmage indicator 544 of a First Down). (A new First Down for the current defensive player [team] is achieved by a change in possession.)

d. On Fourth Down, the current offensive player (team) may choose to either;

i. "go for it 839"—try to obtain a new First Down by gaining sufficient yards at or beyond first down yard marker target 531 (or try to achieve a Touchdown 827); or ii. attempt to kick a field goal 837 by sliding a slider 600 towards opposing kick targets 241 if line of scrimmage indicator 544 is at or closer than the 45 yard line (or another predetermined value) of opponent (defensive player[team]); or iii. punt 835 by sliding slider 600 towards opposing kick targets 241. A worst possible punt may be 35 yards regardless of how far outside of kick targets 241 slider 600 may end. In some embodiments, a "touchback" may be possible. For instance, if line of scrimmage indicator 544 may be at the 50 yard line (too far for a field goal) and kick targets 241 of 55 yards is obtained, the punt is assumed to have gone into the end-zone, offense and defense switch (change of possession 847), and play resumes in the opposite direction starting with line of scrimmage indicator 544 at the new offensive player's 20 yard line. A 45 yard punt when line of scrimmage indicator 544 is at the defensive player's 45 yard line is also considered a touchback.

How to Play a Game on Game 100 Using at Least One Slider 600

Styles of Play Determination 851. In some embodiments, style of play determination 851, may be a selection from "high school style," "college style," or "professional style." In some embodiments, timing of making this decision of style of play determination 851 may be decided by the players (teams) prior to commencement of gameplay, such as prior to start step 805.

High School Style: Players do not indicate whether they intend to run or pass before sliding a slider 600 and simulated defensive players 700 may not utilized for this style of play. If a slider 600 is slid short of the run targets 221 or pass targets 231 or beyond opposing simulated play region graphics 206 (opposing simulated play region 1206), there may be no yards gained nor lost. The Down advances, and the player on offense slides 810 again (if the prior Down was not a Fourth Down).

College Style: Before sliding a slider 600, both players on offense and defense conceal one or two fingers behind their respective backs. The player on offense conceals one finger if intends to aim at run targets 221 and two fingers if intends to aim at pass targets 231. The player on defense conceals one finger if intends to defend run targets 221 and two fingers if intends to defend pass targets 231. On the count of one, two, three, both players reveal their intent by showing each other their fingers. If the player on defense is defending same run targets 221 or the same pass targets 231 that the offensive player is intending to aim for, then defensive player is permitted to place the simulated defensive players 700 in front of the corresponding run targets 221 or the corresponding pass targets 231. If the slider 600 may be slid short of the run targets 221 or short of pass targets 231 or beyond opposing simulated play region graphics 206 (opposing simulated play region 1206), then a result may be a loss of two yards. The Down advances, and the player on offense slides 810 again (if the prior Down was not a Fourth Down).

Professional Style: Before sliding a slider 600, both players on offense and defense conceal one or two fingers behind their respective backs. The player on offense conceals one finger if intends to aim at run targets 221 and two fingers if intends to aim at pass targets 231. The player on defense conceals one finger if intends to defend run targets 221 and two fingers if intends to defend pass targets 231. On the count of one, two, three, both players reveal their intent by showing each other their fingers. If the player on defense is defending same run targets 221 or the same pass targets 231 that the offensive player is intending to aim for, then defensive player is permitted to place the simulated defensive players 700 in front of the corresponding run targets 221 or the corresponding pass targets 231. If the slider 600 may be slid short of the run targets 221 or short of pass targets 231 or beyond opposing simulated play region graphics 206 (opposing simulated play region 1206), then a result may be a loss of six yards. The Down advances, and the player on offense slides 810 again (if the prior Down was not a Fourth Down).

Game Clock

In some embodiments, a game clock (which may be displayed on display 128 in some embodiments) may be set to countdown from 10 minutes (or a duration of play agreed upon by both players). In some embodiments, no more than 20 seconds (or other predetermined length of time) should elapse between each slide 810 of slider 600. This may become relevant for players that attempt to "manage the clock" (i.e., delay play of game) as the game draws closer to its conclusion. In some embodiments, this limitation (i.e., time limit between slides 810 of slider 600) may be provided for by game clock shown on display 128 or another clock. In some embodiments, this limitation (i.e., time limit between slides 810 of slider 600) may be followed on each player's honor. In some embodiments, breach of this limitation (rule) may result a penalty 818; e.g., a 5 yard penalty or some other pre-agreed to consequence. In some embodiments, players can mutually agree to stop the clock for "timeouts" as they deem appropriate.

Start of Gameplay

Start of gameplay on a given game 100 (or using gaming surface 200) using at least one slider 600 may be as follows:

a. To start players engage in Rock, Paper, Scissors (best two out of three) (or flip a coin or the like) the winner of which is on offense first. The line of scrimmage starts at their own 25 yard line as indicated by line of scrimmage indicator 544, it is First Down and 10 yards to go.
b. The Game clock may be started and the player on offense slides 810 a slider 600 at run targets 221 or pass targets 231. This step may be conditioned by style of play determination 851 noted above.
c. Outcomes of the slide 810 may be desired slide outcomes 820 or undesired slide outcomes 819. Some outcomes may be determined by whichever target/region is mostly under the final resting place of the given slider 600; and may indicate a yardage gain, no gain, a yardage loss, a penalty with yardage loss, and the like (see e.g., FIG. 2A, FIG. 2B, and/or FIG. 2D).
d. In some embodiments, slider(s) 600 may be removed from top surface 115 after each slide 810.
e. Players may track the movement of the line of scrimmage, as indicated by line of scrimmage indicator 544 on simulated field graphics 204 (simulated field region 1204), by moving line of scrimmage indicator 544 forward (advancing) or backward (retracting) according to yards gained or lost resulting from outcomes 820 or outcomes 819 to a given slide 810.

Penalties

In some embodiments, it is not possible for the defense to decline a penalty. In some embodiments, all penalties are followed by a repeat of the Down after the penalty yardage is applied. See e.g., step 861 in FIG. 8B. For instance, if it is Second Down and 8 yards to go for a First Down and the slider 600 stops on the "Holding −10" penalty region 261; then line of scrimmage indicator 544 is moved backward 10 yards and the Second Down is repeated, now with 18 yards to go in order to get a First Down.

If there ever is an instance where the penalty would cause the line of scrimmage (as indicated by line of scrimmage indicator 544) to be backed up beyond goal line 220 (i.e., into the end-zone), the penalty is enforced by moving line of scrimmage indicator 544 "half the distance to the goal." For instance, if line of scrimmage indicator 544 is on the 8 yard line and the slider 600 stops on a "Holding −10" penalty, play resumes with a repeat of the same Down from the 4 yard line. When line of scrimmage indicator 544 is on an odd numbered yard marker and the penalty is greater than the distance to goal line 220, the offense gets the benefit of "half the distance to the goal." For instance, if line of scrimmage indicator 544 is at the 5 yard line and slider 600 stops on "Holding −10" penalty, line of scrimmage indicator 544 is moved back to the 3 yard line and the Down is repeated.

In some embodiments, a given game cannot end on a penalty even if the time expires while line of scrimmage indicator 544 is being reset. The last play of the given game must be any outcome other than a penalty.

Scoring

Safety (2 points for defense): In some embodiments, a safety may only occur in "College Style" or "Professional Style" because it may only be possible to lose yards as an outcome other than a penalty when playing those styles. Remember, it may not be possible for a safety to occur as the result of a penalty in some embodiments. However, anytime line of scrimmage indicator 544 may be close enough to goal line 220 of the offensive player that the result of slider 600 sliding is a loss of yards equal to or greater than the yard line associated with line of scrimmage indicator 544, the result may be a safety. In "College Style," if the player on offense has their line of scrimmage at the one or two yard line and the result of the puck sliding is a loss of two yards, a safety is awarded to the defense. The same outcome, a safety, occurs if players are playing in the "Professional Style" and the line of scrimmage is at the six yard line or closer to end-zone 211 of the offense and slider 600 sliding results in a loss of six yards (e.g., an attempted pass play that falls short of pass targets 231 or is tossed beyond simulated play region graphics 206 [simulated play region 1206]). If a safety occurs, the player (team) on defense is awarded 2 points and play restarts with the same team that was on offense performing a punt (considered a "free kick") from their 35 yard line.

Field Goal (3 points to offense): While it may be most common to attempt a field goal 837 on Fourth Down, the team on offense may attempt a field goal 837 on any Down as long as their line of scrimmage (line of scrimmage indicator 544) is at the 45 yard line or closer to opposing end-zone 211. Add ten yards (simulated) (distance to cross from goal line 220 to goal post 400) to calculate the distance of the field goal attempt 837 from line of scrimmage indicator 544. For example, attempting to kick a field goal 837 when line of scrimmage indicator 544 is at the 30 yard line of defense is considered a 40 yard field goal attempt, and so on. An attempted field goal 837 is considered "good" if slider 600 slides and stops in kick targets 241 that corresponds to the distance attempted or greater. For instance, if a 35 yard field goal is attempted, that attempted field goal is good if slider 600 stops in any of the field goal circles in kick targets 241. However, if a 52 yard field goal is attempted, it is only considered "good" if slider 600 stops in the innermost circle of kick targets 241. If a field goal attempt is "missed" then change of possession 849 occurs and the team that was on defense now takes over on offense from the location of line of scrimmage indicator 544 from where the field goal was attempted and with a new set of Downs; First Down and 10 yards to go. If the field goal is "good" the kicking team (offense) is credited with three points, change of possession 847 occurs and the team that was on defense now takes over on offense from their 25 yard line with a new set of downs; First Down and 10 yards to go.

Touchdown (7 points for offense): A touchdown is scored when positive yards are gained equal to or greater than the distance from line of scrimmage indicator 544 to the opposing end-zone 211 (i.e., opposing goal line 220). For instance, if line of scrimmage indicator 544 is the two yard line of the defense and slider 600 slides and stops on a gain of 14 yards, the team on offense is credited with seven points for scoring a touchdown 827. As a result of touchdown 827, change of possession 847 occurs and the team that was on defense now takes over on offense from their 25 yard line with a new set of Downs; First Down and 10 yards to go.

In some embodiments, it is not possible to possess the "ball" on the "goal line" as in actual American Rules Football. In other words, if line of scrimmage indicator 544 may be at the four yard line of the defense and the result of slider 600 sliding is a four yard gain, this is considered a touchdown 827. It is also worthy to note that a First Down cannot be obtained if the team on offense is awarded a new set of Downs on their opponent's 10 yard line. It shall be considered "first and goal" from the 10 yard line of the defense.

Optional: In some embodiments, if both players agree to include this special method of scoring, the player on offense may have a long scoring play by taking it "To the House 814" if slider 600 slides and comes to rest with some portion of slider 600 over an opposing edge of opposing simulated play region graphics 206 (opposing simulated play region 1206). This method of scoring may occur from anywhere on simulated field graphics 204 (simulated field region 1204) regardless of the location of line of scrimmage indicator 544. Players should consult and agree with each other or a (unbiased) third-party if there is any question on the ruling. Taking it "To the House 814" is treated the same as a regular touchdown 827 for scoring and restart of play.

Determining a Winner

End of Regulation: In some embodiments, the player that accumulates the most points is declared the winner at the expiration of the time on the game clock.

Overtime: If the score is tied after the regulation game time has expired and a winner must be determined, players may engage in a "Sudden Death" overtime period. The game clock is not needed for this extended period of play. The winner of another round of Rock, Paper, Scissors (or coin slip) starts with possession (offense) with line of scrimmage indicator 544 at their 25 yard line. The first player to score points is considered the winner of the given game.

This concludes this embodiment's discussion of rules of gameplay.

Figure 9A:
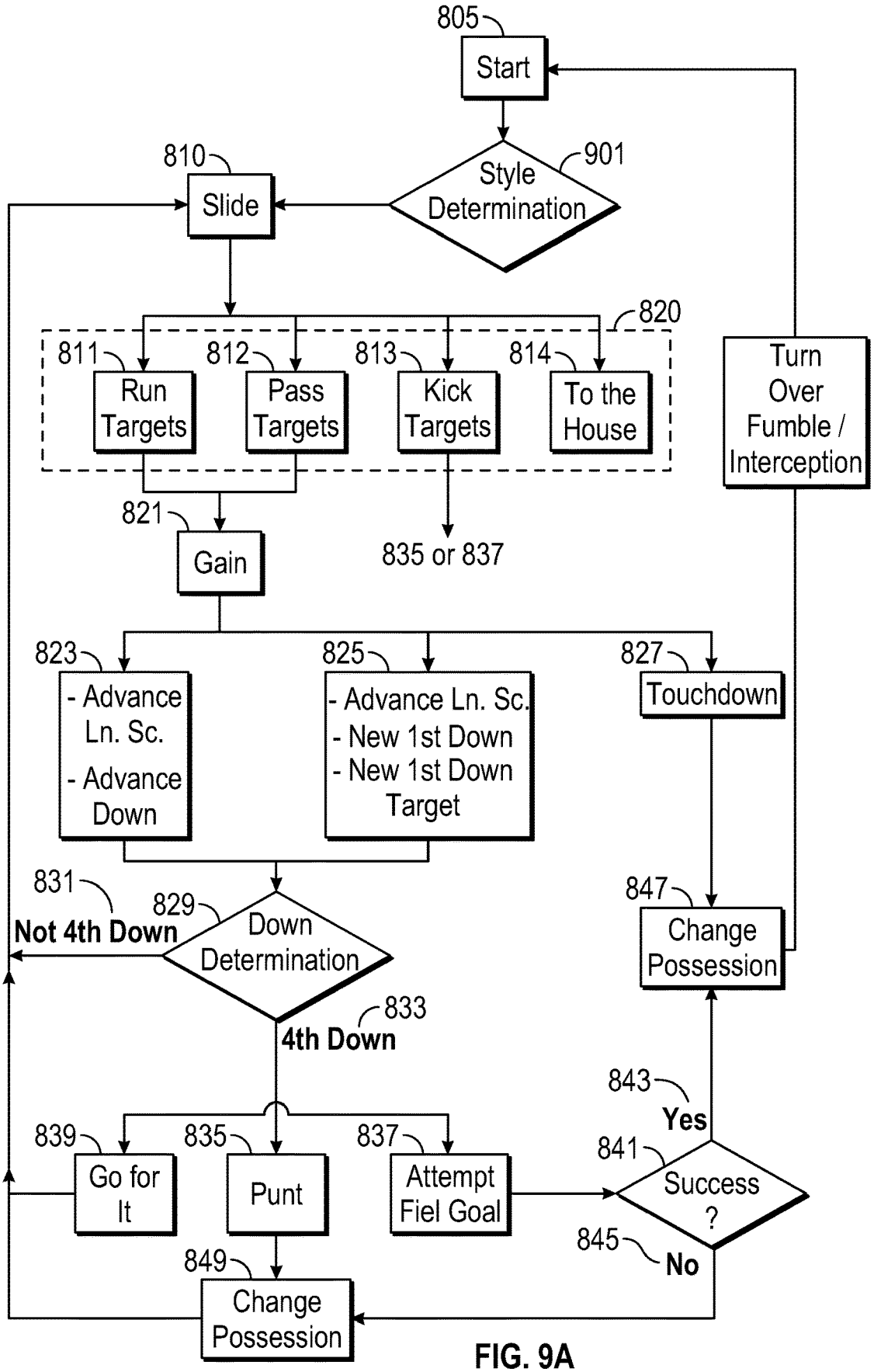
FIG. 9A may depict some possible desired outcomes from an offensive player (team) sliding a given slider, as depicted in a flow diagram.
Figure 9B:
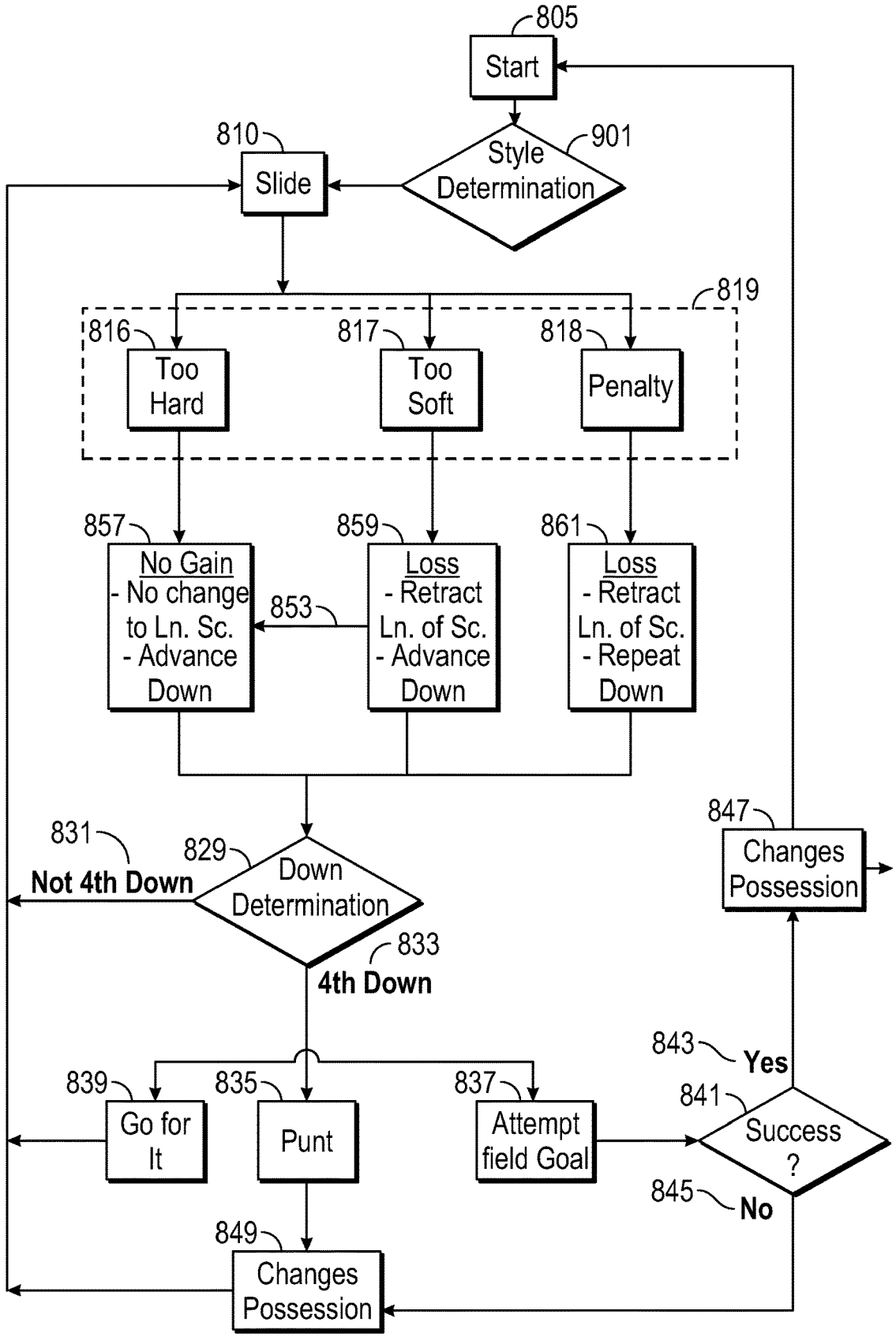
FIG. 9B may depict some possible undesired outcomes from an offensive player (team) sliding a given slider, as depicted in another flow diagram.

FIG. 9A may depict some possible desired outcomes from an offensive player (team) sliding a given slider, as depicted in a flow diagram. FIG. 9B may depict some possible undesired outcomes from an offensive player (team) sliding a given slider, as depicted in another flow diagram.

In some embodiments, FIG. 9A and FIG. 9B may differ from FIG. 8A and from FIG. 8B, respectively, in that in FIG. 9A and in FIG. 9B, prior to step 810 of sliding a slider 600, may be a step 901, of style determination. In FIG. 9A and in FIG. 9B, style determination step 901 may be choice between, "Professional Style" or "Non-Professional Style." If the two players (two teams) select "Professional Style" then the RUN/PASS buttons 143 of controls 141 may be utilized along with simulated defensive players 700. Whereas, if the two players (two teams) select "Non-Professional Style" then the RUN/PASS buttons 143 of controls 141 are not utilized nor are simulated defensive players 700 utilized. In some embodiments, choosing between styles in step 901 may only be done at the onset of a given game before the first slide of slider 600 and the selected style may be utilized for the entirety of that given game.

In some embodiments, if Professional Style is selected, each player will press the RUN or PASS button prior to offensive player sliding slider 600. If the player on offense selects the same RUN/PASS intention as the player on defense, the player on defense will be permitted to place blockers (simulated defensive players 700) on gaming surface 200 in order to make it more difficult for the player on offense to achieve a favorable slide outcome. If the player on offense select a different RUN/PASS intention than the player on defense, then the blockers (simulated defensive players 700) are not utilized for that play.

In some embodiments of gameplay on game 100 and/or on gaming surface 200 the following rules of play may apply:

The Clock

For a new game, the play clock is set to 15 minutes (or a duration of play agreed upon by both players). Players should strive to allow no more than 20 seconds to elapse between each slide of a given slider 600. This may become relevant for players that attempt to "manage the clock" as the game draws closer to its conclusion and should be followed on each player's honor. Players can mutually agree to stop the clock for "timeouts" as they deem appropriate.

Start of Play

The Red (or other predetermined color) team is considered the Home team and starts with possession of the ball (slider 600) to start the game. The line of scrimmage starts at the 25 yard line; first down and 10 yards to go.

The play clock will start with the first slide of slider 600 at the respective opposing run targets 221 or pass targets 231.

The player on offense gains or loses yards (or possibly no gain and no loss outcome in some embodiments) based upon the target that is mainly under the final resting place of slider 600 after a given slide of that player.

A given slider 600 may be removed from gaming surface 200 after each slide and returned to the player that slid.

The line of scrimmage (e.g., 544) will move forward or backward (or stay the same) on gaming surface 200 after the player that just slid a puck presses the button 143 that corresponds with the final resting place of the slider 600 at the conclusion of its slide.

STYLES OF PLAY (also known as levels of play) (Players must agree upon the level/style of play that will apply to their contest/game)

Non-Professional Style: Players do not press the RUN/PASS buttons 143 to indicate whether they intend to run or pass before sliding a slider 600. "Defenders," also known as simulated defensive players 700, also known as blockers are not utilized for this style of play. If a slider 600 is slid short of the run or pass targets, this is considered "STOPPED FOR A LOSS" or "SACKED" and the player that slid the slider 600 will press the either the "−2" button 143 for an attempted run or the "−6" button 143 for an attempted pass where the slider 600 slide comes up short. If the slider 600 is slid off the end of gaming surface 200, this may be considered "NO GAIN" and the corresponding "NO GAIN" button 143 may be engaged by the player on offense.

Professional Style: There may be only one difference under the Professional Style. Before sliding a slider 600, both players will press either the RUN or PASS buttons 143, on their own respective controls 141. If the player on defense is defending the same option to run or pass that the offensive player selected, red lights may flash in front of the target area indicating that the defensive player is permitted to place the "Defenders" (simulated defensive players 700) in front of the corresponding run or pass target area to increase the difficulty of the player on offense successfully achieving a favorable outcome. If the player on defense selects a different RUN/PASS option than the player on offense, green lights will flash in front of the target area indicating that the offensive player is able to slide their puck without "Defenders" (simulated defensive players 700) obstructing the targets.

Object of the Game

The object of the game and gameplay follows that of American Rules Football, advance toward your opponent's end zone and in order score points either by a field goal (3 points) or a touchdown (7 points).

Players are permitted 4 downs to advance 10 yards.

A new set of downs is allotted after a first down (10 yards) is achieved.

On fourth down, a player can choose to either:

(a) to "Go for it"—try to obtain a new set of downs by advancing 10 yards from the original (or current) line of scrimmage indicator 544; or (b) to attempt to "kick" a field goal by declaring your intention to your opponent and then sliding a puck at the field goal targets 241 (field goals can only be attempted when the line of scrimmage is at or closer than the 45 yard line of the opponent); or (c) to punt by declaring your intention and then sliding a puck at the punt target 241. In some embodiments, a worst punt possible is 35 yards regardless of how far outside of the punt target area the puck ends up or even if it slides off the end of the table. It is also noteworthy that a "touchback" is possible. For instance, if the line of scrimmage is at the 50 yard line (too far for a field goal) and the slider 600 comes to rest in the punt target of 55 yards, the player on offense presses the +55 button and the punt is assumed to have gone into the end zone, offense and defense switch, and play resumes in the opposite direction starting from the 20 yard line. A 45 yard punt when the line of scrimmage is at the 45 yard line may also be considered a touchback. There may not be a 0 yard line in some embodiments of gaming surface 200.

Penalties

In some embodiments, it may not be possible for the defense to decline a penalty. In some embodiments, all penalties are followed by a repeat of the down after the penalty yardage is applied. For instance, if it is second down and 8 yards to go for a first down and the slider 600 stops on the "Holding −10" penalty; the line of scrimmage is moved backward 10 yards and second down is repeated, now with 18 yards to go in order to get a first down.

If there ever is an instance where the penalty would cause the line of scrimmage to be backed up beyond the goal line, the penalty is enforced by moving the line of scrimmage "half the distance to the goal." If the line of scrimmage is on the 8 yard line and the puck stops on a "Holding −10" penalty, play resumes with a repeat of the same down from the 4 yard line. When the line of scrimmage is on an odd numbered yard marker and the penalty is greater than the distance to the goal, the offense gets the benefit of "half the distance to the goal." If the line of scrimmage is the 5 yard line and the puck lands on "Holding −10" penalty, the line of scrimmage is moved back to the 3 yard line and the down is repeated.

Scoring

Safety (2 points to defense): A safety cannot occur as the result of a penalty. However, any time the line of scrimmage is close enough to the goal line that the result of the slider 600 sliding is a loss of yards equal to or greater than the yard line associated with the line of scrimmage, the result is a safety. If the player on offense has a line of scrimmage at the 1 or 2 yard line and the result of the slider 600 sliding is a loss of 2 yards, a safety is awarded. Likewise, if the line of scrimmage is at the 6 yard line or closer to the end zone and the puck lands in the "SACKED" area, the result is a loss of 6 yards and a safety is awarded. If a safety occurs, the team on defense gets 2 points and play restarts with the same team that was on offense performing a punt (considered a "free kick") from their own 35 yard line.

Field Goal (3 points): While it is most common to attempt a field goal on fourth down, the team on offense can attempt a field goal on any down as long as their line of scrimmage is at the 45 yard line or closer. Add the simulated "10 yards" (the width of the end zone) to calculate the distance of the field goal attempt from the line of scrimmage. A field goal attempt when the line of scrimmage is at the 30 yard line is considered a 40 yard field goal attempt, and so on. A field goal is considered "good" if the puck slides and stops in the area 241 that corresponds to the distance attempted or greater. If a 35 yard field is attempted, the field goal is good if the puck stops in any of the field goal circles 241 in the target area 241. However, if a 52 yard field goal is attempted, it is only considered "good" if the puck stops in the inner-most circle 241.

If a field goal attempt is "missed" then the player on offense presses the "MISSED FG" button 143 and possession changes. The team that was on defense now takes over on offense from the location of the line of scrimmage where the field goal was attempted. If the field goal is "good" the kicking team presses the "FG" button and is credited with 3 points. Possession changes and the team that was on defense now takes over on offense from their 25 yard line with a new set of downs; first down and 10 yards to go.

Touchdown (7 points): A touchdown is scored when positive yards are gained equal to or greater than the distance from the line of scrimmage to the end zone 211. For instance, if the line of scrimmage is at the 2 yard line and a slider 600 slides and stops on a gain of 14 yards, the team on offense is credited with 7 points for scoring a touchdown. As a result of the score, possession changes and the team that was on defense now takes over on offense from their 25 yard line with a new set of downs; first down and 10 yards to go.

It is not possible to possess the ball on the goal line. In other words, if the line of scrimmage is at the 4 yard line and the result of a puck slide is a 4 yard gain, this is considered a touchdown. It is also worthy to note that a first down cannot be obtained if the team on offense is awarded a new set of downs on their opponent's 10 yard line. This is considered "first and goal" from the 10 yard line.

Optional: If both players agree to include this special method of scoring, the player on offense can have a long scoring play by taking it "To the House" if a slider 600 slides and comes to rest with some portion of the puck over the edge of gaming surface 200, about to fall into catch basin 117, but without falling into catch basin 117. This method of scoring can occur from anywhere on the field regardless of the location of the line of scrimmage. Players should consult and agree with each other or an unbiased third-party if there is any question on the ruling of where the slider 600 comes to rest to qualify as touchdown or not. If a player is determined to have taken it "To the House" the player on offense will press the "TD" button 143 and is awarded 7 points. Taking it "To the House" is treated the same as a regular touchdown for scoring and restart of play.

Determining a Winner

Point Total: Players can set a point total objective such as 17 points as a determination for winner. The first player to reach or surpass the objective is considered the winner regardless of how much time remains on the clock.

End of Regulation: The player that accumulates the most points is declared the winner at the expiration of the time on the game clock.

Overtime: If the score is tied after time has expired and a winner must be determined, players may engage in a "Sudden Death" overtime period. The game clock is not needed for this extended period of play. Flip a coin or engage in a round of Rock, Paper, Scissors to determine which player gets to slide the first slider 600 (i.e., who is on offense first). Then, players alternate sliding slider 600 and the player that takes it "To the House" first is declared the sudden death winner.

This concludes this embodiment's discussion of rules of gameplay.

Figure 10A:
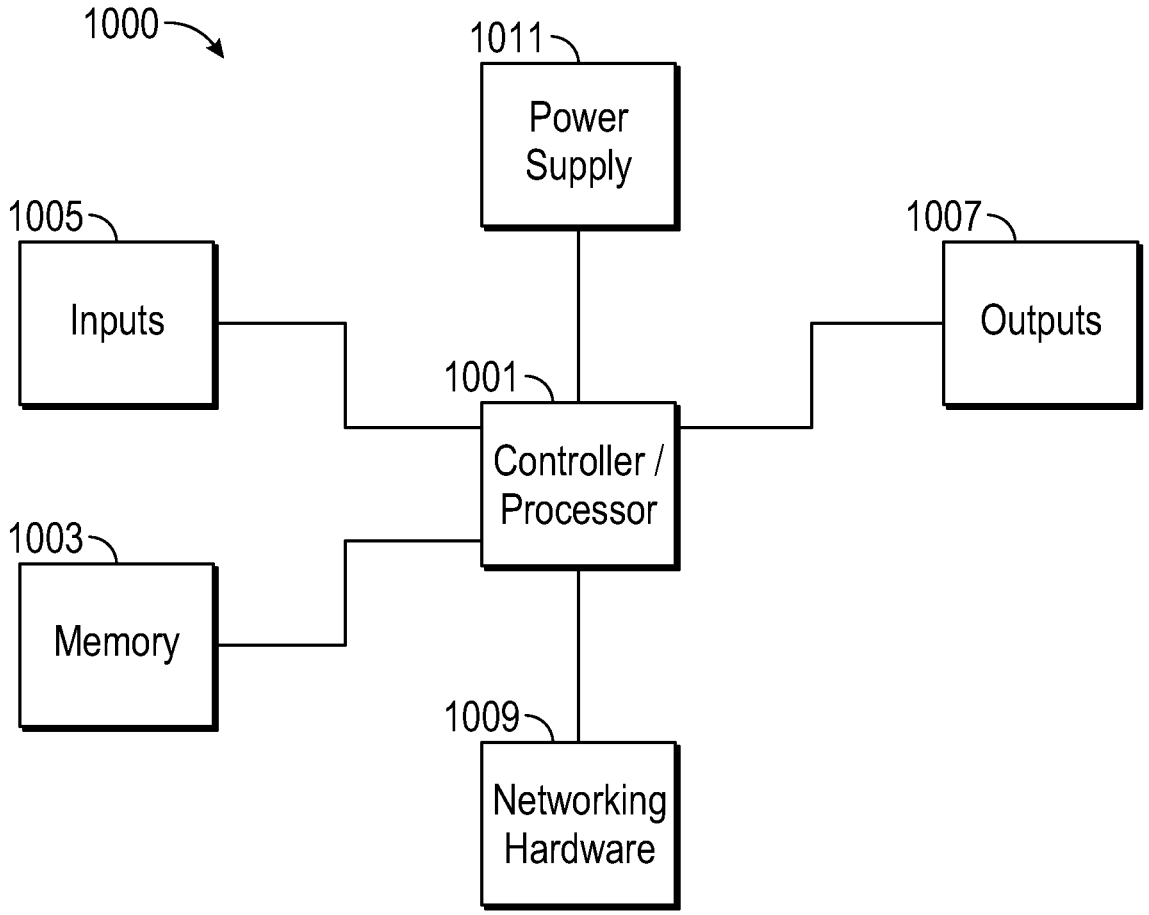
FIG. 10A may depict a block diagram showing some main hardware element for supporting electronic functions of a game.

FIG. 10A may depict a block diagram showing some main hardware element for supporting electronic functions of a game 100. FIG. 10A may depict a block diagram of a generic computer 1000 (which may be a printed circuit board PCB in some embodiments) wherein software (e.g., program, code, scripts, etc.) implementing embodiments of game rules may run on.

In FIG. 10A, Processor 1001 may be one or more processors, including one or more central processors and/or one or more processors for graphics. In some embodiments, Processor 1001 may be in communication with Memory 1003. In some embodiments, Processor 1001 may be in communication with Input/Output Means such as Inputs 1005 and/or Outputs 1007. In some embodiments, Input/Output Means may comprise Inputs 1005 and/or Outputs 1007.

In some embodiments, Inputs 1005 may be selected from one or more of: inputs from controls 141 (e.g., from button(s) 143 engagement); touchscreens; motion detector(s) 1227; hardwired data ports (e.g., a USB port or the like); incoming communications received via Networking Hardware 1009; keyboards; stylus; mouse; trackballs; touchpads; buttons; levers; slides; switches; dials; microphones; and/or the like.

In some embodiments, Outputs 1007 may be selected from one or more of: information displayed on display 128; score display 529; present down 530; yards to go for a first down 531; line of scrimmage indicator 544 (ball on certain yard); current possession 532; time outs remaining 533; game clock; backlighting region 1245; screens; display screens; displays; monitors; touchscreens; readouts; speakers; buzzers; bells; whistles; lights (LEDs); alarms; scanners; printers; outgoing information transmitted via the hardwired port (e.g., a USB port or the like); outgoing information transmitted via Networking Hardware 1009, and/or the like.

Continuing discussing FIG. 10A, in some embodiments, Processor 1001 may execute a computer program known as an operating system (e.g., a Microsoft Windows operating system, a Linux operation system, an Apple and/or Macintosh operating system, a mobile computing device operating system, any other suitable operating system, and/or combinations thereof) which may control the execution of other computer programs (e.g., application programs); and may provide for scheduling, input/output and other device control, accounting, compilation, storage assignment, data management, memory management, communication; and/or dataflow control. Collectively, Processor 1001 and the operating system may define a computer platform for which the application programs and other computer program languages may be written in. In some embodiments, Processor 1001 may also execute one or more computer programs to implement various functions and/or method of the present invention, such as game rules and/or saving and/or transmitting gameplay statistics. These computer programs may be written in any type of computer program language, including, but not limited to, a procedural programming language, object-oriented programming language, macro language, and/or combinations thereof.

These computer programs may be stored in Memory 1003. Memory 1003 may store (hold) information on a volatile or non-volatile medium, and may be fixed and/or removable. Memory 1003 may include a tangible computer readable and computer writable non-volatile recording medium, on which signals are stored that define a computer program or information to be used by the computer program. The recording medium may, for example, be disk memory, flash memory, and/or any other article(s) of manufacture usable to record and store information (in a non-transitory fashion). In some embodiments, in operation, Processor 1001 may cause(s) data (such as, but not limited to, gameplay statistics data) to be read from the nonvolatile recording medium into a volatile memory (e.g., a random access memory, or RAM) that may allow for more efficient (i.e., faster) access to the information by the Processor 1001 as compared against the nonvolatile recording medium. Such memory may be located in the Memory 1003 and/or in Processor 1001. See e.g., FIG. 10A. The Processor 1001 may manipulate(s) the data within integrated circuit memory and may then copy the data to the nonvolatile recording medium after processing may be completed. A variety of mechanisms are known for managing data movement between the nonvolatile recording medium and the integrated circuit memory element, and the invention is not limited to any mechanism, whether now known or later developed. The invention is also not limited to a particular processing unit or storage unit.

Note, each and every method and/or step discussed herein and as depicted in the figures may be implemented as non-transitory computer-readable medium including codes executable by a processor, such as Processor 1001. That is, such non-transitory computer-readable medium may be the one or more Memory 1003 storage units. That is, such a processor may be Processor 1001; or alternatively, Processor 1001 may comprise such a processor.

New and/or updated game rules may be saved non-transitorily onto Memory 1003 via Inputs 1005. Various audio files (e.g., announcer commentary of play outcomes) may be saved non-transitorily onto Memory 1003 for directed playback via speakers (of outputs 1007).

In some embodiments, Processor 1001 may also be in communication with Networking Hardware 1009. Networking Hardware 1009 may permit communication between computer 1000 and computers (e.g., servers) that are not part of computer 1000, nor under the control of computer 1000. In some embodiments, Networking Hardware 1009 may comprise one or more radios to facilitate wireless communications, such as WiFi, cellular, and/or the like. In some embodiments, Networking Hardware 1009 may be in wired and/or wireless communications with the Internet, WAN (wide area network), LAN (local area network), external servers, player's smartphones, and/or the like. In some embodiments, Networking Hardware 1009 may permit gameplay statistics to be communicated to databases in remote servers, wherein players via their own computer devices (e.g., their own smartphones) may access such gameplay statistics.

Figure 10B:
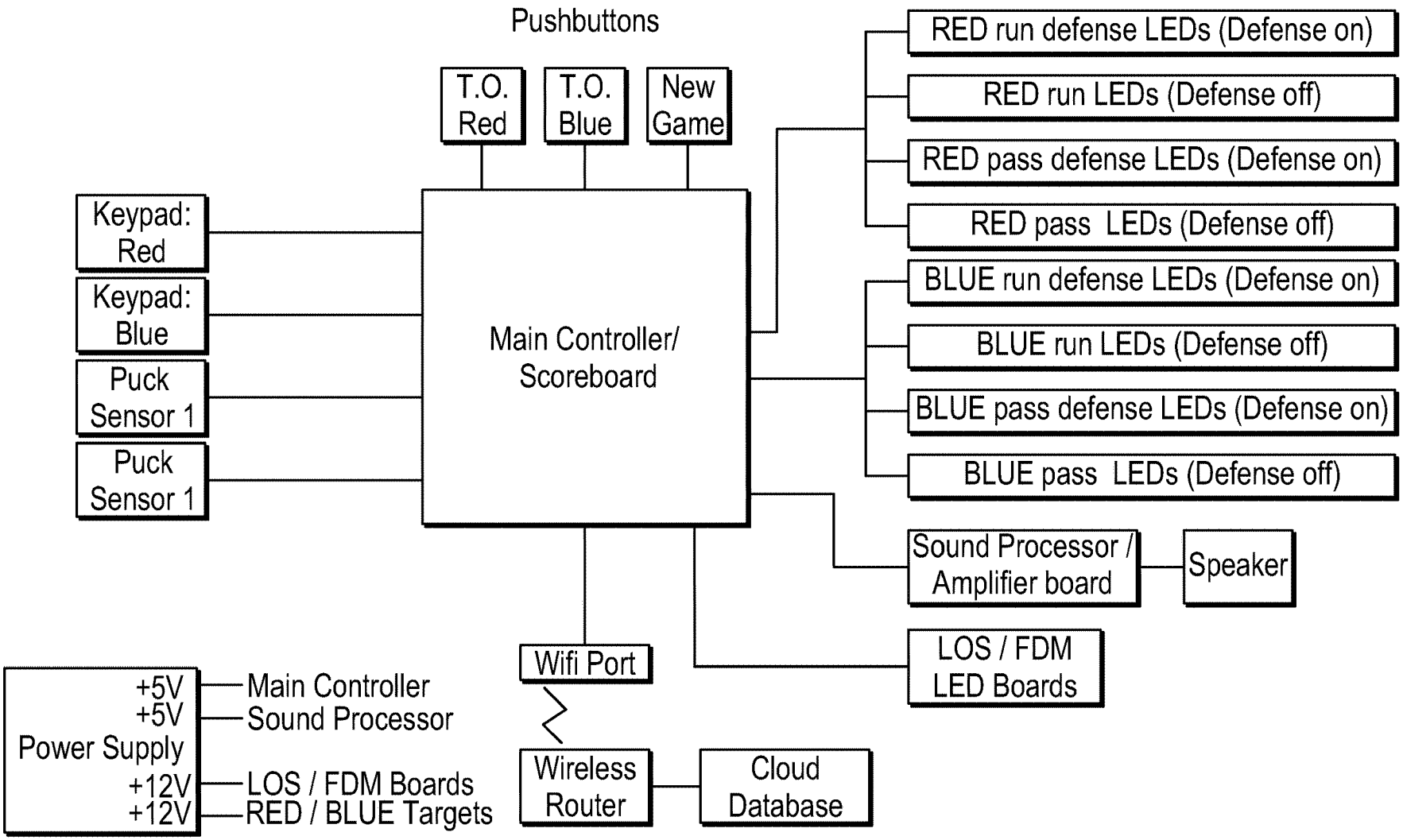
FIG. 10B may depict an expansion of FIG. 10A, showing additional details.

FIG. 10B may depict an expansion of FIG. 10A, showing additional details.

Figure 11:
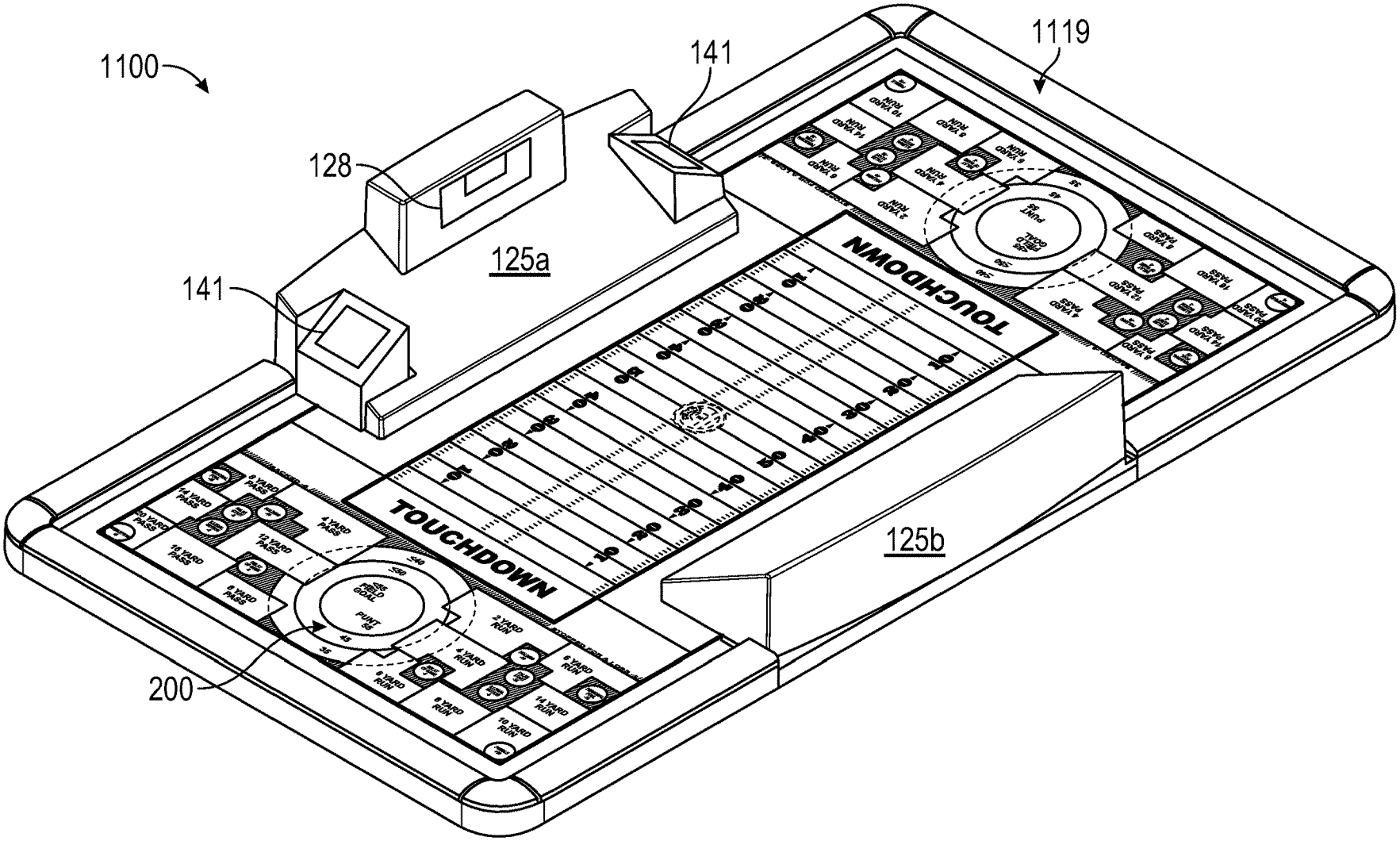
FIG. 11 may depict an embodiment of an overall game, from a perspective view; wherein the game may be simulating American football gameplay.

FIG. 11 may depict an embodiment of an overall game 1100, from a perspective view; wherein the game 1100 may be simulating American football gameplay. In some embodiments, game 1100 may comprise a gaming surface 200. In some embodiments of game 1100, gaming surface may be bound at its end by bumper border 1119; which may minimize sliders 600 from leaving gaming surface 200 during sliding gameplay.

In some embodiments, game 1100 may comprise at least one simulated spectator stand 125. In some embodiments of game 1100, there may be two controls 141, one for each player. In some embodiments, controls 141 may be opposing and/or located on a given simulated spectator stand 125. See e.g., FIG. 11.

In some embodiments, game 1100 may differ from game 100, by game 1100 being smaller than game 100. For example, and without limiting the scope of the present invention, in some embodiments game 1100 may have length by width dimensions, as viewed from above, of approximately four feet by two feet, plus or minus two inches. In some embodiments, game 1100 may still comprise a gaming surface 200. In some embodiments, gaming surface 200 of game 1100 may have length by width dimensions, as viewed from above, of approximately four feet by two feet, plus or minus two inches. In such embodiments, game 1100 may be known as a miniature version of game 100 and/or known as a home version of game 100. In some embodiments, gaming surface 200 of game 1100 may be about 50% smaller than gaming surface 200 of game 100; wherein "about" may be plus or minus 10%.

In some embodiments, game 1100 may differ from game 100, by game 1100 not including supportive structure 119, such as no included cabinet nor base 120. Instead, in some embodiments, gaming surface 200 of game 1100 may be substantially supported by a substantially rigid or semi-rigid planar member beneath gaming surface 200.

Figure 12A:
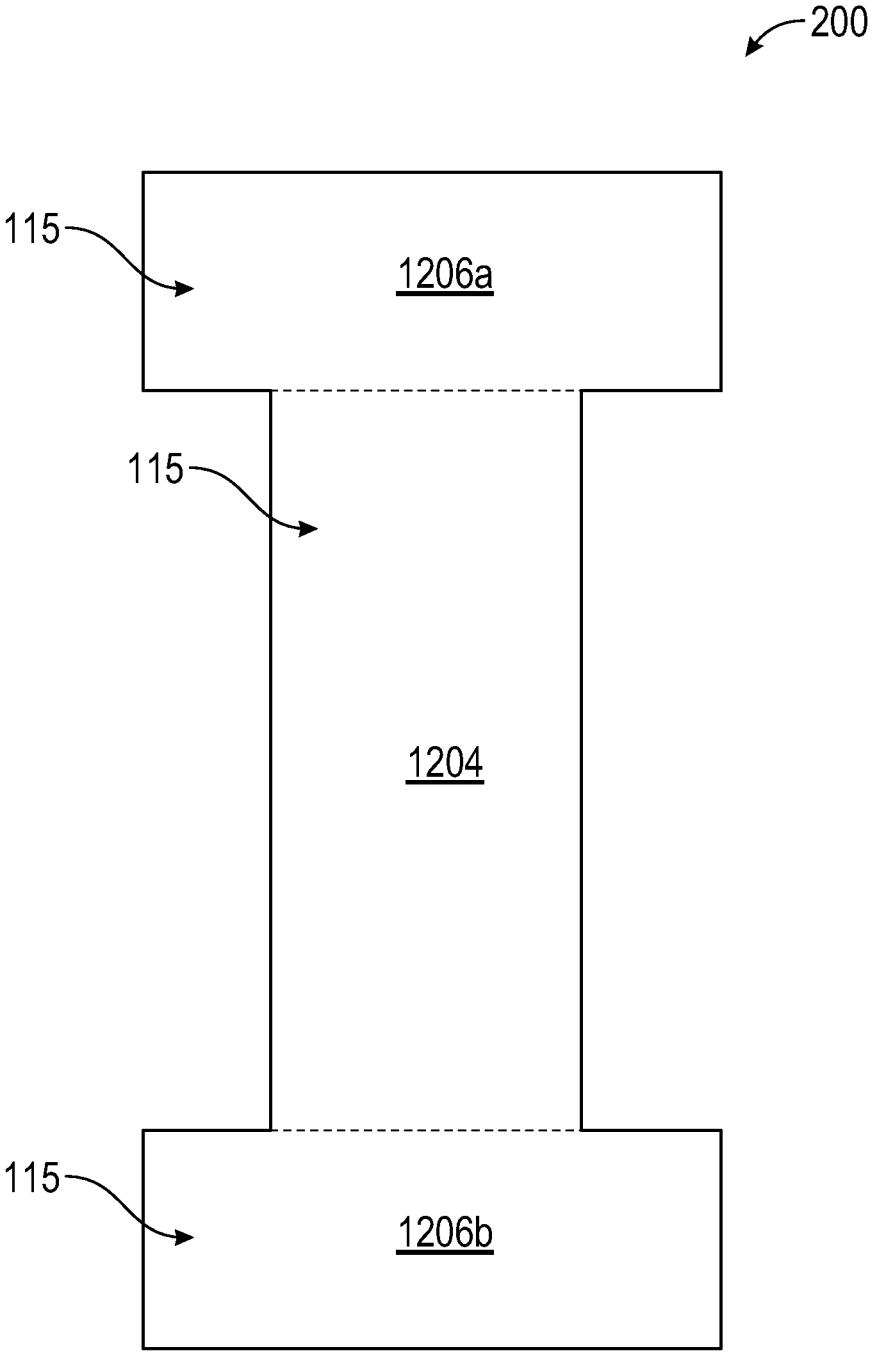
FIG. 12A may depict an overall shape of a gaming surface, as viewed from above or a top view.

FIG. 12A may depict an overall shape of a gaming surface 200 (gaming field 200), as viewed from above or a top view. In some embodiments, this overall shape of gaming surface 200, from this view, may approximate a capital letter "I" in terms of overall visual appearance. In some embodiments, gaming surface 200 may comprise simulated field region 1204 and two opposing simulated play regions 1206. In FIG. 12A, suffix "a" and "b" to reference numeral "1206" are merely to designate one such opposing simulated play region 1206*a* from the other opposing simulated play region 1206*b*. Note, discussion of "simulated play region 1206" without explicit reference to the suffix "a" and/or without explicit reference to the suffix "b," may mean the discussion may apply to either or both of simulated play region 1206*a* and/or simulated play region 1206*b*. In some embodiments, simulated field region 1204 may be substantially rectangular in shape. In some embodiments, simulated field region 1204 may comprise graphical details (simulated field graphics 204) that mimic an American football field, e.g., as shown in FIG. 2A, FIG. 2B, FIG. 2C, and FIG. 2D.

In some embodiments, gaming surface 200 may be shaped substantially as a capital block letter "I" comprising: a first region (e.g., simulated field region 1204), that may be rectangular; wherein this first region resembles the stem portion of the capital block letter "I"; and two opposing regions (e.g., simulated play regions 1206), that each may be rectangular, but each smaller in size than the first region (e.g., simulated field region 1204); wherein these two opposing regions (e.g., simulated play regions 1206) resemble the two opposing arms (serifs) of the capital block letter "I" such that the first region (e.g., simulated field region 1204) may be capped (bound) by these two opposing regions (e.g., simulated play regions 1206). See e.g., FIG. 12A or FIG. 1C.

Continuing discussing FIG. 12A, in some embodiments, simulated play region 1206*a* and simulated play region 1206*b* may each be substantially rectangular in shape. In some embodiments, simulated play region 1206*a* and simulated play region 1206*b* may each be substantially similar in shape and in size. In some embodiments, size and shape of simulated play region 1206*a* and simulated play region 1206*b* may be different from size and shape of simulated field region 1204.

Continuing discussing FIG. 12A, in some embodiments, a simulated field length 1203 of simulated field region 1204 may be bound by simulated play region 1206*a* at one end and may be bound by simulated play region 1206*b* at an other end. See FIG. 12B for simulated field length 1203.

Continuing discussing FIG. 12A, in some embodiments, simulated field region 1204, simulated play region 1206*a*, and simulated play region 1206*b* may form one continuous and integral gaming surface 200. In some embodiments, simulated field region 1204, simulated play region 1206*a*, and simulated play region 1206*b* may be a single article of manufacture. In some embodiments, simulated field region 1204, simulated play region 1206*a*, and simulated play region 1206*b* may be a group of one or more sheets that may be substantially flat, planar, and/or transparent. In some embodiments, simulated field region 1204, simulated play region 1206*a*, and simulated play region 1206*b* may share a common playing surface, top surface 115. In some embodiments, gaming surface 200 may comprise top surface 115. In some embodiments, top surface 115 may an upper most exterior surface of simulated field region 1204, simulated play region 1206*a*, and simulated play region 1206*b*. In some embodiments, top surface 115 may be continuous on the upper portions of the simulated field region 1204 and of the two opposing simulated play regions 1206, such that top surface 115 across the upper portions of the simulated field region 1204 and of the two opposing simulated play regions 1206 exists in a single continuous plane.

Continuing discussing FIG. 12A, in some embodiments, top surface 115 may be a substantially smooth surface. In some embodiments, top surface 115 may be a substantially flat surface. In some embodiments, top surface 115 may be a substantially planar surface. In some embodiments, top surface 115 may be a substantially transparent surface. In some embodiments, top surface 115 may be treated (e.g., coated) to be scratch resistant, crack resistant, and/or shatter resistant. In some embodiments, top surface 115 may be substantially constructed from glass (tempered and/or coated) and/or a thermoplastic, like acrylic (plexiglass) or polycarbonate, or the like.

Figure 12B:
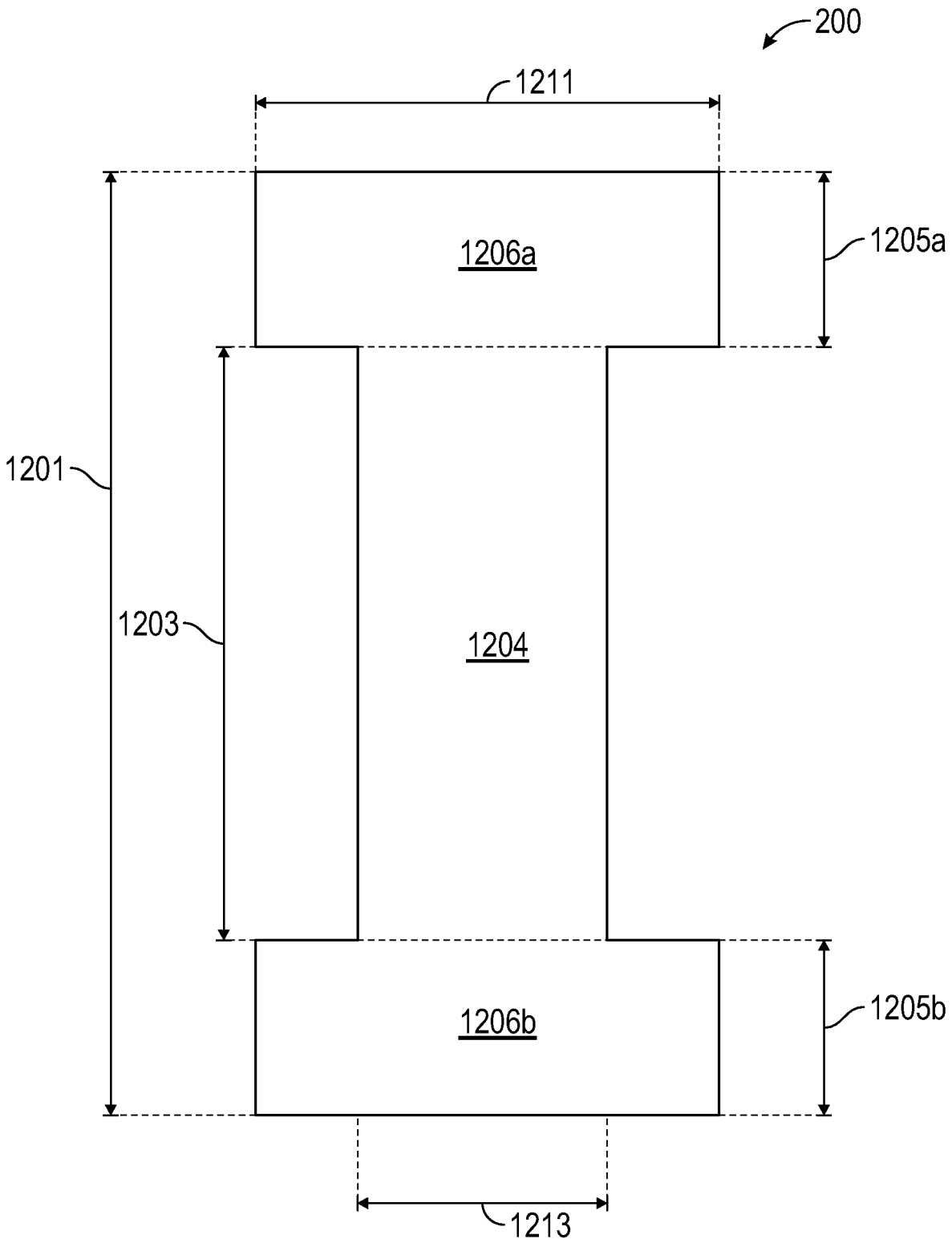
FIG. 12B may depict various lengths and transverse widths of the gaming surface of FIG. 12A, from a top view.

FIG. 12B may depict various lengths and transverse widths of gaming surface 200, from a top view. In some embodiments, gaming surface 200 may comprise an overall length 1201 and an overall transverse width 1211. In some embodiments, overall length overall length 1201 may be substantially perpendicular to overall transverse width 1211. In some embodiments, simulated field region 1204 may comprise simulated field length 1203 and field region transverse width 1213. In some embodiments, simulated field length 1203 may be substantially perpendicular to field region transverse width 1213. In some embodiments, simulated field length 1203 may be less than overall length 1201. In some embodiments, field region transverse width 1213 may be less than overall transverse width 1211. In some embodiments, simulated field length 1203 and overall length 1201 may be substantially parallel. In some embodiments, field region transverse width 1213 and overall transverse width 1211 may be substantially parallel.

Continuing discussing FIG. 12B, in some embodiments, simulated play region 1206*a* may comprise play region length 1205*a* and overall transverse width 1211. In some embodiments, simulated play region 1206*b* may comprise play region length 1205*b* and overall transverse width 1211. Note, discussion of "play region length 1205" without explicit reference to the suffix "a" and/or without explicit reference to the suffix "b," may mean the discussion may apply to either or both of play region length 1205*a* and/or play region length 1205*b*. In some embodiments, play region length 1205*a* may be substantially perpendicular to overall transverse width 1211. In some embodiments, play region length 1205*b* may be substantially perpendicular to overall transverse width 1211. In some embodiments play region length 1205*a* and play region length 1205*b* may be substantially a same length. In some embodiments, play region length 1205*a* may be less than overall length 1201. In some embodiments, play region length 1205*b* may be less than overall length 1201. In some embodiments, play region length 1205*a* may be less than simulated field length 1203. In some embodiments, play region length 1205*b* may be less than simulated field length 1203. In some embodiments, play region length 1205*a* may be substantially parallel with overall length 1201. In some embodiments, play region length 1205*b* may be substantially parallel with overall length 1201. In some embodiments, play region length 1205*a* may be substantially parallel with simulated field length 1203. In some embodiments, play region length 1205*b* may be substantially parallel with simulated field length 1203.

Continuing discussing FIG. 12B, in some embodiments, a ratio of overall length 1201 to overall transverse width 1211 may be from 2.32 to 1.72. In some embodiments, a ratio of overall transverse width 1211 to field region transverse width 1213 may be from 1.90 to 1.35. In some embodiments, a ratio of overall length 1201 to simulated field length 1203 may be from 1.86 to 1.37.

Continuing discussing FIG. 12B, in some embodiments, overall length 1201 may be 96 inches plus or minus 8 inches. In some embodiments, simulated field length 1203 may be 60 inches plus or minus 4 inches. In some embodiments, simulated field length 1205*a* and/or simulated field length 1205*b* may be 18 inches plus or minus 2 inches. In some embodiments, overall transverse width 1211 may be 48 inches plus or minus 3 inches. In some embodiments, field region transverse width 1213 may be 30 inches plus or minus 3 inches. Such dimension ranges may be intended for full size version of the game.

Continuing discussing FIG. 12B, in some embodiments, overall length 1201 may be 48 inches plus or minus 4 inches. In some embodiments, simulated field length 1203 may be 30 inches plus or minus 2 inches. In some embodiments, simulated field length 1205*a* and/or simulated field length 1205*b* may be 9 inches plus or minus 1 inch. In some embodiments, overall transverse width 1211 may be 24 inches plus or minus 2 inches. In some embodiments, field region transverse width 1213 may be 15 inches plus or minus 2 inches. Such dimension ranges may be intended for a home version of the game. Such dimension ranges may be intended for a home version of gaming surface 200.

Figure 12C:
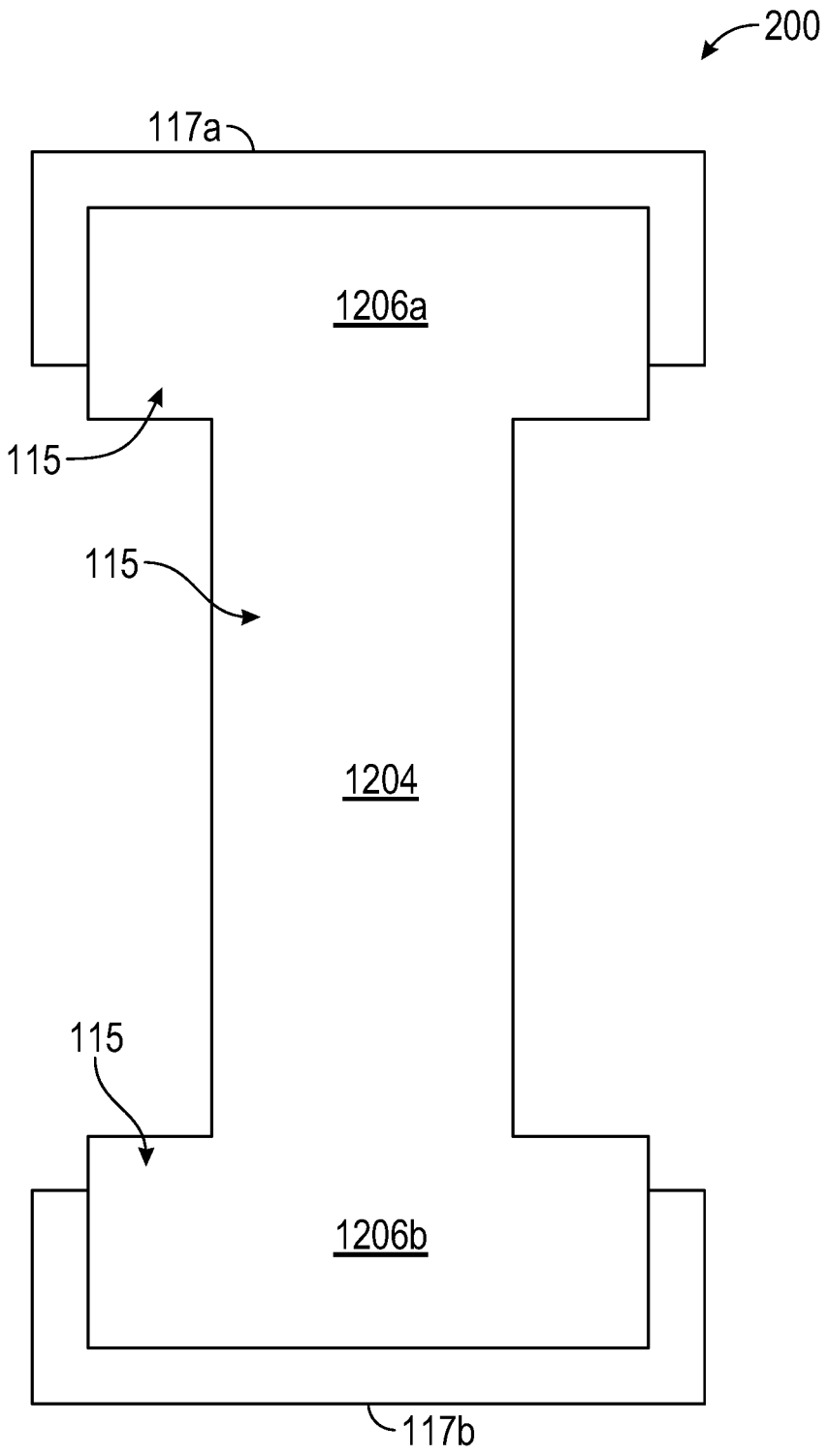
FIG. 12C may depict catch basins of a gaming surface, from a top view.

FIG. 12C may depict catch basins 117, from a top view. In some embodiments, gaming surface 200 may comprise one or more catch basins 117. In some embodiments, game 100 may comprise one or more catch basins 117. Specifically shown in FIG. 12C, may be two opposing catch basins 117, with one catch basin 117 located at each opposing end of gaming surface 200. In FIG. 12C, suffix "a" and "b" to reference numeral "117" are merely to designate one such opposing catch basin 117*a* from the other opposing catch basin 117*b*. Note, discussion of "catch basin 117" without explicit reference to the suffix "a" and/or without explicit reference to the suffix "b," may mean the discussion may apply to either or both of catch basin 117*a* and/or catch basin 117*b*. In some embodiments, catch basin 117 may be sized, shaped, and/or configured to removably receive one or more sliders 600. In some embodiments, catch basin 117 may be used to catch sliding sliders 600 and prevents such sliders 600 from falling onto a ground or onto a floor. Thus, catch basin 117 may operate as a trough or a moat. In some embodiments, catch basin 117 may also be used to removably store one or more sliders 600. See FIG. 6A for slider 600. In some embodiments, catch basin 117 may be substantially constructed from rigid to semi-rigid materials of constructions.

Figure 12D:
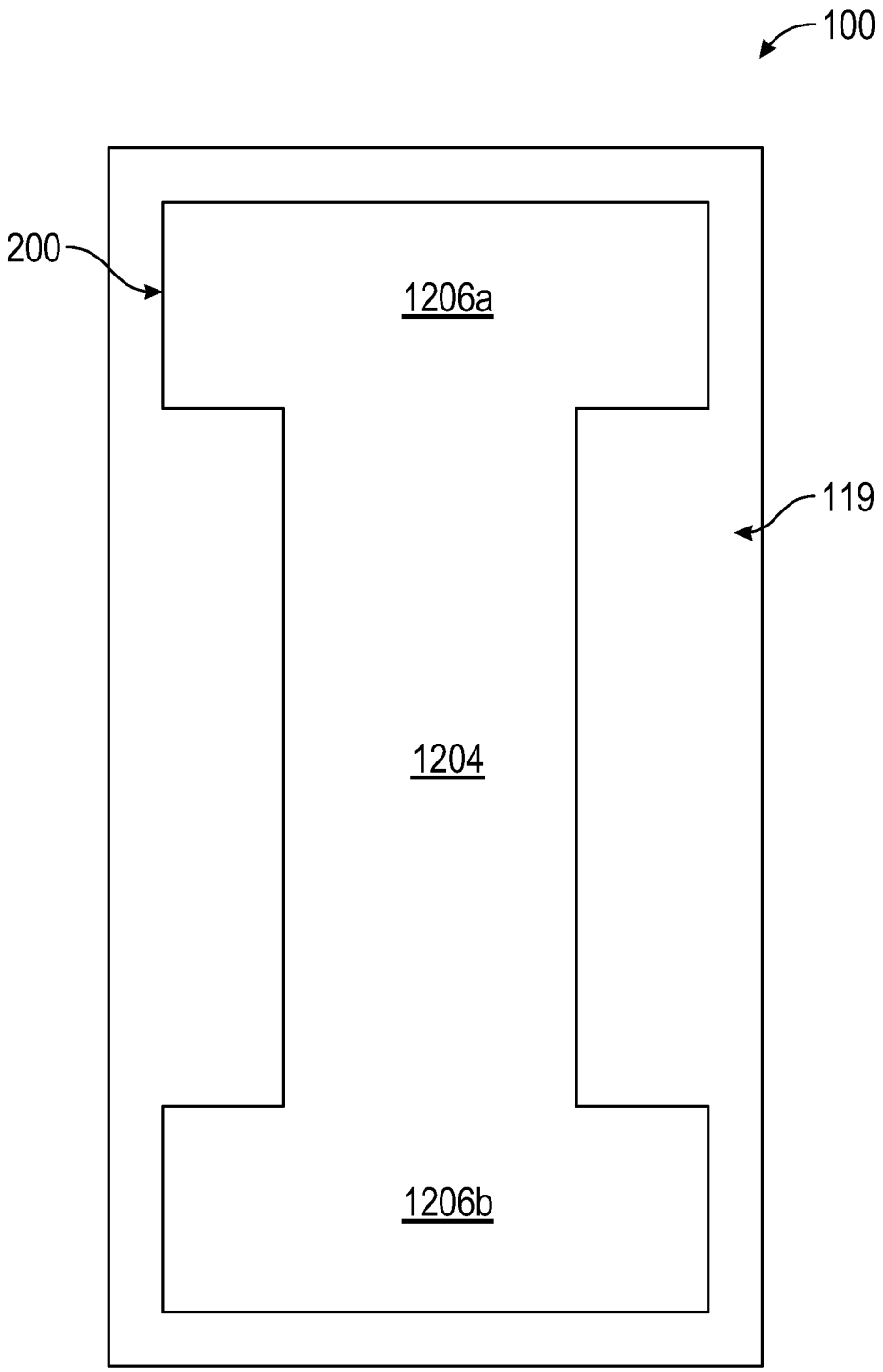
FIG. 12D may depict a supportive structure top, from a top view, that may be used to support at least some portion of a given gaming surface.

FIG. 12D may depict a supportive structure 119, from a top view. In some embodiments, game 100 may comprise supportive structure 119. In some embodiments, portions of supportive structure 119 may be disposed beneath simulated field region 1204. In some embodiments, portions of supportive structure 119 may be disposed beneath portions of simulated play region 1206*a* and beneath portions of simulated play region 1206*b*. In some embodiments, portions of supportive structure 119 may provide structural support for one or more of: gaming surface 200, simulated field region 1204, simulated play region 1206*a*, and/or simulated play region 1206*b*. In some embodiments, supportive table top 119 may be substantially rigid. In some embodiments, supportive structure 119 may be substantially constructed from one or more structural members. In some embodiments, supportive structure 119 may be: a table, a bench, a desk, a workbench, a pedestal, a stand, cabinet, chest, chest of drawers, or the like.

In some embodiments, supportive structure 119 may be: a preexisting table, a preexisting bench, a preexisting desk, a preexisting workbench, a preexisting pedestal, a preexisting stand, preexisting cabinet, preexisting chest, preexisting chest of drawers, or the like. In such embodiments, supportive structure 119 may not be a component of game 100.

Figure 12E:
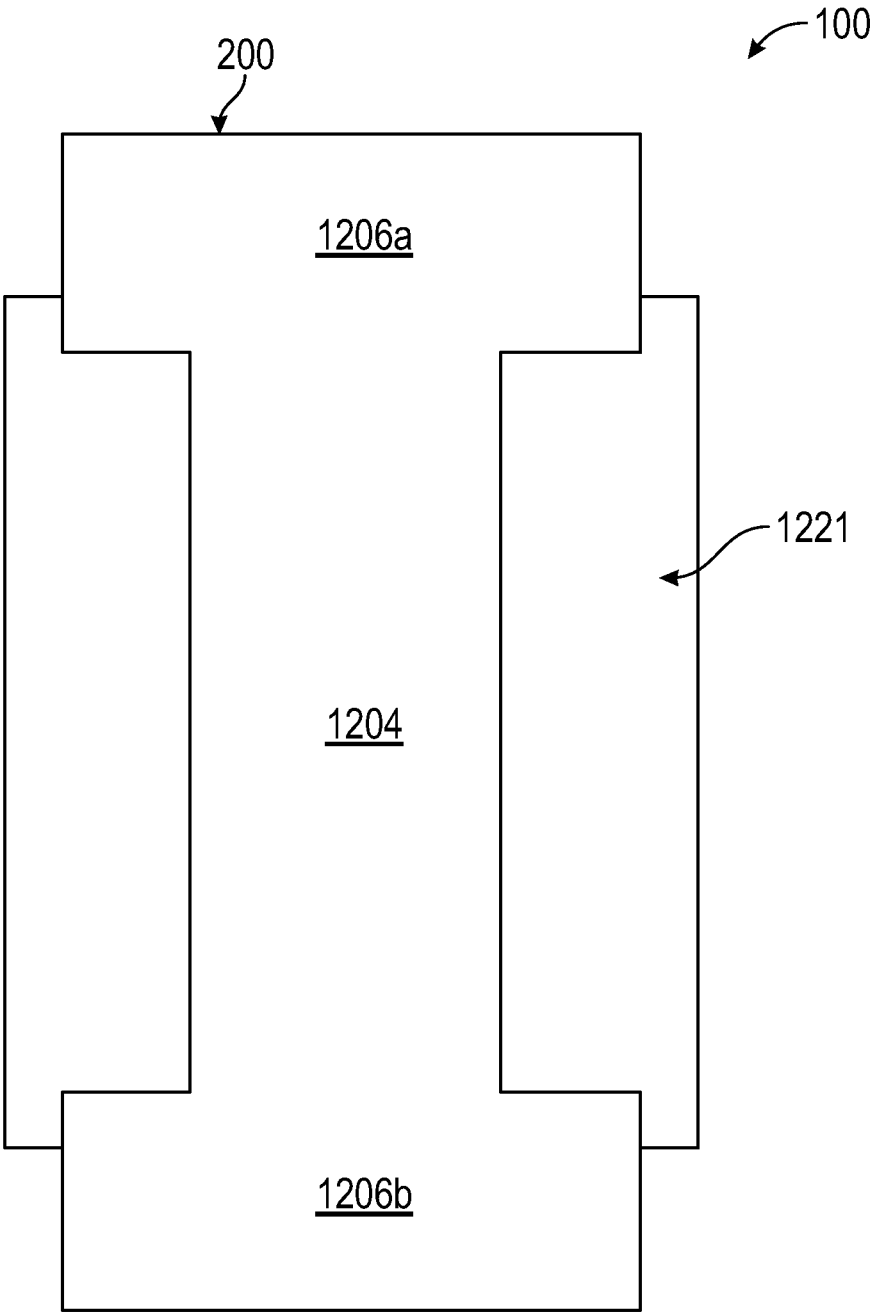
FIG. 12E may depict a shorter supportive structure top, from a top view, that may be used to support at least some portion of a given gaming surface.

FIG. 12E may depict a shorter supportive structure 1221, from a top view. In some embodiments, game 100 may comprise shorter supportive structure 1221. In some embodiments, a length of shorter supportive structure 1221 may be less than overall length 1201. In some embodiments, portions of shorter supportive structure 1221 may be disposed beneath simulated field region 1204. In some embodiments, portions of shorter supportive structure 1221 may be disposed beneath portions of simulated play region 1206*a* and beneath portions of simulated play region 1206*b*. In some embodiments, portions of shorter supportive structure 1221 may provide structural support for one or more of: gaming surface 200, simulated field region 1204, simulated play region 1206*a*, and/or simulated play region 1206*b*. In some embodiments, shorter supportive structure 1221 may be substantially rigid. In some embodiments, shorter supportive structure 1221 may be substantially constructed from one or more structural members. In some embodiments, shorter supportive structure 1221 may be a table top of the following: a table, a bench, a desk, a workbench, a pedestal, a stand, a cabinet, a chest, a chest of drawers, or the like.

In some embodiments, shorter supportive structure 1221 may be a table top of the following: a preexisting table, a preexisting bench, a preexisting desk, a preexisting workbench, a preexisting pedestal, a preexisting stand, a preexisting cabinet, a preexisting chest, a preexisting chest of drawers, or the like. In such embodiments, shorter supportive structure 1221 may not be a component of game 100.

Figure 12F:
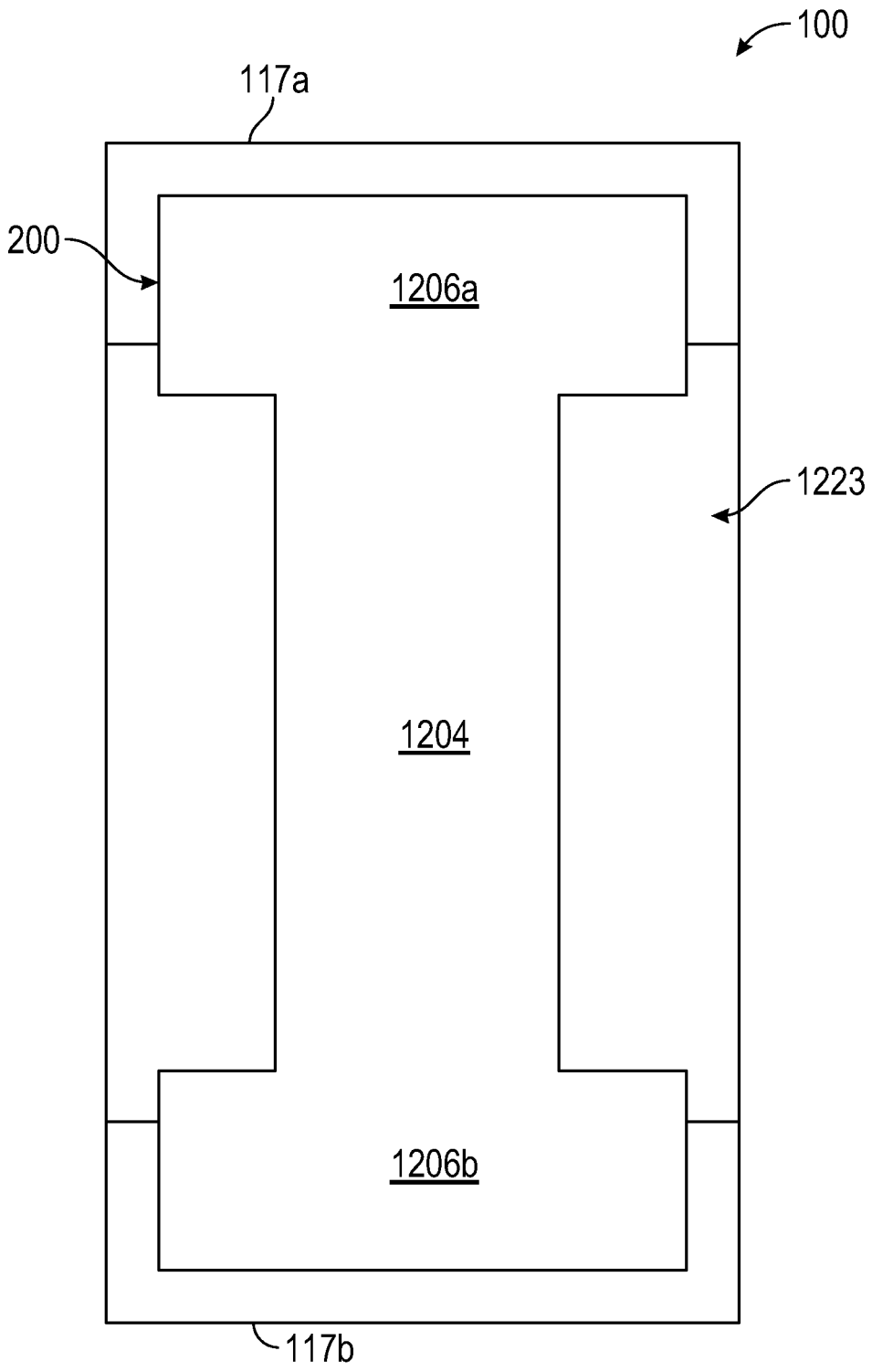
FIG. 12F may depict another supportive structure top, from a top view.

FIG. 12F may depict a supportive structure 1223, from a top view. FIG. 12F may differ from FIG. 12D and from FIG. 12E, in that in FIG. 12F, catch basins 117 may be shown. In some embodiments, supportive structure 1223 may be sized, shaped, and/or configured to be used in connection with catch basins 117. In some embodiments, catch basins 117 may be components of supportive structure 1223; wherein each catch basin 117 may be oppositely disposed at separate ends of supportive structure 1223. Alternatively, in some embodiments, catch basins 117 may be components of respective simulated play regions 1206.

In some embodiments, catch basin 117 may extend substantially around an outside perimeter of simulated play region 1206*a*, simulated field region 1204, and simulated play region 1206*b*; not including where those three distinct regions may be in communication with each other. This embodiment may not be shown in FIG. 12F nor shown in FIG. 12C.

Continuing discussing FIG. 12F, in some embodiments, game 100 may comprise supportive structure 1223. In some embodiments, portions of supportive structure 1223 may be disposed beneath simulated field region 1204. In some embodiments, portions of supportive structure 1223 may be disposed beneath portions of simulated play region 1206*a* and beneath portions of simulated play region 1206*b*. In some embodiments, portions of supportive structure 1223 may provide structural support for one or more of: gaming surface 200, simulated field region 1204, simulated play region 1206*a*, and/or simulated play region 1206*b*. In some embodiments, supportive structure 1223 may be substantially rigid. In some embodiments, supportive structure 1223 may be substantially constructed from one or more structural members. In some embodiments, supportive structure 1223 may be a table top of the following: a table, a bench, a desk, a workbench, a pedestal, a stand, a cabinet, a chest, a chest of drawers, or the like.

In some embodiments, supportive structure 1223 may be: a preexisting table, a preexisting bench, a preexisting desk, a preexisting workbench, a preexisting pedestal, a preexisting stand, a preexisting cabinet, a preexisting chest, a preexisting chest of drawers, or the like. In such embodiments, supportive structure 1223 may not be a component of game 100.

In some embodiments, supportive structure 119, shorter supportive structure 1221, and/or supportive structure 1223, may be components of game 100. In such embodiments, these supportive structures (e.g., 119, 1221, and/or 1223) may comprise one or more: lighting, LEDs (light emitting diodes), wiring, sensors, radios (for wireless communications and/or for positional determination of sliders 600 fitted with RFIDs), speakers, electronics, circuits, and/or the like. Such electrical components may be disposed beneath gaming surface 200, simulated play region 1206*a*, simulated field region 1204, and/or simulated play region 1206*b*.

Figure 12G:
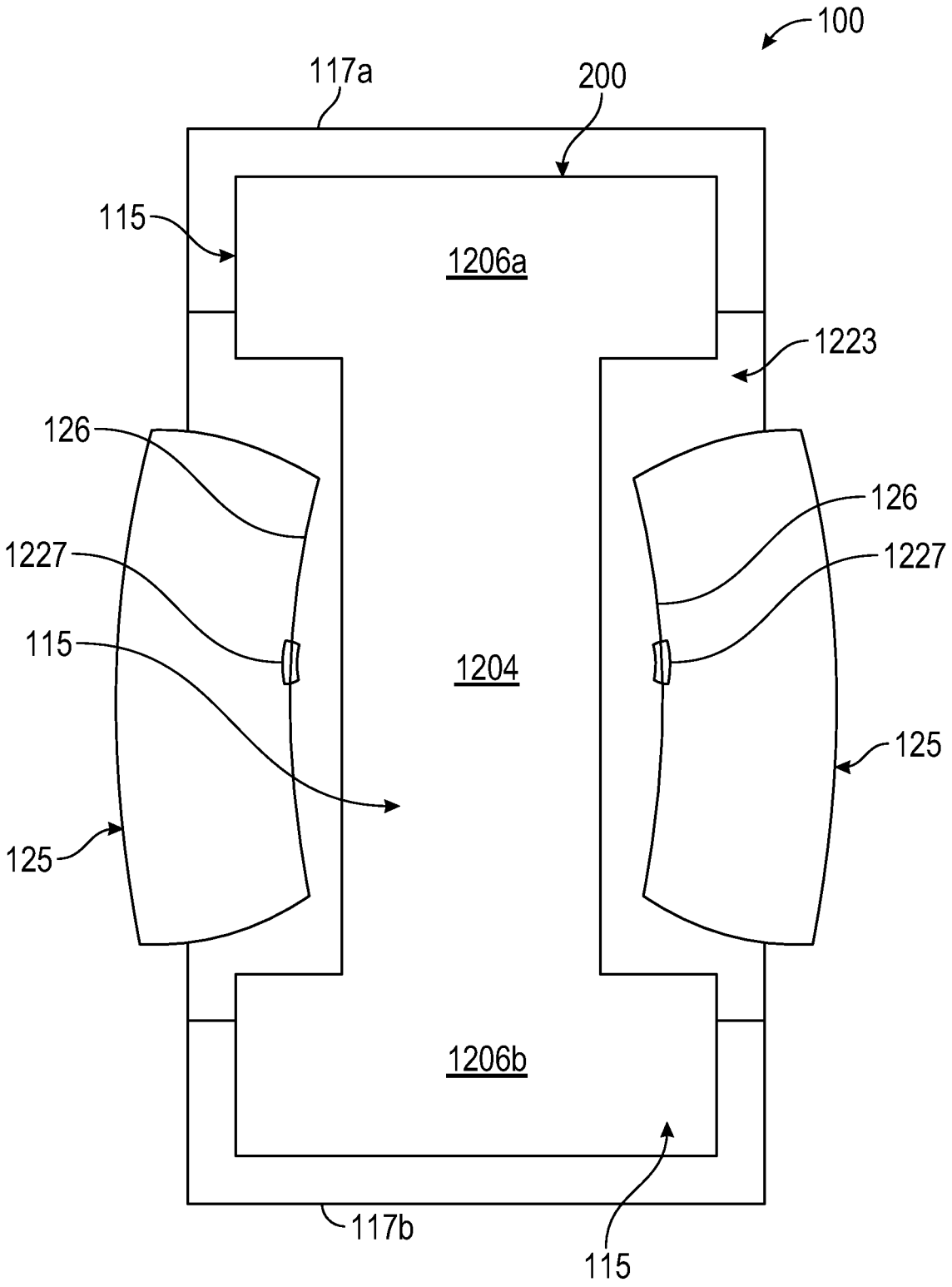
FIG. 12G may depict opposing simulated spectator stands (e.g., bleachers or stadium seating), from a top view.

FIG. 12G may depict opposing simulated spectator stands 125, from a top view. In some embodiments, gaming surface 200 may comprise at least one simulated spectator stand 125. In some embodiments, game 100 may comprise at least one simulated spectator stand 125. As shown in FIG. 12G, two opposing simulated spectator stands 125 may be shown. In some embodiments, simulated spectator stand 125 may simulate fan (patron) bleachers (seating) of a football stadium. In some embodiments, simulated spectator stand 125 may extend substantially vertically at a predetermined height above supportive structure 1223. In some embodiments, simulated spectator stand 125 may extend substantially vertically at a predetermined height above top surface 115. In some embodiments, simulated spectator stand 125 may be attachable to supportive structure 1223. In some embodiments, simulated spectator stand 125 may be removable from supportive structure 1223. In some embodiments, a majority of exterior surfaces of simulated spectator stand 125 may be substantially rigid to semi-rigid. In some embodiments, a majority of exterior surfaces of simulated spectator stand 125 may be colored, painted, decaled, and/or decorated in a manner to reflect colors, names, logos, fans (spectators), and/or mascots of a football team.

Continuing discussing FIG. 12G, in some embodiments, game 100 may comprise two opposing simulated spectator stands 125. In some embodiments, each such simulated spectator stand 125 may be disposed one to a side (e.g., left and right) of simulated field region 1204.

In some embodiments, simulated spectator stand 125 may comprise electronic components, such as, but not limited to lighting, LEDs, wiring, speakers, motion detectors, displays (e.g., for displaying time remaining, scores, down, possession, and the like), circuits, and/or the like.

Continuing discussing FIG. 12G, in some embodiments, simulated spectator stand 125 may comprise ricochet wall 126. In some embodiments, ricochet wall 126 may a side of simulated spectator stand 125 that may be closest to simulated field region 1204. In some embodiments, ricochet wall 126 may be on a side of simulated spectator stand 125 that may face simulated field region 1204. In some embodiments, ricochet wall 126 may be curved (as shown in FIG. 12G) or linearly straight and substantially parallel with simulated field length 1203. In some embodiments, ricochet wall 126 may be substantially rigid. In some embodiments, it may be intended for sliders 600 to hit and/or strike against ricochet wall 126. In some embodiments, ricochet wall 126 may be substantially semi-rigid.

Continuing discussing FIG. 12G, in some embodiments, ricochet wall 126 may comprise one or more motion detectors 1227. In some embodiments, motion detectors 1227 may be for detecting sliding movement of sliders 600 sliding down simulated field region 1204. In some embodiments, motion detectors 1227 may be electrically coupled with one or more speakers, which may be located in or on simulated spectator stand 125; such that when motion detectors 1227 may be triggered, these one or more speakers may emit noise that simulates excited and cheering stadium fans. In some embodiments, motion detectors 1227 may be one or more optical sensors, laser emitters with reflective receivers (e.g., IR lasers with reflective receivers), radio antennas to interrogate RFIDs in or on sliders 600, and/or the like. In some embodiments, each simulated spectator stand 125 may comprise a plurality of motion detectors 1227. In some embodiments, motion detectors 1227 may be located around interior perimeters of supportive structure 119, at or proximate to catch basins 117, and/or beneath gaming surface 200. In some embodiments, wherein motion detectors 1227 may be laser emitters and reflected receivers, there may be at least three such motion detectors 1227 proximate (and in optical view) to each of the two opposing simulated play region graphics 206, such that these lasers via triangulation algorithms may determine resting locations of sliders 600; wherein such determined resting locations of sliders 600 may then correspond to various outcomes (e.g., yards gained, yards lost, successful run, successful pass, unsuccessful run, unsuccessful pass, penalty, turnover, and/or the like).

Figure 12H:
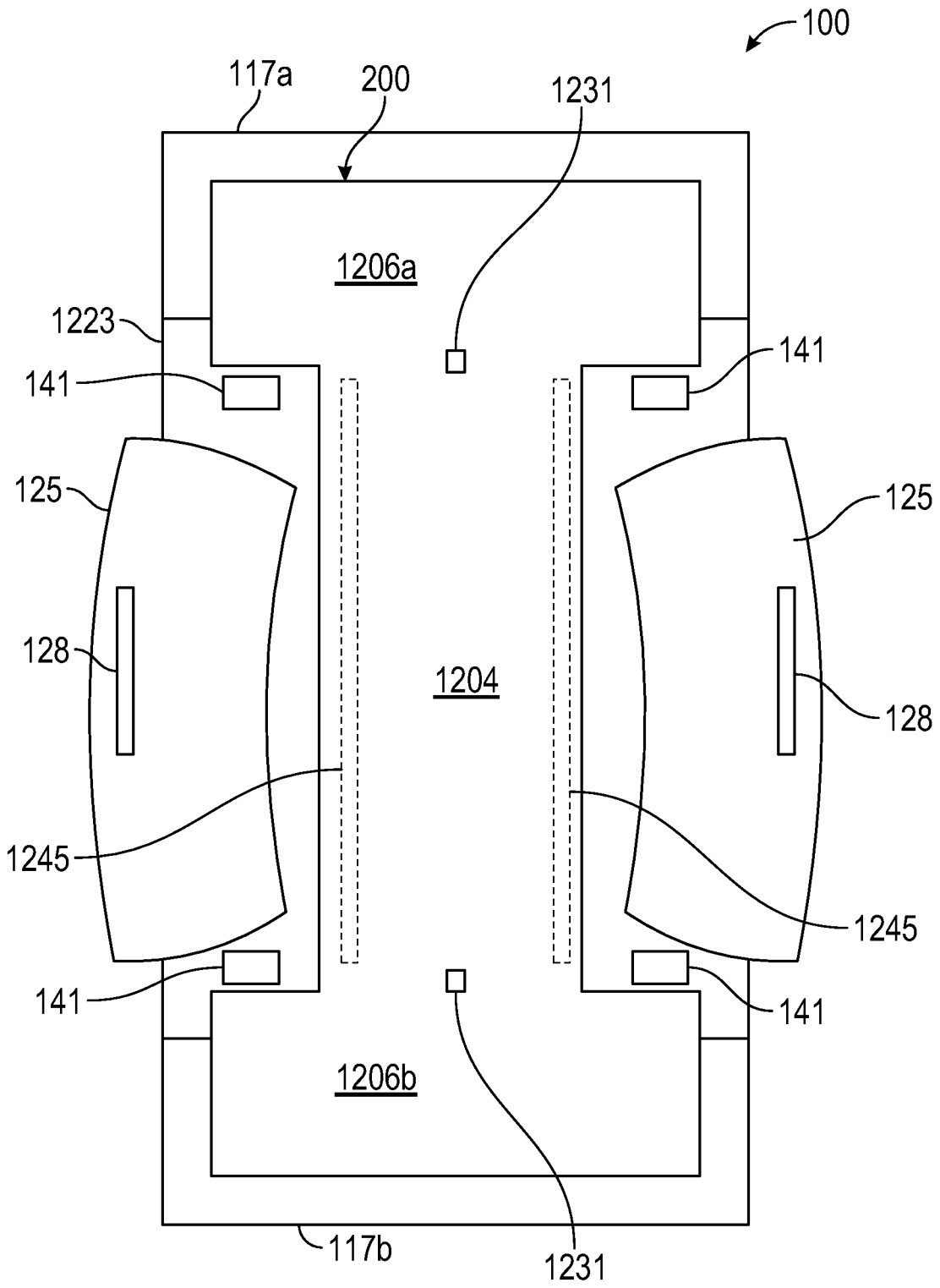
FIG. 12H may depict other features of a gaming surface, from a top view, such as, but limited to, a display, a goal post receiver, a control, and/or a backlighting region.

FIG. 12H may depict other features of gaming surface 200 and/or of game 100, from a top view. In some embodiments, game 100 may comprise one or more of: display 128, goal post receiver 1231, controls 141, and/or backlighting region 1245.

Continuing discussing FIG. 12H, in some embodiments, display 128 may be located on simulated spectator stand 125. In some embodiments which may comprise two opposing simulated spectator stands 125, only one such simulated spectator stand 125 may comprise a display 128. In some embodiments, display 128 may be an electronic display. In some embodiments, display 128 may display one or more of: time remaining (i.e., a countdown clock for overall game time), scores of the teams, current down, and/or possession. In some embodiments, display 128 may display one or more details of: score display 529; present down 530; yards to go for a first down 531; line of scrimmage indicator 544 (ball on certain yard); current possession 532; time outs remaining 533; game clock; and/or the like.

Continuing discussing FIG. 12H, in some embodiments, goal post receiver 1231 may be a through hole through top surface 115. In some embodiments, goal post receiver 1231 may be located where a given simulated play region 1206 abuts simulated field region 1204. In some embodiments, goal post receiver 1231 may be a receiving hole. In some embodiments, this receiving hole may be sized and shaped to removably receive a portion of a goal post 105. See e.g., FIG. 1A for goal post 105 (also known as decorative field goal post 105). In some embodiments, this receiving hole 1231 may be threaded or slotted to removably receive a portion of goal post 105. In some embodiments, there may be two opposing goal post receivers 1231 per a given gaming surface 200. See e.g., FIG. 12H.

Continuing discussing FIG. 12H, in some embodiments, control 141 may comprise one or more buttons 143, switches, slides, dials, knobs, and/or the like, which may be electrically coupled with display 128, lighting, LEDs, speakers, and/or the like. For example, and without limiting the scope of the present invention, control 141 may be one or more toggle switches, touchscreens, levers, dials, slides, and the like for receiving player inputs. In some embodiments, control 141 may be used to advance (or retract) a simulated line of scrimmage indicator (e.g., 544 in some embodiments) to show yardage gains for the team in possession or to show lost yardage. The simulated line of scrimmage indicator may be indicated by one or more lights, LEDs, LED lighting strips, and the like located beneath simulated field region 1204, such as backlighting region 1245. In some embodiments, control 141 may be used to advance (or retract) a simulated first down marker (e.g., 531), that may indicate a minimum number of yards to obtain to obtain a first down. The simulated first down marker may be indicated by one or more lights, LEDs, LED lighting strips, and the like located beneath simulated field region 1204, such as backlighting region 1245.

Continuing discussing FIG. 12H, in some embodiments, backlighting region 1245 may show where regions of LED light strips may be positioned beneath simulated field region 1204. Such LED light strips may be used to show current location of a line of scrimmage and/or may show the simulated first down marker needed to obtain a new first down. In some embodiments, backlighting region 1245 may comprise LED lighting strips of at least two different colors, with one color indicating current line of scrimmage location and another and different color to indicate the first down marker (target).

Figure 13:
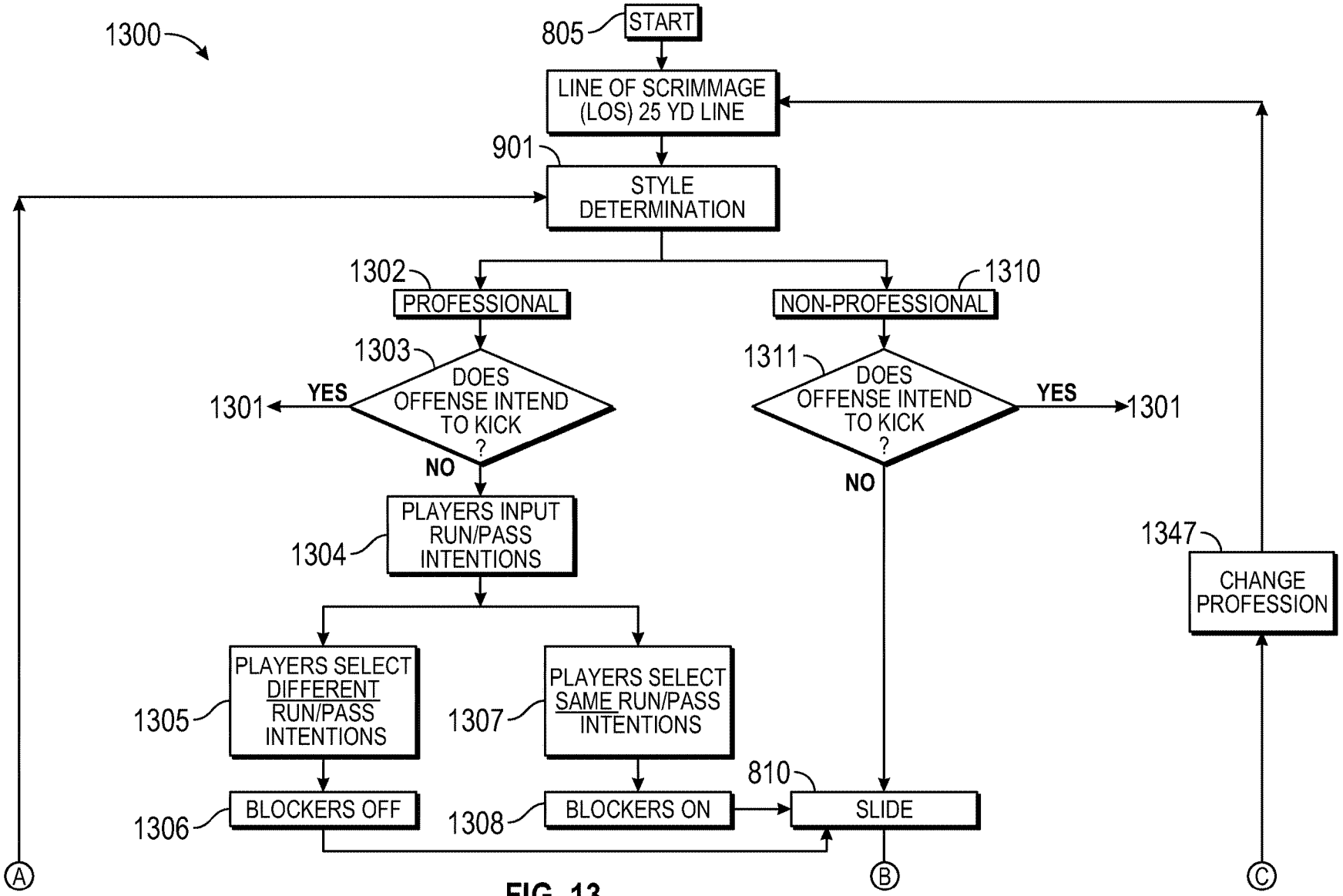
FIG. 13 may depict a flow diagram showing an embodiment of game play on a gaming surface.
Figure 13:
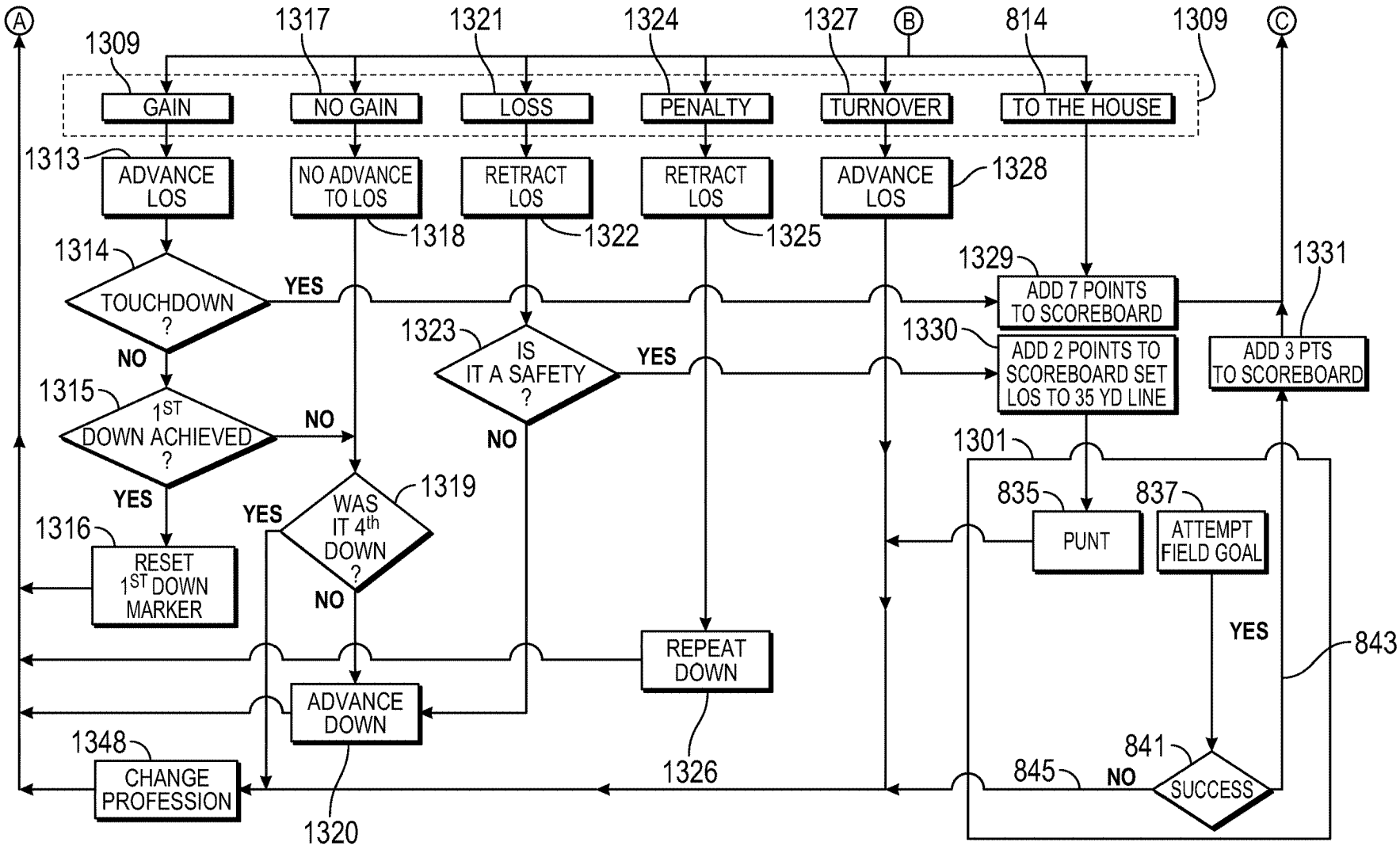

FIG. 13 may depict a flow diagram showing an embodiment of game play on a gaming surface 200 and/or on game 100 and/or on game 1100. In FIG. 13 "LOS" may refer to the "line of scrimmage." In some embodiments, FIG. 13 may depict method of play 1300. In some embodiments, method 1300 may begin with step 805, of offensive possession start conditions 805. For example, and without limiting the scope of the present invention, offensive possession start conditions 805 may mean starting the line of scrimmage (LOS) at the simulated 25 yard line.

Continuing discussing FIG. 13, in some embodiments, step 805 may progress to step 901, wherein step 901 may be characterized as style determination 901; wherein the two opposing teams (opposing players) may select from Professional Style 1302 or Non-Professional Style 1310. Under Non-Professional Style 1310 game play, blockers (e.g., simulated defensive players 700) are not utilized; whereas under Professional Style 1302 game play, blockers (e.g., simulated defensive players 700) may be utilized.

Continuing discussing FIG. 13, in some embodiments, if Professional Style 1302 has been selected, then step 1303 may be triggered, wherein step 1303 may be characterized as a step where the current offensive player (team) intends to simulate a kick (e.g., punt 835 or attempt a field goal 837) or not. If yes (kick attempt), then step 1303 progresses into step 1301. If no (no kick attempt), then step 1303 progresses into step 1304.

Continuing discussing FIG. 13, in some embodiments, under step 1301, the current player on offensive either punts 835 or attempts a field goal 837. Punt 835 will progress to change of possession 1348; wherein change of possession 1348 may then progresses back to style determination 901. Punt 835 outcome may be determined by where slider 600 comes to a rest, as formerly discussed (e.g., in relation to kick targets 241). Attempt a field goal 837 may progress to step 841, of field goal success determination 841. Field goal success determination 841 may be determined by where slider 600 comes to a rest, as formerly discussed (e.g., in relation to kick targets 241). If the attempted field goal was successful, i.e., step 843, then the method may progress to step 1331; wherein step 1331 may be a step of receiving three (3) added points to the team (player) that scored the field goal. And then step 1331 may progress to change of possession 1347; wherein change of possession 1347 may then progress back to start step 805. Whereas, if the field goal attempt was bad, i.e., step 845, then step 845 may progress into change of possession 1348.

Continuing discussing FIG. 13, in some embodiments, if the current offensive player (team) is not intending to kick, then step 1304 may progress to step 1304. In some embodiments, step 1304 may be a step of method 1300 receiving the two opposing players' RUN/PASS selection. Recall, in some embodiments, RUN or PASS selections may be entered by the given opposing player (team) on buttons 143 of each respective controls 141 (see FIG. 4). In some embodiments, step 1304 may progress to either step 1305 or to step 1307. If each opposing team (player) selected different RUN/PASS options, then step 1305 is the outcome of step 1304. Whereas, if each opposing team (player) selected the same RUN or the same PASS selection, then step 1307 is the outcome of step 1304. If step 1305 is the outcome of step 1304, then blockers (e.g., simulated defensive players 700) are not utilized for the coming play (slide); wherein this is indicated by step 1306 in method 1300. Whereas, if step 1307 was the outcome of step 1304, then blockers (e.g., simulated defensive players 700) are utilized for the coming play (slide); wherein this is indicated by step 1308. In step 1308, the current defensive team (player) may place the blockers (e.g., simulated defensive players 700) onto top surface 115 to try and obstruct desirable offensive outcomes (see e.g., FIG. 7G). In some embodiments, step 1306 may then progress into sliding step 810. In some embodiments, step 1308 may then progress into sliding step 810.

Continuing discussing FIG. 13, in some embodiments, if Non-Professional Style 1310 has been selected, then step 1311 may be triggered, wherein step 1311 may be characterized as a step where the current offensive player (team) intends to simulate a kick (e.g., punt 835 or attempt a field goal 837) or not. If yes (kick attempt), then step 1311 progresses into step 1301 (as discussed above). If no (no kick attempt), then step 1311 progresses into sliding step 810.

Continuing discussing FIG. 13, in some embodiments, sliding step 810 may result in Slide Outcomes 1309. In some embodiments, Slide Outcome 1309 may comprise: Gain 1312, No Gain 1317, Loss 1321, Penalty 1324, Turnover 1327, or To the House 814 (which is a touchdown result). These possible outcomes of Slide Outcomes 1309 may be determined by the resting location of the given slider 600 after a given slide (step 810) in relation to various targets (regions) of gaming surface 200 (e.g., run targets 221, pass targets 231, no gain regions 251, penalty regions 261, turnover regions 271, and the like).

Continuing discussing FIG. 13, in some embodiments, in some embodiments Gain 1312 may result if the given slider 600 came to rest mostly over run targets 221 or pass targets 231. If Gain 1312 was a slide outcome, then step 1312 progresses to step 1313, of advancing the line of scrimmage (LOS). How much the LOS is advanced depends upon the nature of the given Gain 1312 outcome as noted by the given run targets 221 or pass targets 231; and/or where the LOS was located prior to the successful offensive play. Recall, in some embodiments, LOS may be shown on gaming surface 200 and/or on display 128, by line of scrimmage indicator 544. In some embodiments, step 1313 may then progress to step 1314, of inquiring whether the simulated yardage gain was sufficient to achieve a touchdown. If yes (yes a touchdown), then step 1314 progresses to step 1329, of receiving seven (7) points added onto the score for that current offensive player; and wherein step 1329 then progresses into change of possession 1347. Whereas if the inquiry of step 1314 was insufficient simulated yardage gain to result in a touchdown, then step 1314 progresses into another inquiry step, that of step 1315. In some embodiments, step 1315 may be an inquiry step of determining if the simulated yardage gain was sufficient to trigger (obtain) a first down. If yes (i.e., new first down achieved), then step 1315 progresses into step 1316, of resetting the down to first down and resetting the first down marker (e.g., yards to go for a first down 531); wherein step 1316 then may progress back to step 901. Whereas, if step 1315 outcome was that a new first down was not achieved, then step 1315 may progress into step 1319. In some embodiments, step 1319 may be an inquiry step of determining if the previous play was a $4^{th}$ down. If yes (was $4^{th}$ down), then step 1319 progresses into change of possession 1348. Whereas, if no (was not $4^{th}$ down), then step 1319 may progress into step 1320; wherein step 1320 may be a step of advancing the down (or of receiving a down advancement). In some embodiments, step 1320 may then progress back to step 901.

Continuing discussing FIG. 13, in some embodiments, in some embodiments No Gain 1317 may result if the given slider 600 came to rest mostly over no gain regions 251 or short of the simulated end-zone 211 in some embodiments. If No Gain 1317 was the slide outcome, the step 1318 may occur; wherein step 1318 is no change to the LOS (line of scrimmage). In some embodiments, step 1318 may then progress to inquiry step 1319. In some embodiments, step 1319 may be the inquiry step of determining if the previous play was a $4^{th}$ down. If yes (was $4^{th}$ down), then step 1319 progresses into change of possession 1348. Whereas, if no (was not $4^{th}$ down), then step 1319 may progress into step 1320; wherein step 1320 may be the step of advancing the down (or of receiving a down advancement). In some embodiments, step 1320 may then progress back to step 901.

Continuing discussing FIG. 13, in some embodiments, in some embodiments Loss 1321 may result if the given slider 600 came to rest mostly over simulated yardage loss regions. If Loss 1321 was a slide outcome, then step 1321 progresses to step 1322, of retracting the line of scrimmage (LOS). How much the LOS is retracted depends upon the nature of the given simulated yardage loss region and/or where the LOS was located prior to the unsuccessful offensive play. In some embodiments, step 1322 may then progress to an inquiry step, that of step 1323. In some embodiments, step 1323 may be inquiring of the simulated yardage loss resulted in a "safety." If no safety, then step 1323 may progress into step 1320 (wherein step 1320 has been previously discussed above). Whereas, if yes a safety, then step 1323 may progress into step 1330; wherein step 1330 is a step of receiving two (2) added points to the team (player) currently on defense. In some embodiments, step 1330 may also entail moving the LOS to the simulated 35 yard line. In some embodiments, then step 1330 may progress into punt 835.

Continuing discussing FIG. 13, in some embodiments, in some embodiments Penalty 1324 may result if the given slider 600 came to rest mostly over a given penalty region 261. If Penalty 1324 was a slide outcome, then step 1324 progresses to step 1325, of retracting the line of scrimmage (LOS). How much the LOS is retracted depends upon the nature of the given penalty region 261 and/or where the LOS was located prior to the unsuccessful offensive play. In some embodiments, step 1325 may then progress to step 1326; wherein step 1326 may be a step of repeating the last down. In some embodiments, step 1326 may then progress back to step 901.

Continuing discussing FIG. 13, in some embodiments, in some embodiments Turnover 1327 may result if the given slider 600 came to rest mostly over a given turnover region 271. In some embodiments, step 1327 may then progress to step 1328, wherein step 1328 may be a step of advancing the LOS. In some embodiments, step 1328 may then progress to change of possession 1348.

Continuing discussing FIG. 13, in some embodiments, in some embodiments a successful To the House 814 result may occur if the given slider 600 came to rest straddling the end (opposing end) of gaming surface 200 without falling into a catch basin 117. In FIG. 13, outcome 814 may then progress to step 1329 (as discussed above).

Gaming surfaces, as well as games, and methods of play that all simulate American rules football have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A game simulating gameplay of American rules football comprising:

at least one slider configured for sliding translation across a top of a top surface of a gaming surface;

the gaming surface; wherein the gaming surface comprises:

a simulated field region that is rectangular in shape and simulates a look of an American football 100 yard field and simulated play regions; wherein the simulated field region has no simulated play regions along a length of the simulated field region; wherein the simulated play regions are regions of the gaming surface that determine game play by the at least one slider coming to rest upon a location above some portion of the simulated play regions;

two opposing simulated play regions, selected from the simulated play regions, which bound the length of the simulated field region such that the simulated field region is centrally located disposed between the two opposing simulated play regions; wherein the two opposing simulated play regions are separated from each other by the length of the simulated field region; wherein each of the two opposing simulated play regions comprises a plurality of delineated regions indicating gameplay outcomes; and the top surface that is substantially hard, substantially smooth, and substantially flat; wherein the top surface is continuous on upper portions of the simulated field region and of the two opposing simulated play regions, such that the top surface across the upper portions of the simulated field region and of the two opposing simulated play regions exists in a single continuous plane that is substantially horizontal with respect to a floor that the game is resting above; wherein the top surface is configured for receiving sliding translation of the at least one slider across the top of the top surface;

wherein the simulated field region and the two opposing simulated play regions are fixed with respect to each other; and a set of opposing simulated spectator stands; wherein the simulated field region runs between the set of opposing simulated spectator stands;

wherein at least one of the set of opposing simulated spectator stands comprises two opposing electronic user interface controls; wherein each of two opposing electronic user interface controls faces one of the two opposing simulated play regions.

2. The game according to claim 1, wherein the game further comprises a supportive structure for structurally supporting the gaming surface.

3. The game according to claim 2, wherein the supportive structure is selected from: a table, a bench, a desk, a workbench, a pedestal, a stand, a cabinet, a chest, or a chest of drawers.

4. The game according to claim 1, wherein the set of opposing simulated spectator stands is disposed between the two opposing simulated play regions.

5. The game according to claim 1, wherein the game further comprises at least one set of removable defensive blockers which are removably placed upon the top surface to obstruct sliding of the at least one slider of sliding to certain locations selected from the plurality of delineated regions.

6. The game according to claim 1, wherein the gaming surface when viewed from above resembles a capital block letter "I" with a stem capped by two opposing arms, wherein the stem of the capital block letter "I" corresponds to the simulated field region; and wherein the two opposing arms correspond to the two opposing simulated play regions.

7. The game according to claim 1, wherein the top surface of the gaming surface is substantially transparent.

8. The game according to claim 1, wherein the two opposing simulated play regions each comprises simulated play region graphics; wherein the simulated play region graphics are visible from the top surface of the gaming surface; wherein the plurality of delineated regions are located within each of the simulated play regions graphics; wherein the at least one slider coming to rest upon the location over a given graphic selected from the simulated play region graphics indicates an outcome of gameplay.

9. The game according to claim 8, wherein each of the simulated play region graphics comprise one or more of: run targets, pass targets, kick targets, no gain regions, penalty regions, and turnover regions.

10. The game according to claim 1, wherein the simulated field region comprises simulated field graphics; wherein the simulated field graphics are visible from the top surface of the gaming surface; wherein the simulated field graphics comprise a plurality of yardage markers that simulate a look of the American football 100 yard field.

11. The game according to claim 10, wherein the simulated field graphics further comprise at least one of: two opposing goal lines, two opposing simulated end-zones, a logo or trademark region, or a plurality of major yardage markers.

* * * * *